US006815157B2

(12) United States Patent
Kondo et al.

(10) Patent No.: US 6,815,157 B2
(45) Date of Patent: Nov. 9, 2004

(54) SILVER HALIDE EMULSION AND SILVER HALIDE PHOTOGRAPHIC MATERIAL

(75) Inventors: Toshiya Kondo, Hino (JP); Shuji Murakami, Matsuda-machi (JP); Koichiro Kuroda, Hino (JP)

(73) Assignee: Konica Minolta Holdings, Inc., Tokyo (JP)

( * ) Notice: Subject to any disclaimer, the term of this patent is extended or adjusted under 35 U.S.C. 154(b) by 0 days.

(21) Appl. No.: 10/756,415

(22) Filed: Jan. 14, 2004

(65) Prior Publication Data

US 2004/0146816 A1 Jul. 29, 2004

(30) Foreign Application Priority Data

Jan. 20, 2003 (JP) ..... 2003-010482

(51) Int. Cl.[7] ..... G03C 1/09; G03C 1/015; G03C 1/34

(52) U.S. Cl. ..... 430/569; 600/603; 600/604; 600/605; 600/611

(58) Field of Search ..... 430/569, 600, 430/603, 604, 605, 611

(56) References Cited

U.S. PATENT DOCUMENTS 3,062,654 A * 11/1962 Allen et al.
4,960,689 A * 10/1990 Nishikawa et al.
5,009,992 A * 4/1991 Friedrich et al.
5,079,138 A * 1/1992 Takada
5,217,859 A * 6/1993 Boettcher et al.
5,219,721 A * 6/1993 Klaus et al.
5,229,263 A * 7/1993 Yoshida et al.
5,418,127 A * 5/1995 Budz et al.
5,698,388 A * 12/1997 Waki
5,851,753 A * 12/1998 Yamada et al.

* cited by examiner

*Primary Examiner*—Richard L. Schilling
(74) *Attorney, Agent, or Firm*—Finnegan, Henderson, Farabow, Garrett & Dunner, L.L.P.

(57) ABSTRACT

A silver halide emulsion comprising silver halide grains containing at least 90 mol % chloride, 0.02 to 5.0 mol % bromide and 0 to 2.0 mol % iodide, which is prepared by a process comprising (i) forming a silver halide grain emulsion, (ii) subjecting the silver halide emulsion to desalting and (iii) subjecting the desalted silver halide emulsion to chemical sensitization by adding a chemical sensitizer, wherein in the step (iii), at least one compound represented by the following formula (1) to (4) is added before adding a chemical sensitizer and at least one compound represented by the following formula (1) to (4) is further added after adding a chemical sensitizer formula (1)

$$R—SO_2S—M$$

formula (2)

$$R_1—SO_2S—R_2$$

formula (3)

$$R_3—SO_2S—L_m—SSO_2—R_4$$

formula (4)

$$R_{11}—(S)_{m1}—R_{12}.$$

15 Claims, No Drawings

SILVER HALIDE EMULSION AND SILVER HALIDE PHOTOGRAPHIC MATERIAL

FIELD OF THE INVENTION

The present invention relates to a silver halide photographic emulsion, a silver halide photographic material and an image forming method, which exhibit enhanced sensitivity, minimized fog density and superior contrast, improved storage stability and pressure resistance, resulting in stable high quality prints, and leading to superior image quality and enhanced print reproducibility specifically when subjected to digital exposure at a relatively high intensity for a short time.

BACKGROUND OF THE INVENTION

Recent rapid directivity to digitization has led to increased opportunities of subjecting silver halide photographic materials to digital exposure. Along with such a trend, photographic color paper as a photographic material for color prints is desired with respect to suitability for exposure at a relatively high intensity for an extremely short time at the level of milli-seconds to nano-seconds and aptitude for scanning exposure.

There have been employed silver chloride emulsions or high chloride silver halide emulsions in color paper to achieve rapid processability. Further, it is commonly known that doping iridium compounds is effective to improve reciprocity law failure characteristics as a matter of properties of silver halide emulsions. There are disclosed silver high chloride halide emulsion grains having a high bromide region in the vicinity of the corners of the grains, as described in JP-A No. 64-26837 (hereinafter, the term JP-A refers to Japanese Patent Application publication; silver high chloride halide emulsion grains in which a bromide-localized region is selectively doped with an iridium compound, thereby leading to superior latent image stability and reciprocity law failure characteristics, as described in JP-A No. 1-105940. There is also disclosed a method of forming a bromide-localized region by using fine silver bromide grains doped with an iridium compound, as described in U.S. Pat. No. 5,627,020. However, neither of the foregoing methods was sufficient for improving latent image stability in the initial stage after exposure.

In a digital exposure system of the recent subject, it was proved that sufficient practical qualities were not achieved only by known techniques for improving latent image stability, in exposure suitability at a high intensity for an extremely short time. Techniques adaptable to such a digital exposure system include, for examples, chemical sensitization and spectral sensitization suitable for formation of a bromide-localized phase, as described in U.S. Pat. No. 5,691,119; and the use of a silver iodochloride emulsion, as described in European Patent Nos. 750,222 and 772,079.

However, it was proved by studies of the inventors of this application that the foregoing techniques for improving aptitude for digital exposure was not only insufficient for improving latent image stability but also resulted in marked deteriorated pressure resistance and pre-exposure storage stability of photographic materials. It is desired to immediately solve this matter.

JP-A No. 2001-188311 discloses a method for improving reciprocity law failure and coating solution stability, in which silver halide grains contain a bromide-rich or iodide-rich phase in the vicinity of the grain surface and introduction of such a rich phase is separated into two occasions, before and after addition of mercapto compounds. However, it was proved that using only this method was insufficient for improving storage stability of silver halide emulsions.

JP-A Nos. 6-19024 and 6-19026 disclose that adding non-labile di-chalcogen compounds before or during formation of silver halide grains, or during spectral/chemical sensitization of a silver halide emulsion improves fresh fog or aging fog. Further, JP-A No. 6-19037 discloses adding such compounds in the form of a solid particle dispersion and JP-A No. 6-35147 discloses that a silver chloride emulsion containing a diaminodisulfide compound and a sulfonate compound at a weight ratio of 1:1 to 1:20 improves storage stability and performance variation caused by temperature fluctuation at the time of exposure on color photographic materials.

JP-A No. 6-202265 discloses that adding a specific disulfide compound and a specific sulfinate or seleninate compound before or during spectral/chemical sensitization results in reduced fogging and enhanced sensitivity. There is also disclosed a photographic element comprising a silver chloride emulsion including a water-soluble disulfide compound, leading to reduced fogging, reduced variation in fog density and sensitivity after pre-exposure storage and reduced variation in sensitivity due to temperature fluctuation at the time of exposure, as described in JP-A No. 7-72580.

However, neither of the foregoing methods was sufficient in description and effectiveness with respect to latent image stability, storage stability and pressure resistance, specifically, latent image stability, storage stability and pressure resistance of emulsions exposed at a high intensity.

JP-A Nos. 2002-182326 and 2002-162707 discloses a photographic material comprising a silver high chloride emulsion and a mercapto compound, in embodiments of which the mercapto compound is added to a coating solution or after chemical sensitization; JP-A No. 8-234354 discloses a photographic element comprising a thiosulfonate, a sulfonate and silver iodochloride grains. However, neither of them is characterized in a method of using these compounds and improvements in sensitivity, fogging, latent image, reciprocity failure, storage stability and pressure resistance were limitative ones.

SUMMARY OF THE INVENTION

It is an object of the present invention to provide a silver halide emulsion, a silver halide photographic material and an image forming method, which exhibit enhanced sensitivity, minimized fog density and superior contrast, improved storage stability and pressure resistance, resulting in stable high quality prints, and leading to superior image quality and enhanced print reproducibility specifically when subjected to digital exposure at a relatively high intensity for a short time.

As a result of extensive study by the inventors of this application in light of the foregoing problems, it was found that the foregoing object of the invention could be achieved by adding a compound relating to this invention in such a manner as defined in this invention after formation of host grains and in the stage of chemical sensitization.

Although the compound relating to this invention has been widely used as a sensitizer, antifogging agent or development inhibitor in the process of preparing silver halide emulsions, an achievement of the object of this invention is not expected from the prior art described above and surprising.

In one aspect the present invention is direct to a silver halide emulsion comprising silver halide grains containing at least 90 mol % chloride, 0.02 to 5.0 mol % bromide and 0 to 2.0 mol % iodide, wherein the silver halide emulsion is prepared by a process comprising the steps of (i) forming a silver halide grain emulsion, (ii) subjecting the silver halide emulsion to desalting to remove soluble salts and (iii) subjecting the desalted silver halide emulsion to chemical sensitization by adding a chemical sensitizer, wherein in the step (iii), at least one compound represented by the following formula (1) to (4) is added before adding a chemical sensitizer and at least one compound represented by the following formula (1) to (4) is further added after adding a chemical sensitizer:

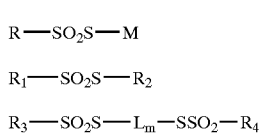

formula (1)

formula (2)

formula (3)

wherein R, $R_1$, $R_2$, $R_3$, and $R_4$ are each an aliphatic group, an aromatic group or a heterocyclic group; M is a cation; L is a divalent linkage group; and m is 0 or 1;

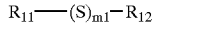

formula (4)

wherein $R_{11}$ and $R_{12}$ are each an aliphatic group, an aromatic group or a heterocyclic group, or $R_{11}$ and $R_{12}$ combine with each other to form a ring; m1 is an integer of 2 to 6;

Another aspect of the invention is a silver halide photographic material comprising on a support at least one image forming layer, wherein the image forming layer comprises a silver halide emulsion as claimed in claim 1.

Another aspect the invention is directed to a method of preparing the above-described silver halide emulsion comprising the steps of (i) forming a silver halide grain emulsion by mixing a silver salt and a halide salt to form silver halide host grains, (ii) subjecting the silver halide grain emulsion to desalting to remove soluble salts and (iii) subjecting the desalted silver halide emulsion to chemical sensitization by adding a chemical sensitizer, wherein in the step (iii), at least one compound represented by the foregoing formula (1) to (4) is added before adding a chemical sensitizer and at least one compound represented by the formula (1) to (4) is further added after adding a chemical sensitizer.

Further in another aspect the invention is directed to an image forming method comprising the steps of (i) subjecting the above-described photographic material to scanning exposure and (ii) subjecting the exposed photographic material to photographic color processing to form images.

DETAILED DESCRIPTION OF THE INVENTION

Silver halide grains included in the silver halide emulsion relating to this invention have an average chloride content of at least 90 mol %, preferably at least 95 mol %, and more preferably at least 97 mol %, based on silver. The silver halide grains have an average iodide content of 0 to 2.0 mol %, preferably 0.01 to 1.0 mol % and more preferably 0.02 to 0.5 mol %, based on silver.

The silver halide grains relating to this invention preferably have at least one iodide-localized silver halide phase in the interior of the grains. In the invention, the interior of the grains refers to a silver halide phase, except for the grain surface. The iodide-localized silver halide phase (hereinafter, also denoted as iodide-localized phase) is a silver halide phase having at least two times the average iodide content of the grains, preferably at least three times the average iodide content, and more preferably at least 5 times the average iodide content. The iodide-localized phase is located in a portion external to 60% (preferably 70%, and more preferably 80%) of the grain volume within the grain. In other words, the iodide-localized phase is located in an exterior region outside the interior region accounting for at least 60% of the total silver forming the grains. The iodide-localized phase is located in a portion external to preferably 70%, and more preferably 80% of the grain volume within the grain.

In one embodiment of this invention, the iodide-localized phase is in a layer form in the interior of the grains. It is preferred to introduce at least two of such iodide-localized layers. In this case, the main layer is introduced under the conditions described above and at least a layer having an iodide content less than the maximum iodide content (also denoted as a sub-layer) is introduced so that the sub-layer is located nearer to the grain surface than the main layer. Iodide contents of the main layer and sub-layer can be optionally selected according to the object. It is preferred in terms of latent image stability that the main layer has an iodide content as high as possible and the sub-layer has an iodide content less than that of the main phase.

In one preferred embodiment of this invention, a iodide-localized phase is located near the corners, at edges or on the outermost surface of the grain. The iodide-localized phase can be introduced using a variety of iodine compounds. Examples thereof include the use of an aqueous iodide salt solution, such as an aqueous potassium iodide solution, the use of a polyiodide compound, as described in S. Nakahara "Mukikagobutsu.Sakutai Jiten" (Dictionary of Inorganic Compound and Complex, page 944, published by Kodansha) and the use of fine iodide-containing silver halide grains or iodide ion-releasing agents, as disclosed in JP-A No. 2-68538. The use of potassium iodide or a polyiodide of $I_4$ or higher is preferred, and the use of a polyiodide of $I_4$ or higher is more preferred in terms of rapid processability and process stability. The iodide content of the iodide-localized phase can be controlled by arbitrarily adjusting a concentration or a quantity of an iodide containing solution.

Silver halide grains included in a silver halide emulsion relating to this invention usually contain 0.02 to 5.0 mol % bromide, preferably 0.03 to 3.0 mol % bromide, and more preferably 0.05 to 2.0 mol % bromide. In the silver halide grains, the bromide containing silver halide phase preferably accounts for 50 to 100%, and more preferably 70 to 100% of the grain volume.

A silver halide emulsion comprising silver halide grains having a high bromide portion within the grain is also preferred in this invention. The high bromide portion may be formed by an epitaxial junction or by forming a core/shell structure. Alternatively, there may exist regions partially differing in bromide composition without forming a complete layer. The bromide composition may be continuously varied or discontinuously varied, and silver halide grains having a bromide-localized phase in the vicinity of corners of the grain are preferred. The expression bromide-localized phase herein means a silver halide phase having a relatively high bromide content. Thus, the bromide-localized phase has a bromide content of at least two times the average bromide content of the grains, preferably at least three times and more preferably at least 5 times the average bromide content. The bromide-localized phase preferably contains a Group 8 metal compound, as described later. The Group 8 metal compound is preferably an iridium complex compound.

In this invention, after completion of desalting of a silver halide host grain emulsion, at least one compound represented by the foregoing formulas (1) to (4) is added before adding a chemical sensitizer and at least one compound represented by the formulas (1) to (4) is further added after adding a chemical sensitizer. The foregoing two compounds added before and after adding a chemical sensitizer may be the same or different.

In one preferred embodiment of this invention, at least one compound represented by the foregoing formula (1), (2) or (3) is added to a silver halide grain emulsion relating to this invention after completion of desalting of the silver halide host grain emulsion, and respectively before and after adding a chemical sensitizer.

In formulas (1) to (3), aliphatic groups represented by R, and $R_1$ through $R_4$ are each a saturated or unsaturated, straight chain, branched or cyclic aliphatic hydrocarbon group, and preferably an alkyl group having 1 to 22 carbon atoms, or an alkenyl or alkynyl group having 2 to 22 carbon atoms. Specific examples of the alkyl group include methyl, ethyl, propyl, butyl, pentyl, hexyl, octyl, 2-ethylhexyl, decyl, dodecyl, hexadecyl, octadecyl, cyclohexyl, isopropyl, and t-butyl; examples of the alkenyl group include allyl and butenyl; and examples of the alkynyl group include propargyl.

Aromatic groups represented by R, and $R_1$ through $R_4$ include monocyclic and condensed ring aromatic groups. Preferred aromatic groups are those having 6 to 20 carbon atoms, such as phenyl and naphthyl.

Heterocyclic groups represented by R, and $R_1$ through $R_4$ include monocyclic and condensed ring ones, which are groups derived from 3- to 10-membered heterocycles containing at least one atom selected from nitrogen atom, oxygen atom, sulfur atom, selenium atom tellurium atom and at least one carbon atom. Examples thereof include a pyrrolidine ring group, piperidine ring group, pyridine ring group, tetrahydrofuran ring group, thiophene ring group, oxazole ring group, thiazole ring group, imidazole ring group, benzothiazole ring group, benzoxazole ring group, benzimidazole ring group, selenazole ring group, benzoselenazole ring group, tetrazole ring group, triazole ring group, benzotriazole ring group, oxadiazole ring group and thiadiazole ring group.

The foregoing aliphatic group, aromatic group and heterocyclic group represented by R, and $R_1$ through $R_4$ may further be substituted. Specific examples of substituents include an alkyl group (e.g., methyl, ethyl, hexyl), alkoxy group (e.g., methoxy, ethoxy, octyloxy), aryl group (e.g., phenyl, naphthyl, tolyl), hydroxy group, halogen atom (e.g., fluorine atom, chlorine atom, bromine atom, iodine atom), aryloxy group (e.g., phenoxy), alkylthio group (e.g., methylthio, butylthio), arylthio group (e.g., phenylthio), acyl group (e.g., acetyl, propionyl, butylyl, valeryl), sulfonyl group (methylsulfinyl, phenylsulffonyl), acylamino group (e.g., acetylamino, benzoylamino), sulfonylamino group (e.g., methanesulfonylamino, benzenesulfonylamino), acyloxy group (e.g., acetoxy group, benzoxy group), carboxyl group, cyano group, sulfo group, amino group, —$SO_2SM$, and aliphatic, aromatic and heterocyclic groups represented by the foregoing R, and $R_1$ through $R_4$.

Divalent linkage group represented by L is an atom selected from carbon atom, nitrogen atom, sulfur atom and oxygen atom or an atomic group containing at least one atom selected from the foregoing atoms. Specific examples thereof include an alkylene group, alkenylene group, alkynylene group, arylene group, —O—, —S—, —NH—, —CO—, —$SO_2$— and their combinations. The divalent linkage group represented by L is preferably a divalent aliphatic or aromatic group, such as —$(CH_2)_n$— (in which n is 1–12), —$CH_2$—CH═CH—$CH_2$—, —$CH_2$—C≡C—$CH_2$—, xylene group, phenylene group, naphthylene group, and

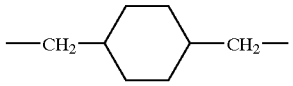

The divalent linkage group represented by L may be substituted by the substituent described above.

M is a cation, and preferably a metal ion, ammonium ion or an organic cation. Examples of a metal ion include lithium ion, sodium ion and potassium ion. Examples of an organic ion include an alkylammonium ion (e.g., tetramethylammonium, tetrabutylammonium), phosphonium ion (e.g., tetraphenylphosphonium) and guanidyl group.

The compound represented by the foregoing formula (1) to (3) may be included in a polymer, as a component element of the polymer. Thus, in cases where the compound represented by formula (1) to (3) is included in a polymer, repeating units forming the polymer are, for examples, as follows.

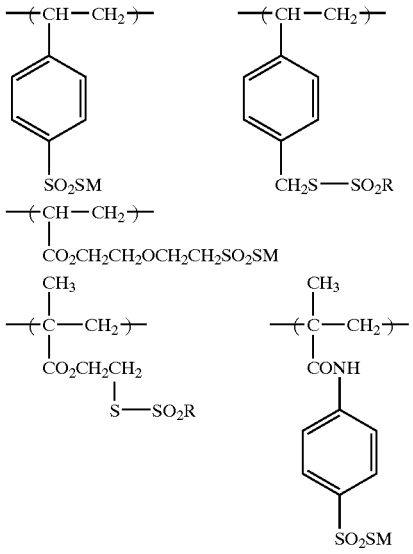

A polymer containing the foregoing repeating unit may be a homopolymer or may form its copolymer with other polymer(s).

Specific examples of the compound represented by formula (1) to (3) and specific examples of a polymer containing a compound represented by formula (1) to (3) as a component element of the polymer are shown below but are by no means limited to these.

$CH_3SO_2SNa$ (1-1)

$C_2H_5SO_2SNa$ (1-2)

$C_2H_5SO_2SK$ (1-3)

-continued
(1-4) $C_4H_9SO_2SLi$
(1-5) $C_6H_{13}SO_2SNa$
(1-6) $C_8H_{17}SO_2SNa$
(1-7) $CH_3(CH_2)_3-CH(C_2H_5)CH_2SO_2S\cdot NH_4$
(1-8) $C_{10}H_{21}SO_2SNa$
(1-9) $C_{12}H_{25}SO_2SNa$
(1-10) $C_{16}H_{33}SO_2SNa$
(1-11) $(CH_3)_2CH-SO_2SK$
(1-12) $(t)C_4H_9SO_2SNa$
(1-13) $CH_3OCH_2CH_2SO_2S\cdot Na$
(1-14) 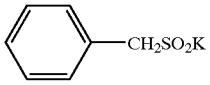
(1-15) $CH_2=CHCH_2SO_2SNa$
(1-16) 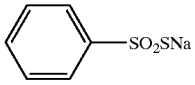
(1-17) 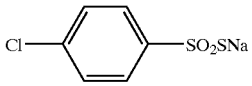
(1-18) 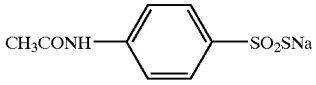
(1-19) 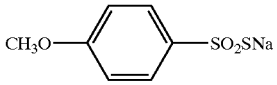
(1-20) 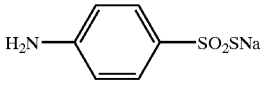
(1-21) 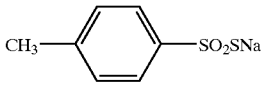
(1-22) 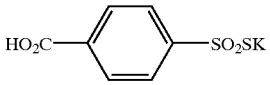
(1-23) 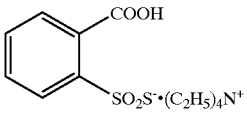
(1-24) 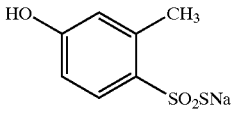
(1-25) 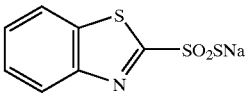
(1-26) 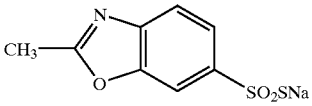
(1-27) 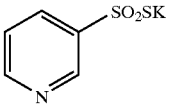
(1-28) 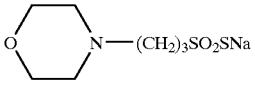
(1-29) $KSSO_2(CH_2)_3SO_2SK$
(1-30) $NaSSO_2(CH_2)_4SO_2SNa$
(1-31) $NaSSO_2(CH_2)_4S(CH_2)_4SO_2SNa$
(1-32) 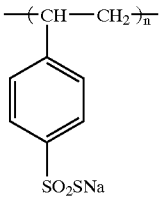
(1-33) 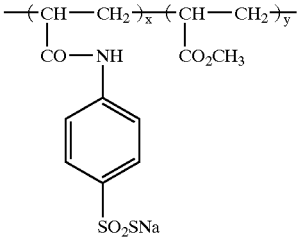
x:y=1:1 (molar ratio)
(1-34) 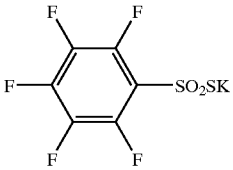
(1-35) 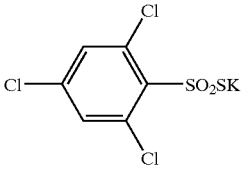
(2-1) $C_2H_5SO_2S-CH_3$
(2-2) $C_8H_{17}SO_2SCH_2CH_3$
(2-3) 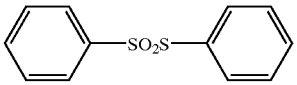

-continued
(2-4)
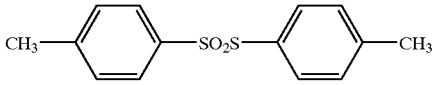
(2-5)
$C_2H_5SO_2SCH_2CH_2CN$
(2-6)
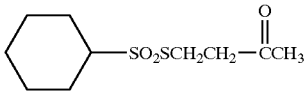
(2-7)
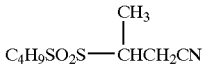
(2-8)
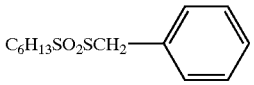
(2-9)
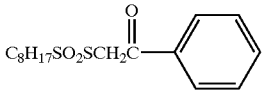
(2-10)
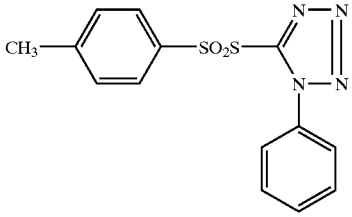
(2-11)
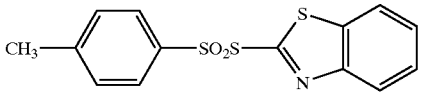
(2-12)
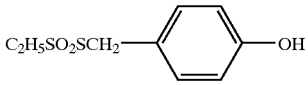
(2-13)
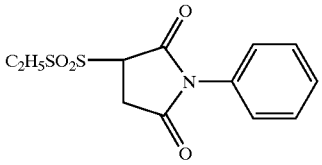
(2-14)
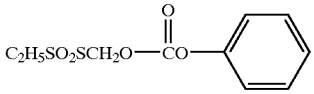
(2-15)
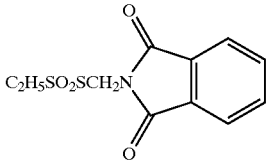
(2-16)
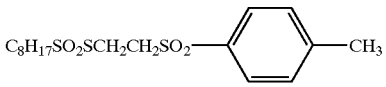
(2-17)
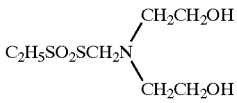
-continued
(2-18)
$C_2H_5SO_2SCH_2CH_2CH_2CH_2OH$
(2-19)
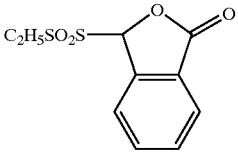
(2-20)
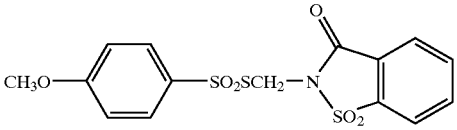
(2-21)
$CH_3SSO_2(CH_2)_4SO_2SCH_3$
(2-22)
$CH_3SSO_2(CH_2)_8SO_2SCH_3$
(2-23)
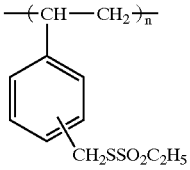
(2-24)
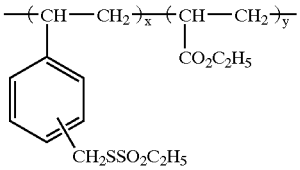
x:y=2:1 (molar ratio)
(2-25)
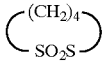
(3-1)
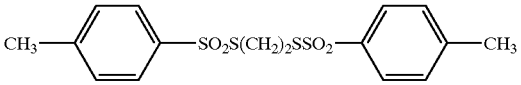
(3-2)
$C_2H_5SO_2SCH_2CH_2SO_2CH_2CH_2SSO_2C_2H_5$
(3-3)
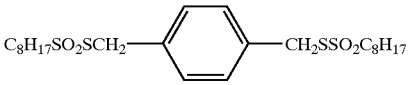
(3-4)
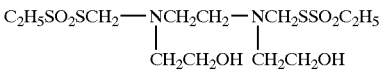
(3-5)
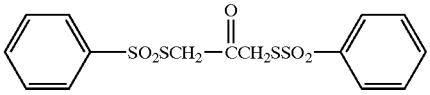
(3-6)
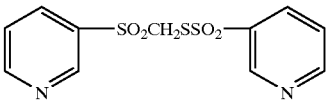
(3-7)
$C_2H_5SO_2SSSO_2C_2H_5$
(3-8)
$(n)C_3H_7SO_2SSSO_2C_3H_7(n)$ -continued (3-9)

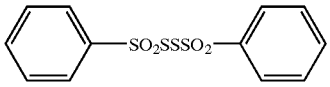

One feature of preparation of silver halide emulsions relating to this invention is that desalting is conducted after formation of the silver halide host grains. In this invention, silver halide host grains refer to silver halide grains having formed a silver halide phase corresponding to at least 90% of the total silver forming the final grains.

Desalting can be carried out according to methods described in Research Disclosure (hereinafter, also denoted simply as RD) 17643, section II. Thus, to remove unnecessary (or unwanted) soluble salts from a precipitation product or an emulsion which has been subjected to physical ripening, a noodle washing may be employed by allowing gelatin to be gelled or there may be used inorganic salts, anionic surfactants or anionic polymers (e.g., polystyrenesulfonic acid). In particular, coagulation desalting using gelatin derivatives or chemically modified gelatin (such as acylated gelatin or carbamoylated gelatin) and ultrafiltration desalting employing membrane separation are preferred.

Ultrafiltration employing membrane separation can be conducted with reference to methods described in "Kagaku Kogaku Binran" (Chemical Engineering Handbook, edited by Kagaku Kogaku Kyokai, published by Maruzen) page 924–954; RD 10208 and RD 13122; JP-B Nos. 59-43727 and 62-27008 (hereinafter, the term JP-B refers to Japanese Patent publication); JP-A Nos. 62-113137, 57-209823, 59-43727, 62-113137, 61-219948, 62-23035, 63-40137, 63-40039, 3-140946, 2-172816, 2-172817 and 4-22942. Ultrafiltration can also be carried out employing apparatuses or methods described in JP-A Nos. 11-339923 and 11-231448.

In this invention, the chemical sensitizer refers to a chalcogen sensitizer containing sulfur, selenium or tellurium, noble metal sensitizer such as gold or platinum, silver sulfide, gold-silver sulfide and gold sulfide.

In one preferred embodiment of this invention, at least one compound represented by the foregoing formula (4) is added to a silver halide grain emulsion after completion of desalting host grains of the silver halide grain emulsion, and respectively before and after adding a chemical sensitizer.

In formula (4), aliphatic groups represented by $R_{11}$ and $R_{12}$ include straight chain or branched alkyl, alkenyl or alkynyl group having 1 to 30 carbon atoms (preferably 1 to 20 carbon atoms) and a cycloalkyl group. Specific examples thereof include methyl, ethyl, propyl, butyl, hexyl, decyl, dodecyl, isopropyl, t-butyl, 2-ethylhexyl, allyl, 2-butenyl, 7-octenyl,propargyl, 2-butynyl, cyclopropyl, cyclopentyl, cyclohexyl and cyclododecyl. Aromatic groups represented by $R_{11}$ and $R_{12}$ include ones having 6 to 20 carbon atoms, such as phenyl, naphthyl and anthranyl. Heterocyclic groups represented by $R_{11}$ and $R_{12}$ may be a monocyclic one or a condensed ring one, including, for example, 5- or 6-membered heterocyclic group containing at least one of O, S and N atoms and amineoxide group within the ring. Specific examples of the heterocyclic group include groups derived from pyrrolidine, piperidine, tetrahydrofuran, tetrahydropyrane, oxirane, morpholine, thiomorpholine, thiopyrane, tetrahydrothiopyrane, pyrrole, pyridine, furan, thiophene, imidazole, pyrazole, oxazole, thiazole, isooxazole, isothiazole, triazole, tetrazole, thiadiazole, oxadiazole and their benzenelogs. Rings formed by $R_{11}$ and $R_{12}$ include 4- to 7-membered rings and 5- to 7-membered rings are preferred. $R_{11}$ and $R_{12}$ are preferably a heterocyclic group or aromatic group, and more preferably a heterocyclic group. The foregoing aliphatic, aromatic and heterocyclic groups represented by $R_{11}$ and $R_{12}$ may be substituted by a substituent. Specific examples of such a substituent include a halogen atom (e.g., chlorine atom, bromine atom), alkyl group (e.g., methyl, ethyl, propyl, hydroxyethyl, methoxymethyl, trifluoromethyl, t-butyl), cycloalkyl group (e.g., cyclopentyl, cyclohexyl9, aralkyl group (e.g., benzyl, 2-phenethyl), aryl group (e.g., phenyl, naphthyl, p-tolyl, p-chlorophenyl), alkoxy group (e.g., methoxy, ethoxy, isopropoxy, butoxy), aryloxy group (e.g., phenoxy, 4-methoxyphenoxy), cyano group, acylamino group (e.g., acetylamino, propionylamino), alkylthio group (e.g., methylthio, ethylthio, butylthio), arylthio group (e.g., phenylthio, p-methylphenylthio), sulfonylamino group (e.g., methanesulfonylamino, benzenesulfonylamino), ureido group (e.g., 3-methylureido, 3,3-dimethylureido, 1,3-dimethylureido), sulfamoylamino (e.g., dimethylsulfamoylamino, diethylsulfamoylamino), carbamoyl group (e.g., methylcarbamoyl, ethylcarbamoyl, dimethylcarbamoyl), sulfamoyl group (e.g., ethylsulfamoyl, dimethylsulfamoyl), alkoxycarbonyl group (e.g., methoxycarbonyl, ethoxycarbonyl), aryloxycarbonyl group (e.g., phenoxycarbonyl, p-chlorophenoxycarbonyl), sulfonyl group (e.g., methanesulfonyl, butanesulfonyl, phenylsulfonyl), acyl group (e.g., acetyl, propanoyl, butyloyl), amino group (e.g., methylamino, etylamino, dimethylamino), hydroxy group, nitro group, nitroso group, amineoxide group (e.g., pyridine oxide), imido group (e.g., phthalimido), and disulfide group (e.g., benzenesulfide, benzthiazolyl-2-disulfide).

Specific examples of the compound represented by formula (4) are shown below but are not limited to these.

4-0

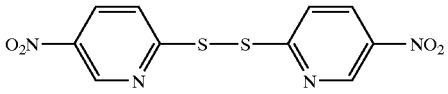

4-1

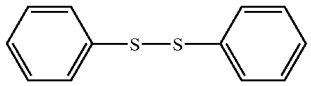

4-2

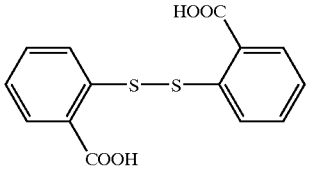

4-3

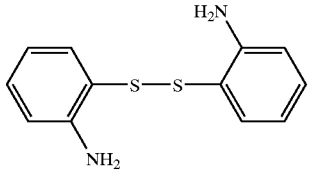

-continued
4-4
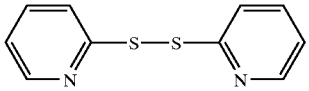
4-5
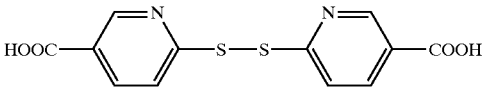
4-6
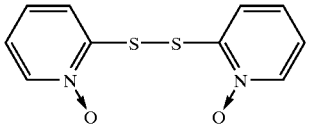
4-7
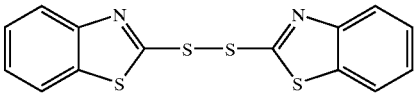
4-8
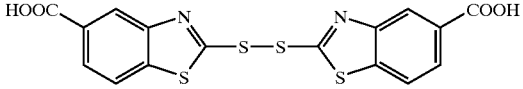
4-9
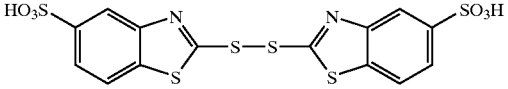
4-10
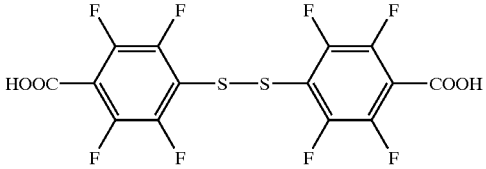
4-11
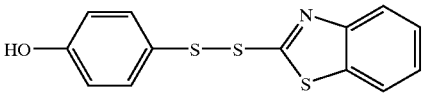
4-12
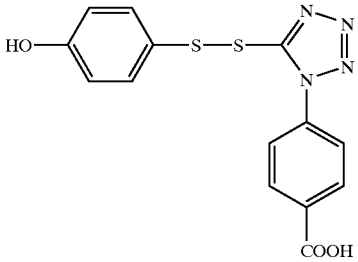
4-13
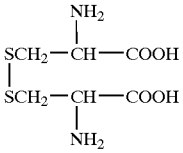
4-14
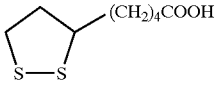
4-15
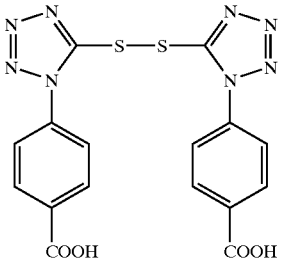
4-16
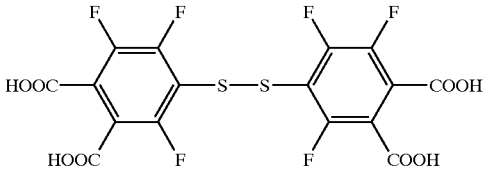
4-17
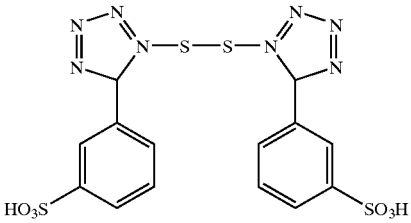
4-18
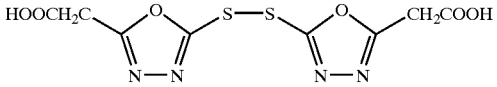
4-19
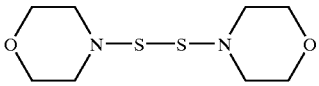
4-20
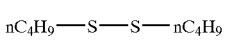
4-21
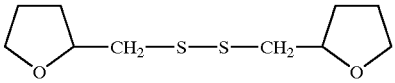
4-22
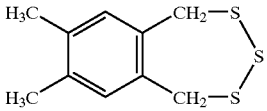
4-23
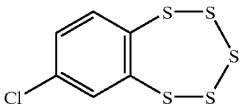

-continued
4-24
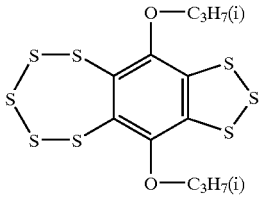
4-25
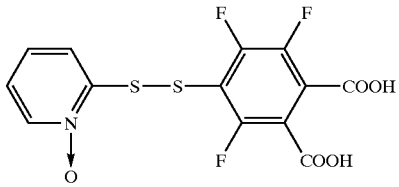
4-26
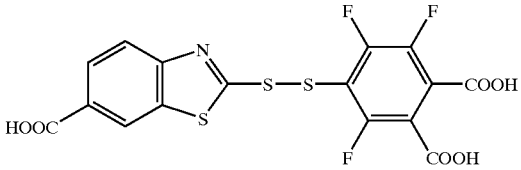
4-27
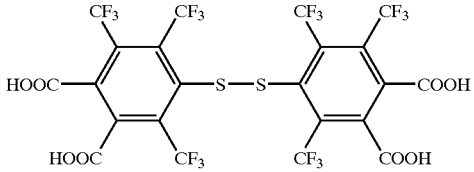
4-28
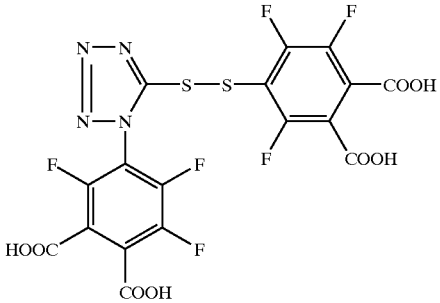
4-29
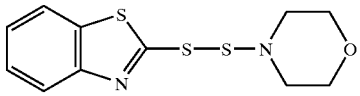
4-30
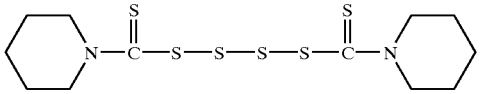
4-31
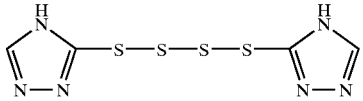
4-32
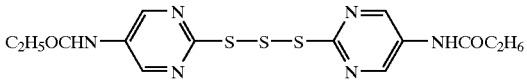
4-33
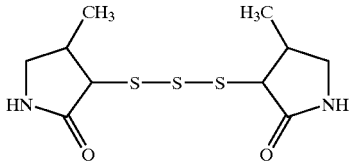
5-1
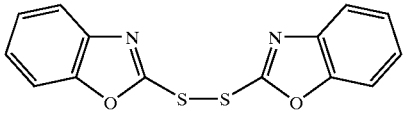
5-2
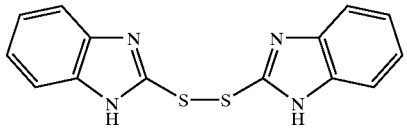
5-3
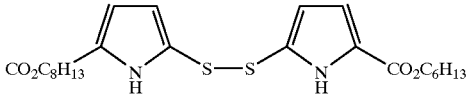
5-4
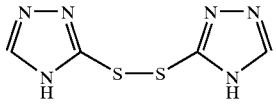
5-5
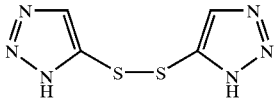
5-6
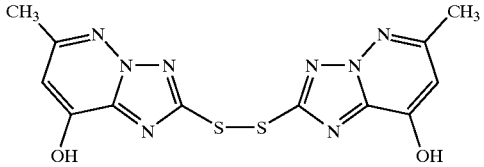
5-7
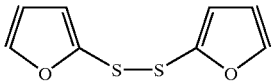
5-8
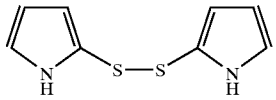

-continued
5-9
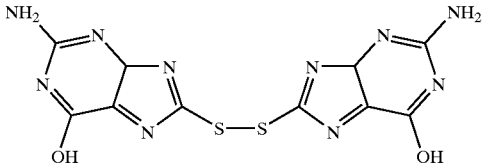
5-10
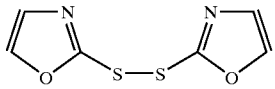
5-11
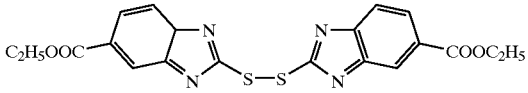
5-12
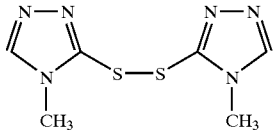
5-13
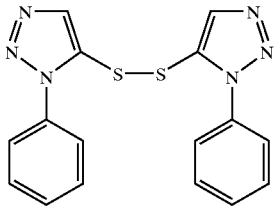
5-14
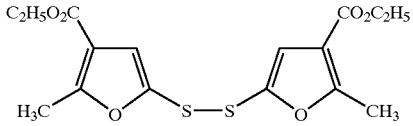
5-15
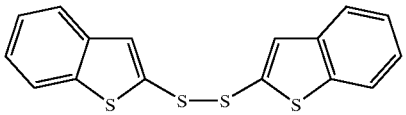
5-16
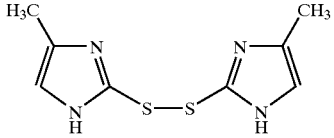
5-17
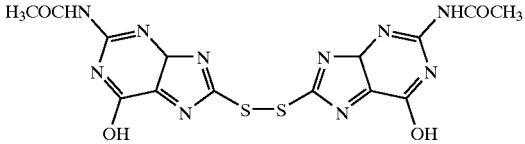
5-18
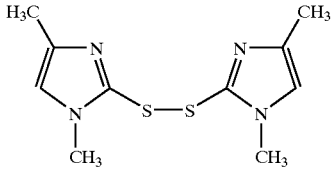
6-1
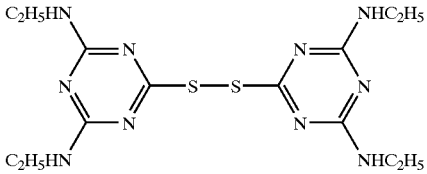
6-2
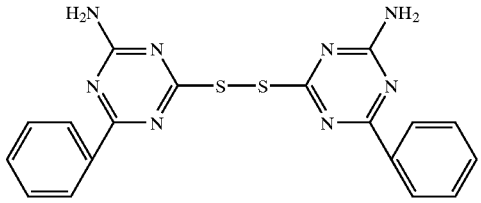
6-3
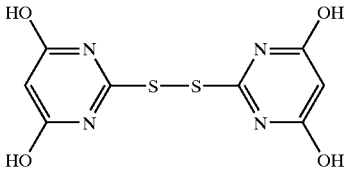
6-4
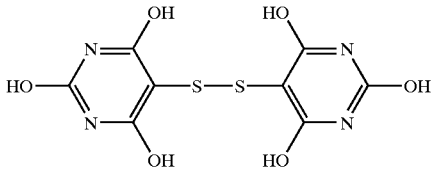
6-5
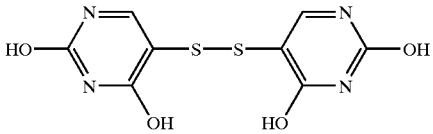
6-6
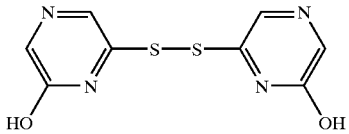
6-7
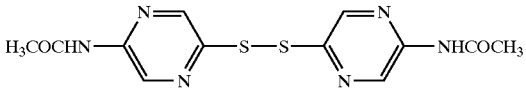
6-8
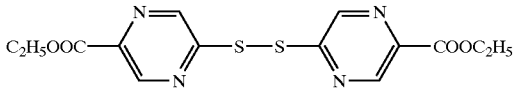

-continued
6-9
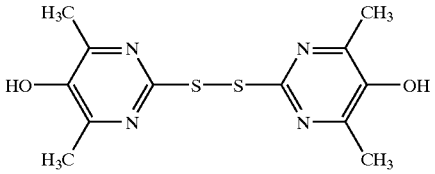
7-1
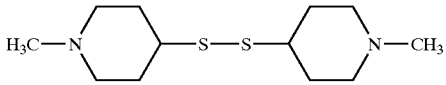
7-2
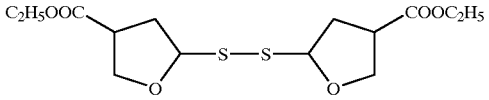
7-3
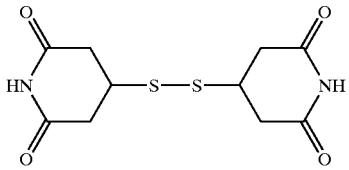
7-4
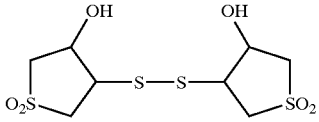
7-5
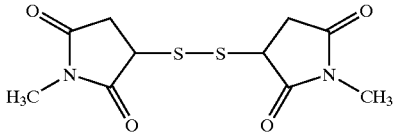
7-6
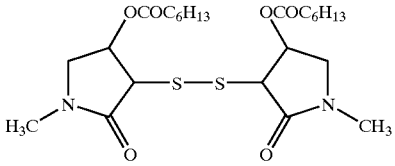
7-7
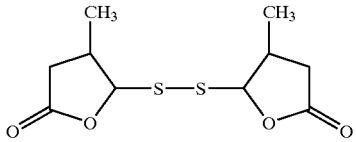
7-8
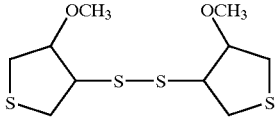
7-9
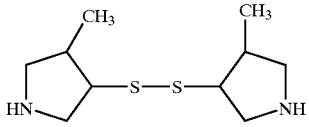
8-1
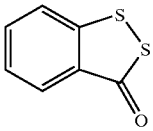
8-2
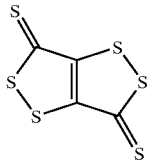
8-3
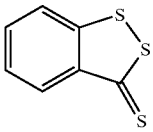
8-4
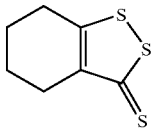
8-5
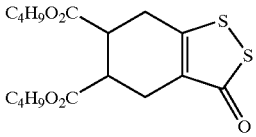
8-6
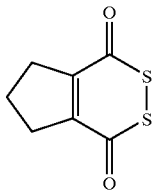
8-7
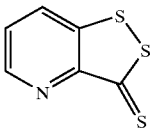
8-8
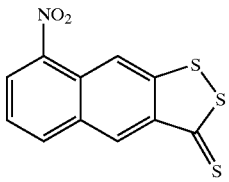

-continued
8-9
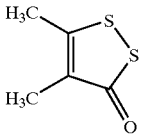
9-1
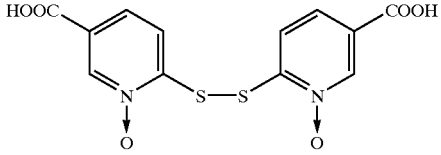
9-2
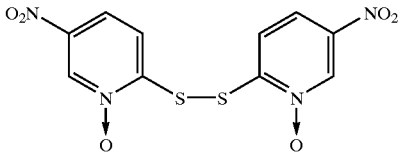
9-3
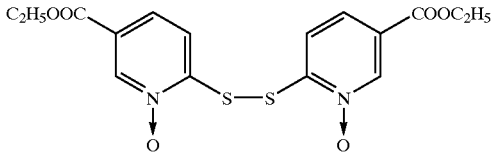
9-4
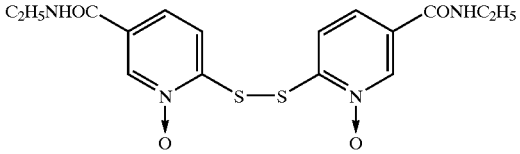
9-5
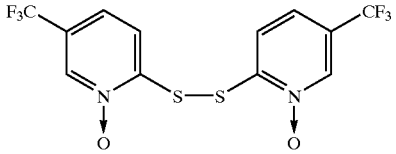
9-6
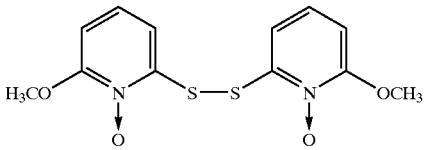
9-7
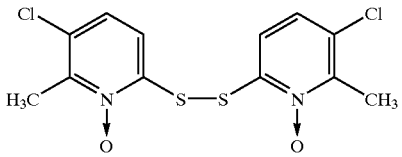
9-8
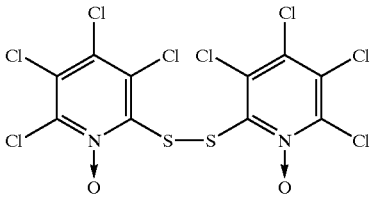
9-9
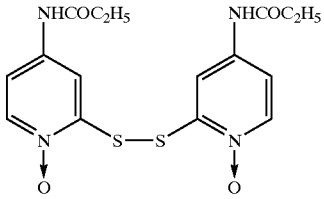
9-10
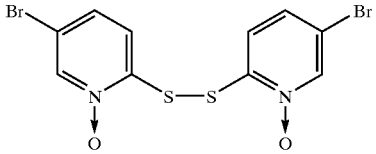
9-11
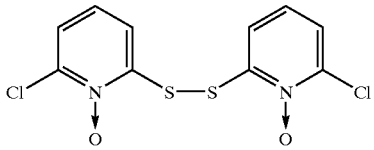
9-12
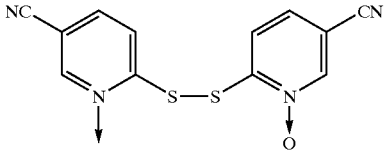
9-13
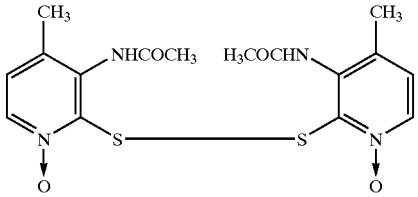
9-14
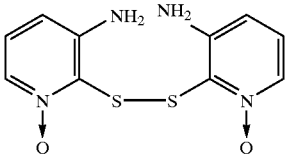
9-15
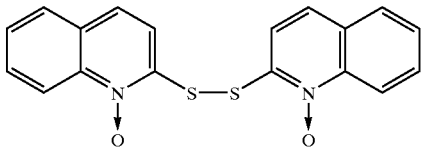
9-16
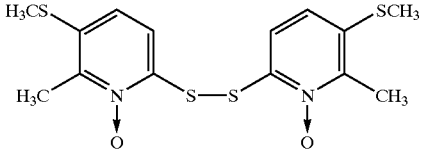
9-17
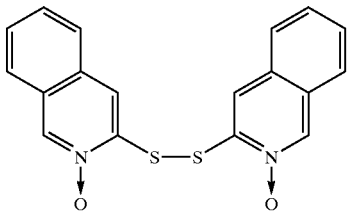

-continued
9-18
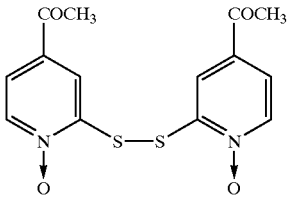
10-1
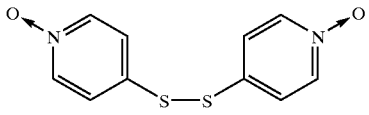
10-2
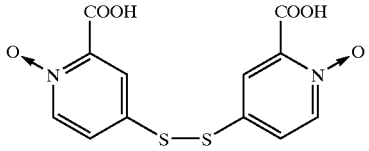
10-3
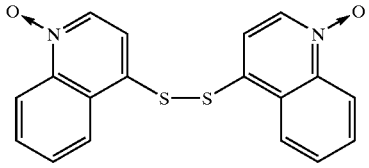
10-4
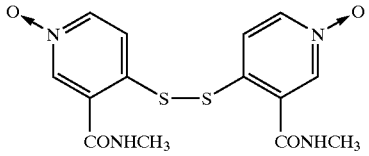
10-5
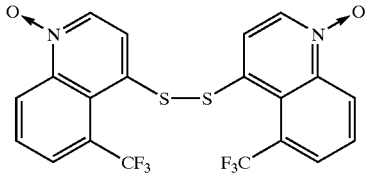
10-6
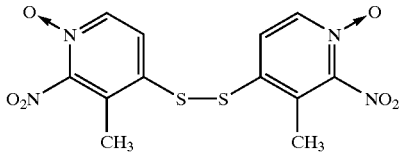
10-7
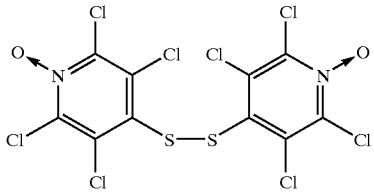
10-8
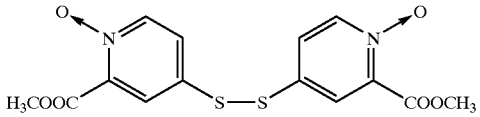
10-9
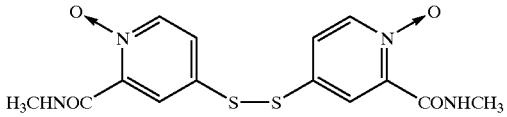
11-1
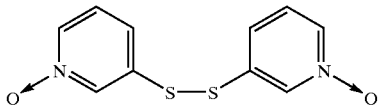
11-2
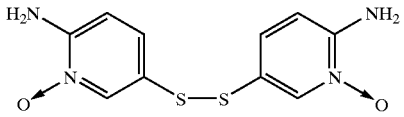
11-3
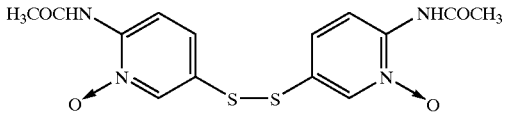
11-4
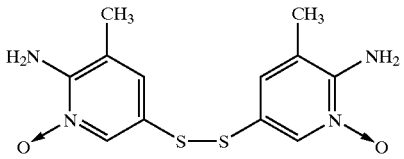
11-5
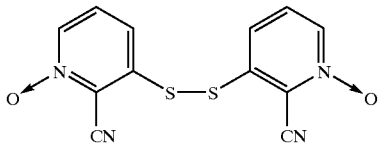
11-6
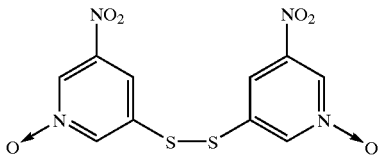
11-7
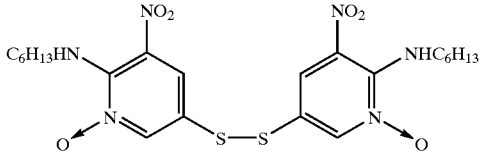
11-8
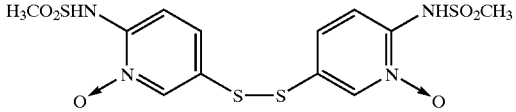

-continued
11-9
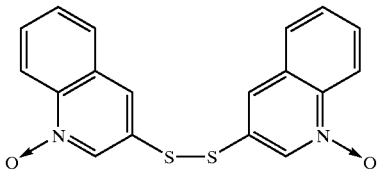
12-1
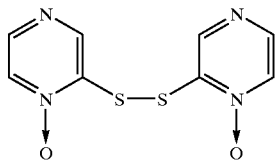
12-2
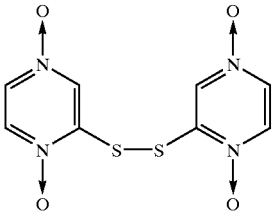
12-3
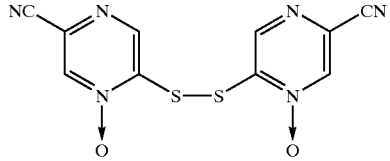
12-4
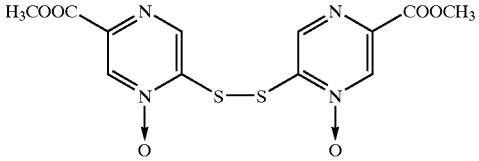
12-5
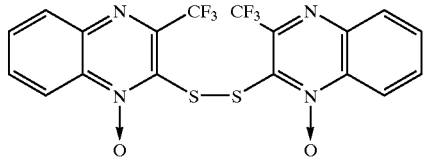
12-6
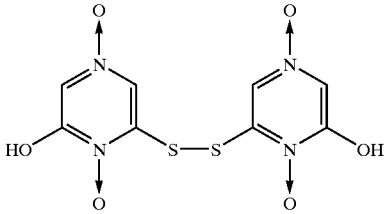
12-7
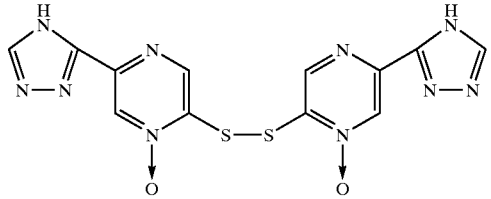
12-8
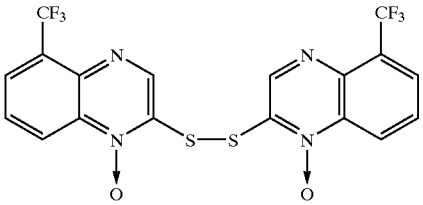
12-9
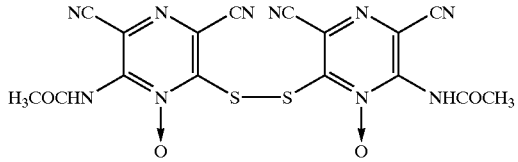
12-10
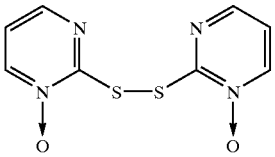
12-11
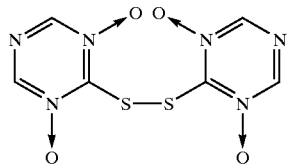
12-12
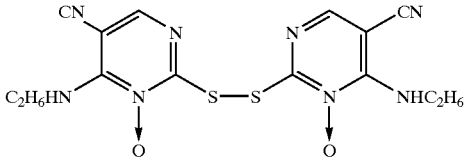
12-13
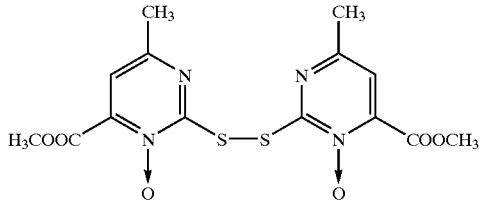
12-14
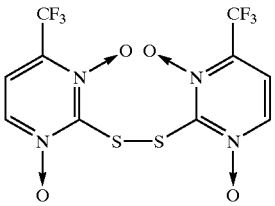
12-15
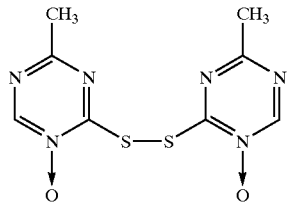

-continued
12-16
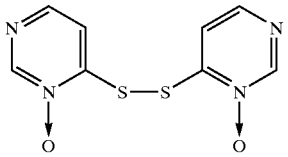
12-17
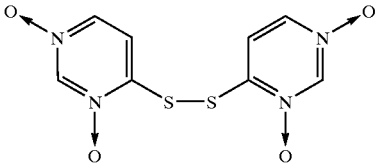
12-18
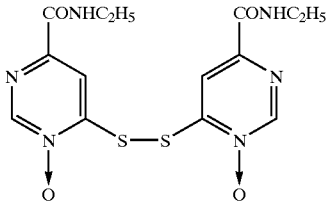
12-19
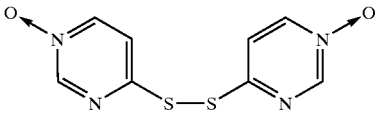
12-20
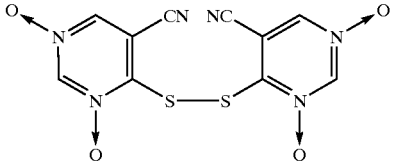
12-21
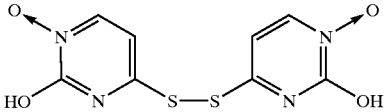
12-22
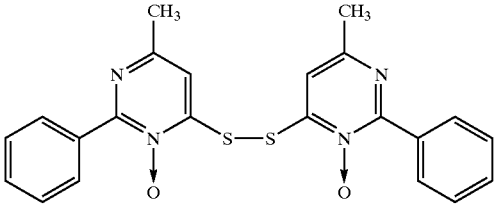
12-23
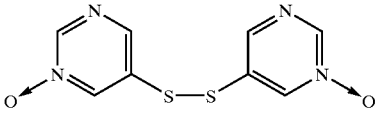
12-24
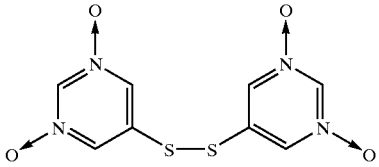
12-25
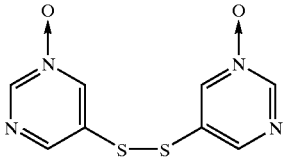
12-26
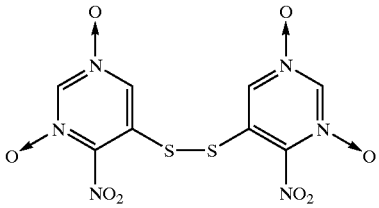
12-27
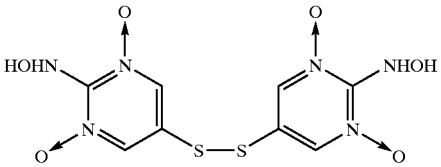
12-28
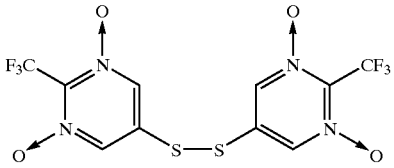
12-29
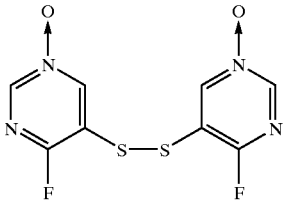
12-30
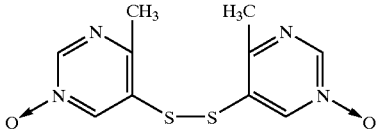
12-31
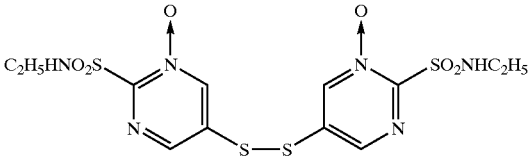

-continued
12-32
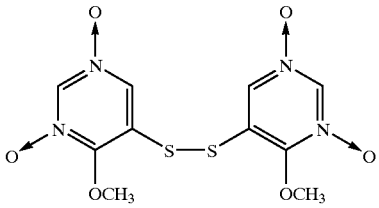
13-6
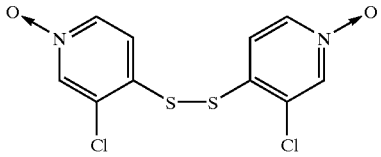
13-7
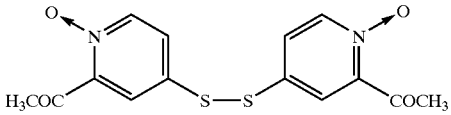
13-8
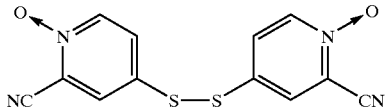
13-9
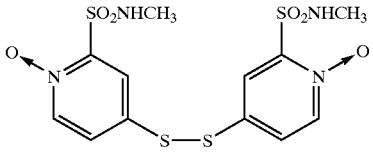
13-10
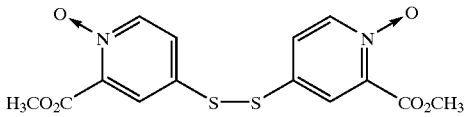
13-11
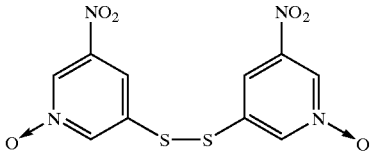
13-12
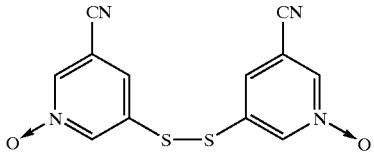
13-13
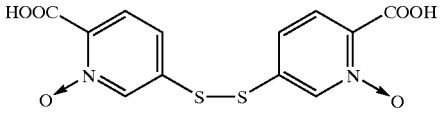
13-14
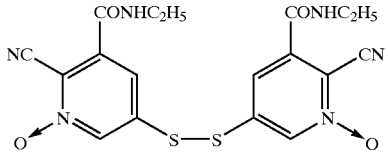
13-15
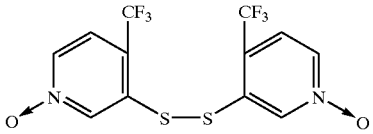
13-16
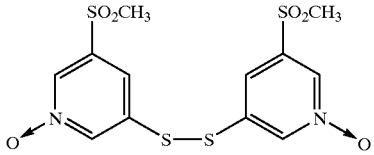
13-17
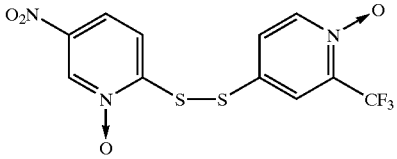
14-1
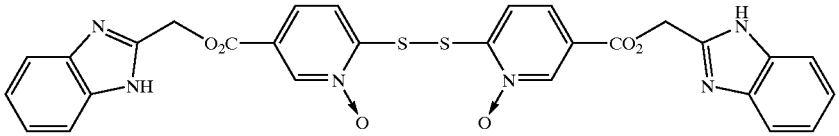
14-2
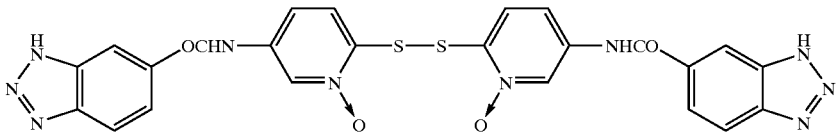

-continued
14-3
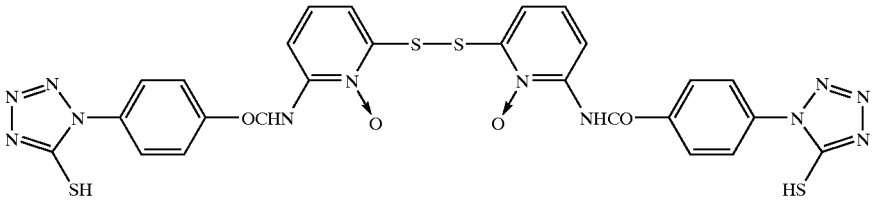
14-4
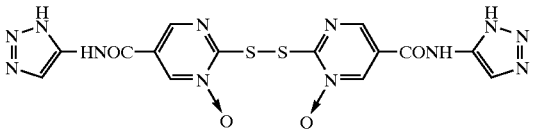
14-5
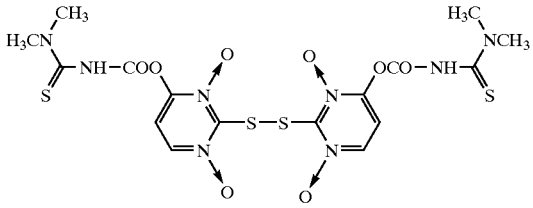
14-6
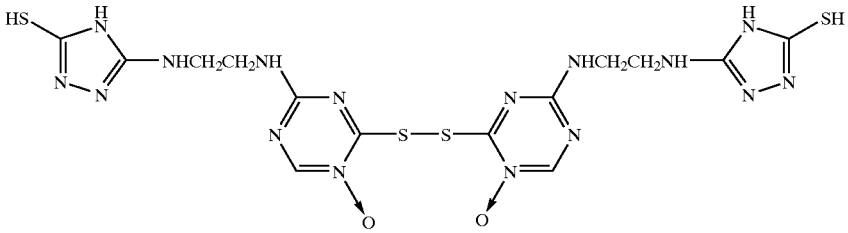
14-7
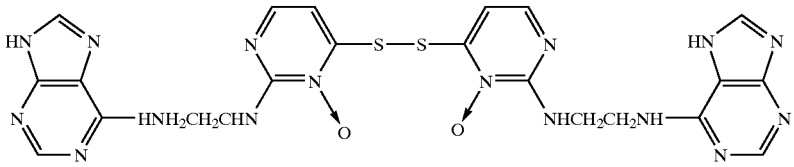
14-8
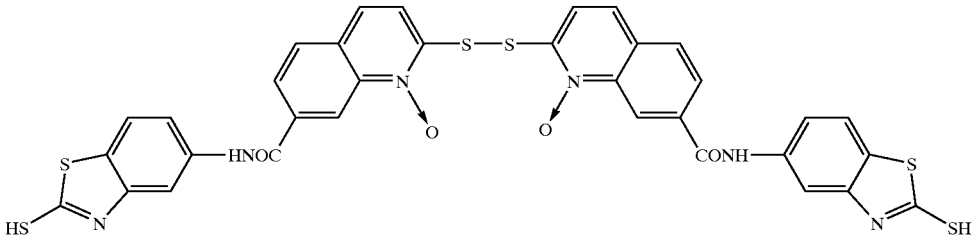
14-9
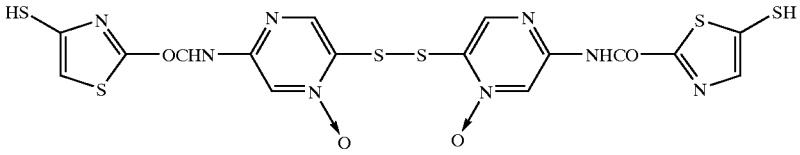
14-10
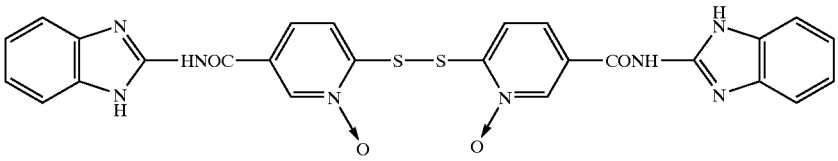
14-11
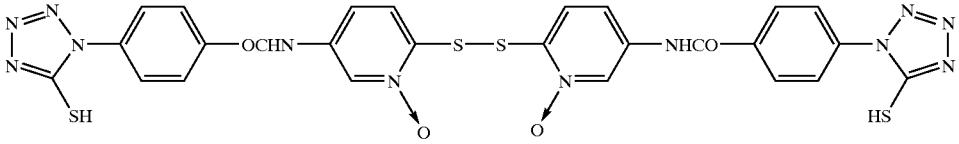

-continued 14-12

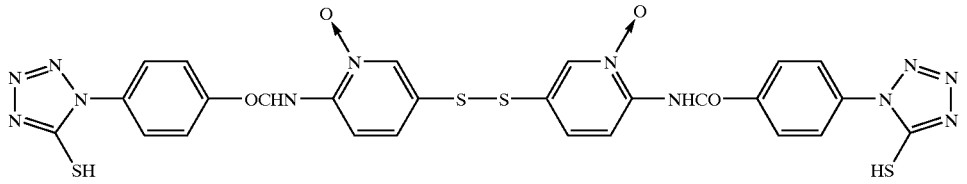

In this invention, at least one of the compounds represented by formula (1) to (3) or a compound represented by formula (4) is added before adding a chemical sensitizer (which is denoted as addition A) and is further added after adding a chemical sensitizer (which is denoted as addition B). In cases when at least two chemical sensitizers are added, it is preferred that the addition A is conducted before adding at least one chemical sensitizer and the addition B is conducted after adding the chemical sensitizer, and it is more preferred that the addition A is performed before adding any one of the chemical sensitizers and the addition B is performed after adding all of the chemical sensitizers.

In the embodiments of this invention, the addition A may be performed immediately after completion of desalting of silver halide host grains. Alternatively, the addition A is performed after completion of desalting of silver halide host grains and after being stored in a refrigerator or in a freezer, the emulsion is re-dissolved, followed by adding a chemical sensitizer. The addition A is performed preferably immediately before adding a chemical sensitizer, and more preferably within 60 min. before adding a chemical sensitizer. Even in cases when a silver halide emulsion is allowed to stand in the form of a solution over the period of from completion of desalting of silver halide host grains to addition of a chemical sensitization, the addition A is performed preferably immediately before adding a chemical sensitizer, and more preferably within 60 min. before adding a chemical sensitizer. When performing chemical sensitization and spectral sensitization, addition of a spectral sensitizing dye may be conducted either before or after the addition A, or at any time.

In the embodiments of this invention, the addition B can be performed at any time after adding a chemical sensitizer, for example, during chemical sensitization or at the time after completion of chemical sensitization and immediately before coating, preferably after completing 50% of chemical sensitization and before completing chemical sensitization, and more preferably after completing 70% of chemical sensitization and before completing chemical sensitization. When performing chemical sensitization and spectral sensitization, addition of a spectral sensitizing dye may be conducted either before or after the addition B, or at any time.

The chemical sensitization in this invention refers to adding a chemical sensitizer to perform ripening of the emulsion and, after the elapse of an optimal ripening time, a compound capable of being adsorbed onto silver halide (or silver halide-adsorptive compound) is added to stop the progress of chemical sensitization. In the foregoing process, the stage of from starting addition of a chemical sensitizer to addition of a silver halide-adsorptive compound to stop the progress of chemical sensitization refers to a chemical sensitization process. The time required for the chemical sensitization process refers to a chemical ripening time. In the foregoing, the expression, completing 50% of chemical sensitization, completing 70% of chemical sensitization and completing chemical sensitization mean the time of from the start of adding a chemical sensitizer reaching 50%, 70% and 100% of the total time of optimum chemical ripening, respectively.

In one preferred embodiment of this invention, at least one of the compounds represented by the foregoing formulas (1) to (3) and at least a compound represented by the foregoing formula (4) are added to the silver halide emulsion after completion of desalting of silver halide host grains and before completion of chemical sensitization. In this regard, it is more preferred that one of a compound represented by formula (1), (2) or (3) and a compound represented by formula (4) is added before adding a chemical sensitizer (which is denoted as addition A') and the other one of a compound represented by formula (1), (2) or (3) and a compound represented by formula (4) is added after adding a chemical sensitizer (which is denoted as addition B'). In cases when at least two chemical sensitizers are added, the addition A' is conducted before adding at least one of the chemical sensitizers and the addition B' is conducted after adding at least one of the chemical sensitizers, and it is more preferred that the addition A' is performed before adding any one of the chemical sensitizers and the addition B' is performed after adding all of the chemical sensitizers.

In the embodiments of this invention, the addition A' may be performed immediately after completion of desalting of silver halide host grains. Alternatively, the addition A' is performed after completion of desalting of silver halide host grains and after being stored in a refrigerator or in a freezer, the emulsion is re-dissolved, followed by adding a chemical sensitizer. The addition A' is performed preferably immediately before adding a chemical sensitizer, and more preferably within 60 min. before adding a chemical sensitizer. Even in cases when a silver halide emulsion is allowed to stand in the form of a solution over a period of from completion of desalting of silver halide host grains to addition of a chemical sensitization, the addition A' is performed preferably immediately before adding a chemical sensitizer, and more preferably within 60 min. before adding a chemical sensitizer. When performing chemical sensitization and spectral sensitization, addition of a spectral sensitizing dye may be conducted either before or after the addition A', or at any time.

In the embodiments of this invention, the addition B' is performed preferably after completing 50% of chemical sensitization and before completing chemical sensitization, and more preferably after completing 70% of chemical sensitization and before completing chemical sensitization. When performing chemical sensitization and spectral sensitization, addition of a spectral sensitizing dye may be conducted either before or after the addition B', or at any time.

In one preferred embodiment of this invention, at least one of the compounds represented by the foregoing formulas (1) to (3) and at least one compound represented by the foregoing formula (4) are added to the silver halide emulsion, in the presence of a compound represented by the following formula (S), after completion of desalting of silver halide host grains and before completion of chemical sensitization:

formula (S)

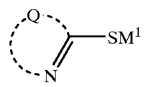

wherein Q is an atomic group necessary to form a 5- or 6-membered nitrogen-containing ring; $M^1$ is a hydrogen atom, alkali metal or a group forming a monovalent cation (or a monovalent cation group).

In the formula (S), examples of the 5-membered ring containing Q include an imidazole ring, tetrazole ring, thiazole ring, oxazole ring, selenazole ring, benzimiazole ring, naphthoimidazole ring, benzothiazole ring, naphthothiazole ring, benzoselenazole ring, naphthoselenazole ring, and benzoxazole ring. Examples of the 6-membered ring containing Q include a pyridine ring, pyrimidine ring and quinoline ring. The 5-membered or 6-membered ring may be substituted. Alkali metals represented by $M^1$ include, for example, sodium atom and potassium atom. Monovalent cation groups represented by $M^1$ include ammonium ion and organic cations.

The mercapto compound represented by the foregoing formula (S) is preferably mercapto compounds represented by the following formula (S-1), (S-2), (S-3) or (S-4):

formula (S-1)

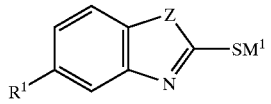

wherein $R^1$ is a hydrogen atom, an alkyl group, an alkoxy group, an aryl group, a halogen atom, a carboxyl group or its salt, a sulfo group or its salt or an amino group; Z is —NH—, —O— or —S—: and $M^1$ is the same as defined in the foregoing formula (S);

formula (S-2)

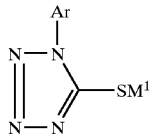

wherein Ar is a group represent by the following formula:

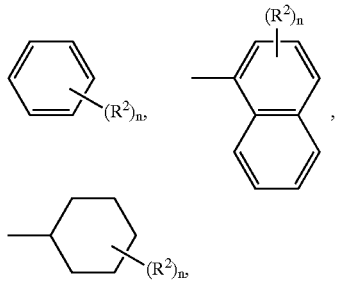

wherein $R^2$ is an alkyl group, an alkoxy group, a carboxy group or its salt, a sulfo group or its salt, a hydroxy group, an amino group, an acylamino group, a carbamoyl group or a sulfonamido group; n is an integer of 0 to 2; $M^1$ is the same as defined in the foregoing formula (S);

formula (S-3)

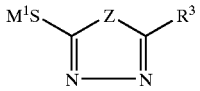

wherein Z is —$NR^3$—, an oxygen atom or a sulfur atom, in which $R^3$ is a hydrogen atom, alkyl group, aryl group, alkenyl group, cycloalkyl group, —$SR^{31}$, —$NR^{32}(R^{33})$—, —$NHCOR^{34}$, —$NHSO_2R^{35}$ or a heterocyclic group, in which $R^-$ is a hydrogen atom, alkyl group, alkenyl group, cycloalkyl group, aryl group —$COR^{34}$, or —$SO_2R^{35}$, $R^{32}$ and $R^{33}$ are each a hydrogen atom, alkyl group or aryl group, $R^{34}$ and $R^{35}$ are each an alkyl group or aryl group; $M^1$ is the same as defined in formula (S);

formula (S-4)

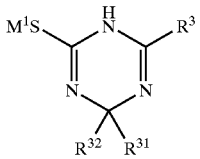

wherein $R^3$ and $M^1$ are each the same as defined in the foregoing formula (S-3); $R^{31}$ and $R^{32}$ are each the same as defined in the foregoing formula (S-3).

In the foregoing formulas (S-1) and (S-2), the alkyl group represented by $R^1$ and $R^2$ includes, for example, methyl, ethyl and butyl; the alkoxy group includes methoxy and ethoxy, salts of the carboxy or sulfo group includes sodium and ammonium salts. In formula (S-1), the aryl group represented by $R^1$ includes, for example, phenyl and naphthyl, and the halogen atom includes, for example, chlorine atom and bromine atom. In formula (S-2), the acylamino group represented by $R^2$ includes, for example, methylcarbonylamino and benzoylamino; the carbamoyl group includes, for example, ethylcarbamoyl and phenylcarbamoyl; and the sulfonamido group includes, for example, methylsulfonamido and phenylsulfonamido. The foregoing alkyl, alkoxy, aryl, amino, acylamino, carbamoyl and sulfonamido groups may be substituted with substituents.

In the foregoing formula (S-3), the alkyl group represented by $R^3$, $R^{31}$, $R^{32}$, $R^{33}$, $R^{34}$ and $R^{35}$ includes, for example, methyl, benzyl, ethyl and propyl; and the aryl group includes, for example, phenyl and haphthyl. The alkenyl group represented by $R^3$ and $R^{31}$ includes, for example, propenyl; the cycloalkyl group includes, for example, cyclohexyl. The heterocyclic group represented by $R^3$ includes, for example, furyl and pyridinyl. The foregoing alkyl or aryl group represented by $R^3$, $R^{31}$, $R^{32}$, $R^{33}$, $R^{34}$ and $R^{35}$, the alkenyl or cycloalkyl group represented by $R^3$ and $R^{31}$ and the heterocyclic group represented by $R^3$ each may be substituted with substituents.

Specific examples of the compound represented by formula (S) are shown below but are by no means limited to these.

S-1-1
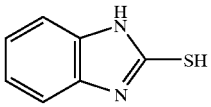
S-1-2
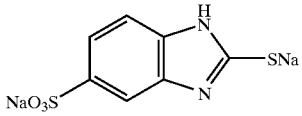
S-1-3
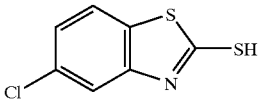
S-1-4
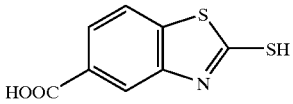
S-1-5
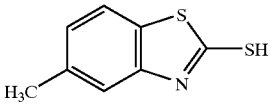
S-1-6
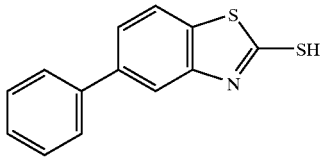
S-1-7
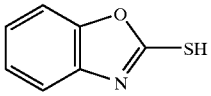
S-1-8
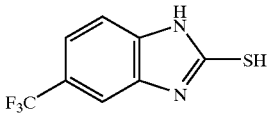
S-2-1
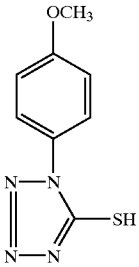
S-2-2
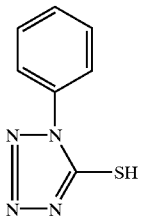
S-2-3
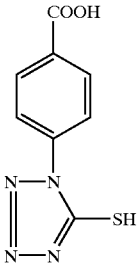
S-2-4
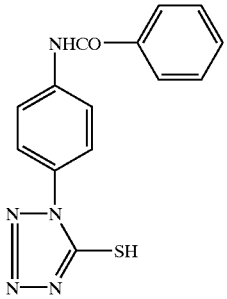
S-2-5
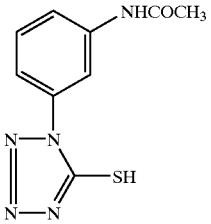
S-2-6
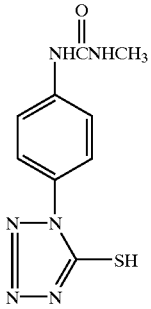

-continued
S-2-7
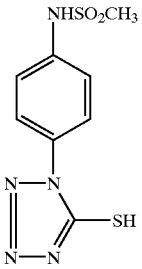
S-2-8
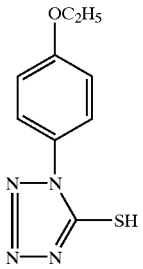
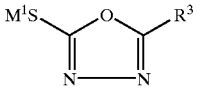
| Compound | $R^3$ | $M^1$ |
|---|---|---|
| S-3-1 | $—C_2H_5$ | —H |
| S-3-2 | $—CH_2—CH=CH_2$ | —H |
| S-3-3 | $—CH=CH—CH_2—CH_3$ | —H |
| S-3-4 | $—C_7H_{15}$ | —H |
| S-3-5 | $—C_9H_{19}$ | —Na |
| S-3-6 | 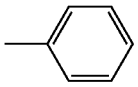 | —H |
| S-3-7 | $—C_4H_9(t)$ | —H |
| S-3-8 | 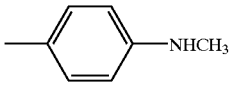 | —H |
| S-3-9 | 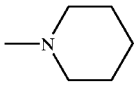 | —H |
| S-3-10 | 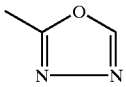 | —H |
| S-3-11 | 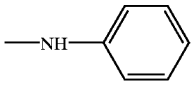 | —H |
| S-3-12 | 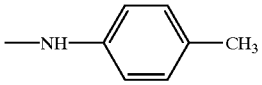 | —H |
| S-3-13 | $—NHCOCH_3$ | —H |
| S-3-14 | 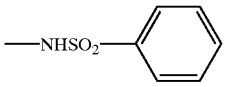 | —H |
| S-3-15 | $—N(CH_3)_2$ | —H |
| S-3-16 | 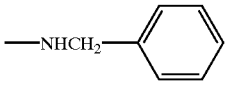 | —H |
| S-3-17 | 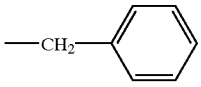 | —H |

-continued
| | | |
|---|---|---|
| S-3-18 | —S—$CH_3$ | —H |
| S-3-19 | —S— | —H |
| S-3-20 | —SH | —H |
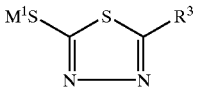
| Compound | $R^3$ | $M^1$ |
|---|---|---|
| S-3-21 | —H | —H |
| S-3-22 | —$C_2H_5$ | —H |
| S-3-23 | —$C_4H_9$(t) | —H |
| S-3-24 | —$C_6H_{13}$ | —H |
| S-3-25 | | —H |
| S-3-26 | —$NO_3$ | —H |
| S-3-27 | —$N(CH_3)_2$ | —H |
| S-3-28 | | —H |
| S-3-29 | —NH— | —H |
| S-3-30 | —NH—$N(CH_3)_2$ | —H |
| S-3-31 | —$CH_2CH$=$CH_2$ | —H |
| S-3-32 | —SH | —H |
| S-3-33 | —$NHCOC_2H_5$ | —H |
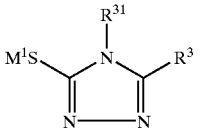
| Compound | $R^3$ | $R^{31}$ | $M^1$ |
|---|---|---|---|
| S-3-34 | —$C_2H_5$ | —H | —H |
| S-3-35 | —$CH_3$ | —$CH_3$ | —H |
| S-3-36 | —$CH_3$ | | —H |
| S-3-37 | —$NHCOCH_3$ | —$CH_3$ | —H |
| S-3-38 | —NHCO— | —CO— | —H |
| S-3-39 | —$NHCOCH_3$ | —$COCH_3$ | —H |

-continued
| | | | |
|---|---|---|---|
| S-3-40 | —NHCOCH$_3$ | —CH$_2$— 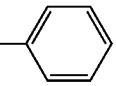 | —H |
| S-3-41 | —NHCOC$_2$H$_5$ | 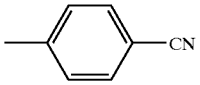 | Na |
| S-3-42 | —NHCO— 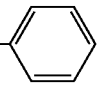 | 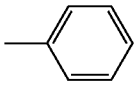 | H |
| S-3-43 | —NHSO$_2$CH$_3$ | —H | H |
| S-3-44 | —NHCO— 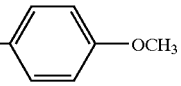 —OCH$_3$ | —CH$_3$ | Na |
| S-3-45 | —NHCO— 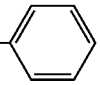 | —CH$_2$CH═CH$_2$ | H |
| S-3-46 | —NHCO— 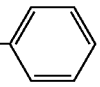 | —CH$_2$CH$_2$O— 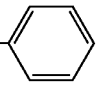 | —H |
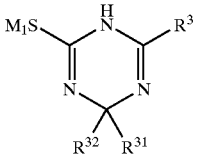
| Compound | R$^3$ | R$^{31}$ | R$^{32}$ | M$^1$ |
|---|---|---|---|---|
| S-4-1 | —C$_2$H$_5$ | —CH$_3$ | —CH$_3$ | —H |
| S-4-2 | 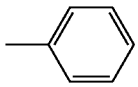 | —CH$_3$ | —CH$_3$ | —H |
| S-4-3 | —NH$_2$ | —H | 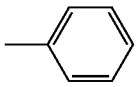 | —H |
| S-4-4 | —NH— 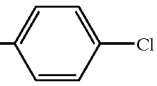 —Cl | —H | —C$_4$H$_9$ | —H |
| S-4-5 | —NHCOCH$_3$ | —CH$_3$ | —CH$_3$ | —H |
| S-4-6 | —NHCO— 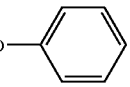 | —CH$_3$ | —CH$_3$ | —H |
| S-4-7 | —NH— 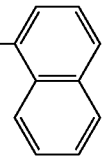 | —CH$_3$ | —C$_3$H$_7$(i) | —H |
| S-4-8 | | | | |

-continued

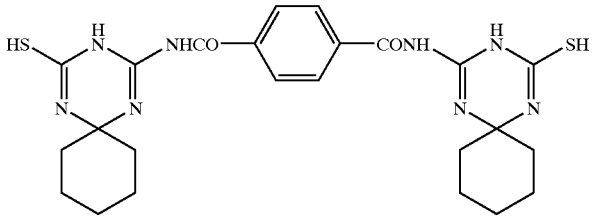

The compounds represented by formula (S) include compounds described, for example, in JP-B No. 40-28496, JP-A 50-89034; J. Chem. Soc. 49, 1748 (1927), ibid 4237 (1952); J. Org. Chem. 39, 2469 (1965); U.S. Pat. No. 2,824,001; J. Chem. Soc. 1723 (1951); JP-A No. 56-111846; U.S. Pat. Nos. 1,275,701, 3,266,897, 2,403,927, and can be synthesized in accordance with the synthesis described in the foregoing literature.

To allow the compound represented by formula (S), which is hereinafter also denoted simply as a compound (S), to be included in a silver halide emulsion layer relating to this invention, the compound (S) is incorporated through solution in water or water-miscible organic solvents (e.g., methanol, ethanol). The compound (S) may be used alone or in combination with another compound represented by formula (S), or a stabilizer or antifoggant other than the compounds represented by formula (S).

In one preferred embodiment of this invention, the compound (S) is added before adding at least one of the compounds represented by the foregoing formulas (1) to (3) and/or at least a compound represented by the foregoing formula (4). It is preferred that the compound (S) is added before adding a chemical sensitizer, and it is also preferred that at least one of the compounds represented by the foregoing formulas (1) to (3) and/or at least a compound represented by the foregoing formula (4) are added to the silver halide emulsion after adding a chemical sensitizer. The addition of at least one of the compounds represented by the foregoing formulas (1) to (3) and/or at least a compound represented by the foregoing formula (4) is conducted preferably after completing 50% of chemical sensitization and before completing total chemical sensitization, and more preferably after completing 70% of chemical sensitization and before completing chemical sensitization. When chemical sensitization and spectral sensitization are conducted, spectral sensitizing dyes may be added at any time.

In silver halide emulsions relating to this invention are preferably used polysulfide compounds and mercapto compounds described in JP-A No. 2002-148750.

The compounds represented by formulas (1) through (4) and the compound (S) are each added preferably in an amount of $1\times10^{-8}$ to 1 mol/mol.AgX, and more preferably $1\times10^{-7}$ to $1\times10^{-1}$ mol/mol.AgX. Addition of the compounds represented by formulas (1) through (4) and the compound (S) to a silver halide emulsion can be conducted by applying methods which have been used in the art to incorporate additives to photographic emulsions. For example, a water-soluble compounds is dissolved in water to form an aqueous solution at an optimum concentration, and a water-insoluble or sparingly water-soluble compounds are incorporated through solution in water-miscible organic solvents which have no adverse effect on photographic characteristics, e.g., alcohols, glycols, ketones, esters and amides.

Silver halide emulsion grains relating to this invention preferably include the foregoing compound represented by formula (S) [or compound (S)] in the interior of the grains. The interior of the grains refers to a silver halide phase, except for the silver halide grain surface.

The compound (S) is included in the interior of the grains, preferably in an amount of $1\times10^{-8}$ to $1\times10^{-1}$ mol/mol.AgX, and more preferably $1\times10^{-7}$ to $1\times10^{-2}$ mol/mol.AgX.

There may be any number of regions differing in concentration of compound (S) in the interior of the grains and the concentration is not specifically limited so long as intended grains are formed. It is preferred that at least two silver halide phases differing in concentration of compound (S) are in the interior of the grains, and it is more preferred that a silver halide phase having a less concentration of compound (S) than a silver halide phase having a maximum concentration of compound (S) is external to the silver halide phase having a maximum concentration of compound (S). In one preferred embodiment of this invention, for example, the outermost region (shell portion) within the grain has a concentration of compound (S) less than the internal region (core portion). The shell portion refers to the final region in the course of grain formation through grain growth and the outermost region of the grain including the grain surface. The average concentration of compound (S) in the shell portion is preferably less than $1.5\times10^{-4}$ mol per mol of silver halide. The concentration of compound (S) may be 0 and is preferably 0.1 to $1\times10^{-4}$ mol, and more preferably 0.1 to $0.5\times10^{-4}$ mol per mol of silver halide. The concentration of compound (s) in the core portion is not specifically limited insofar as it is less than the shell portion, and preferably 0.5 to $3\times10^{-4}$ mol per mol of silver halide.

There may be included plural compounds (S) in combination and plural silver halide phases, or the core portion and the shell portion are different in the kind or combination thereof. The compound (S) may be allowed to be present in a grain forming system using any method and preferably to be contained in a halide solution. In the silver halide grains relating to this invention, the volume of a shell portion is preferably not more than 50%, and more preferably not more than 30% of the grain volume. In one preferred embodiment, the shell portion accounts for not more than 10% of the grain volume and is located in a sub-surface region near the grain surface.

Silver halide grains relating to this invention preferably occlude at least two kinds of compounds containing a metal selected from Group 8 of the periodical table of elements (which is hereinafter also denoted simply as a Group 8 metal compound), including at least one iridium compound. Thus, it is preferred to occlude at least one Group 8 metal compound and at least one iridium compound. It is more preferred to occlude at least three kinds of Group 8 metal compounds including at least two iridium compounds. Inclusion of at least three iridium compounds is still more preferred. The iridium compound preferably contains at least one water (or aqua) ligand and/or an organic ligand, as described below. It is still more preferred that silver halide grains occlude at least four kinds of Group 8 metal compounds, and furthermore preferably at least five kinds of Group 8 metal compounds in the interior of the grains.

The silver halide emulsion grains relating to this invention preferably occlude at least one Group 8 metal cyano complex, besides the foregoing iridium compound.

The Group 8 metal compounds usable in this invention is preferably a compound containing a metal selected from iron iridium, rhodium, osmium, ruthenium, cobalt and platinum, which are chosen from metal atoms, metal ions, their complexes or salts (complex salts), and compounds including the foregoing, and preferably from metal complexes. Of metal complexes, six-coordinate complex, five-coordinate complex, four-coordinate complex and two-coordinate complex are preferred and six-coordinate complex and four-coordinate complex are more preferred. Any ligand is usable and examples of a ligand include carbonyl ligand, fulminate ligand, thiocyanate ligand, nitrosyl ligand, thionitrosyl ligand, cyano ligand, water (or aquo-) ligand, halogen ligand, ligands of ammonia, a hydroxide, nitrous acid, sulfurous acid and a peroxide and organic ligands. Of these, it is preferred to contain at least one ligand selected from nitrocyl ligand, thionitrocyl ligand, cyano ligand, water ligand, halogen ligand and an organic ligand. In this invention, the organic ligand refers to a compound containing at least one of H—C, C—C and C—N—H bonds and capable of being coordinated with a metal ion. Preferred organic ligands usable in this invention include a compound selected from pyridine, pyrazine, pyrimidine, pyrane, pyridazine, imidazole, thiazole, isothiazole, triazole, pyrazole, furan, furazane, oxazole, isooxazole, thiophene, phenthroline, bipyridine and ethylenediamine, their ions and compounds substituted with the foregoing compounds.

Preferred in this invention is occlusion of at least a compound represented by the following formula (A):

$$R^{11}_{n2}[M^{11}X^{11}_{m2}Y^{11}_{6-m2}] \quad \text{formula (A)}$$

wherein $M^{11}$ is a metal selected from Group 8 elements of the periodical table (preferably iron, cobalt, ruthenium, iridium, rhodium, osmium and platinum, and more preferably iron, ruthenium, iridium, rhodium, osmium); $R^{11}$ is an alkali metal (preferably cesium, sodium and potassium); m2 is an integer of 0 to 6, and n2 is an integer of 0 to 4; $X^{11}$ and $Y^{11}$ are each a ligand, including carbonyl ligand, fulminate ligand, thiocyanate ligand, nitrosyl ligand, thionitrosyl ligand, cyano ligand, aqua ligand, halogen ligand, ligands of ammonia, a hydroxide, nitrous acid, sulfurous acid and a peroxide and organic ligands.

Specific examples of the Group 8 metal compound and Group 8 metal complex are shown below but are by no means limited to these. Any counter cation is usable, including potassium ion, calcium ion, sodium ion ammonium ion. Counter anions for the metal complex include nitrate ion, halide ion and perchlorate ion.

A-1: $K_2[IrCl_6]$
A-2: $K_3[IrCl_6]$
A-3: $K_2[Ir(CN)_6]$
A-4: $K_3[Ir(CN)_6]$
A-5: $K_2[Ir(NO)Cl_5]$
A-6: $K_3[Ir(NO)Cl_5]$
A-7: $K_2[IrBr_6]$
A-8: $K_3[IrBr_6]$
A-9: $Na_2[IrBr_6]$
A-10: $Na_3[IrBr_6]$
A-11: $K_2[IrBr_4Cl_2]$
A-12: $K_3[IrBr_4Cl_2]$
A-13: $K_2[IrBr_3Cl_3]$

-continued

A-14: $K_3[IrBr_3Cl_3]$
A-15: $K_2[IrBr_5Cl]$
A-16: $K_3[IrBr_5Cl]$
A-17: $K_2[IrBr_5I]$
A-18: $K_3[IrBr_5I]$
A-19: $K[IrBr_5(H_2O)]$
A-20: $K[IrBr_4(H_2O)_2]$
A-21: $K_2[IrBr_5(H_2O)]$
A-22: $K_3[IrBr_5(H_2O)]$
A-23: $K_4[IrBr_5(H_2O)]$
A-24: $K[IrCl_5(H_2O)]$
A-25: $K[IrCl_4(H_2O)_2]$
A-26: $K_2[IrCl_5(H_2O)]$
A-27: $K_3[IrCl_5(H_2O)]$
A-28: $K_4[IrCl_5(H_2O)]$
A-29: $K_4[IrCl_6]$
A-30: $K_2[Ir(CN)_5(H_2O)]$
A-31: $K_3[Ir(CN)_5(H_2O)]$
A-32: $K_4[Ir(thiazole)Cl_5]$
A-32: $K_4[Ir(imidazole)Cl_5]$
B-1: $K_2[RuCl_6]$
B-2: $K_2[PtCl_6]$
B-3: $K_2[Pt(SCN)_4]$
B-4: $K_2[NiCl_4]$
B-5: $K_2[PdCl_6]$
B-6: $K_3[RhCl_6]$
B-7: $K_2[OsCl_6]$
B-8: $K_2[ReCl_6]$
B-9: $K_3[RhBr_6]$
B-10: $K_3[Mo(OCN)_6]$
B-11: $K_3[Re(CNO)_6]$
B-12: $K_4[Ru(CNO)_6]$
B-13: $K_4[Fe(CNO)_6]$
B-14: $K_2[Pt(CNO)_4]$
B-15: $K_3[CO(NH_3)_6]$
B-16: $K_5[CO_2(CNO)_{11}]$
B-17: $K_3[Re(CNO)_6]$
B-18: $K_4[Os(CNO)_6]$
B-19: $Cs_2[Os(NO)Cl_5]$
B-20: $K_2[Ru(NO)Cl_5]$
B-21: $K_2[Ru(CO)Cl_5]$
B-22: $Cs_2[Os(CO)Cl_5]$
B-23: $K_2[Fe(NO)Cl_5]$
B-24: $K_2[Ru(NO)Br_5]$
B-25: $K_2[Ru(NO)I_5]$
B-26: $K_2[Re(NO)Br_5]$
B-27: $K_2[Re(NO)Cl_5]$
B-28: $K_2[Ru(NS)Cl_5]$
B-29: $K_2[Os(NS)Br_5]$
B-30: $K_2[Ru(NS)Br_5]$
B-31: $K_2[Ru(NS)(SCN)_5]$
B-32: $K_4[Fe(CN)_6]$
B-33: $K_3[Fe(CN)_6]$
B-34: $K_4[Ru(CN)_6]$
B-35: $K_2[RuBr(CN)_5]$
B-36: $K_4[Os(CN)_6]$
B-37: $K_2[Os(NS)(CN)_5]$
B-38: $K_4[Re(CN)_6]$
B-39: $K_2[ReCl(CN)_5]$ In addition, there are also preferably usable metal compounds and bipyridine complexes described in JP-A No. 5-341426 are also preferred.

To allow the foregoing Group 8 metal compounds to be included, doping may be conducted during physical ripening of silver halide grains or in the course of forming silver halide grains (in general, during addition of water-soluble silver salt and alkali halide). Alternatively, forming silver halide grains is interrupted and doping is carried out, then, the grain formation is continued. Doping can also be conducted by performing nucleation, physical ripening or grain formation in the presence of a Group 8 metal compound.

The Group 8 metal compound is used in an amount of $1\times10^{-9}$ to $1\times10^{-2}$ mol, preferably $5\times10^{-9}$ to $1\times10^{-3}$ mol, and more preferably $1\times10^{-8}$ to $1\times10^{-4}$ mol per mol of silver halide. Commonly known methods of adding additives to a silver halide emulsion are applicable to allow the Group 8 metal compound to be included in silver halide grains, for example, the compound may be directly dispersed in an emulsion or incorporated through solution in solvents such as water, methanol and ethanol. A method of preparing a silver halide emulsion, in which fine silver halide grains including a Group 8 metal compound are added during grain formation can be referred to a method described in JP-A Nos. 11-212201 and 2000-89403.

Silver halide emulsions relating to this invention preferably contain gelatin substantially free of calcium ions. The gelatin substantially free of calcium ions (hereinafter, also denoted as calcium-free gelatin) is a gelatin having a calcium content of not more than 100 ppm, preferably not more than 50 ppm, and more preferably not more than 30 ppm. A calcium-free gelatin usable in this invention can be obtained by a cation exchange treatment using ion exchange resin and the like. In a silver halide emulsion relating to this invention, a calcium-free gelatin is preferably used in at least one stage of the process of preparing a silver halide emulsion, including silver halide grain formation, desalting, dispersion, chemical sensitization and/or spectral sensitization, and preferably prior to chemical sensitization and/or spectral sensitization. At least 10% by weight (preferably at least 30% and more preferably at least 50% by weight) of the total dispersing medium contained in the silver halide emulsion prepared is preferably accounted for by a calcium-free gelatin.

It is preferred that amino group-substituted, chemically modified gelatin is used in grain formation and/or desalting of a silver halide emulsion relating to this invention. There are preferably used chemically modified gelatins in which an amino group of the gelatin is substituted, as described in JP-A Nos. 5-72658, 9-197595 and 9-251193. The chemically modified gelatin is used in the grain formation and/or desalting, preferably in an amount of at least 10% by weight, more preferably at least 30% by weight, and still more preferably at least 50% by weight of the total dispersing medium. The substituted amino group percentage is preferably at least 30%, more preferably at least 50%, and still more preferably at least 80%.

Dispersing medium used in the preparation of silver halide emulsions relating to this invention is a compound exhibiting a protective-colloidal property. The dispersing medium is preferably allowed to be present over the stage of nucleation and grain growth in the grain formation process. Preferred dispersing medium usable in this invention is gelatin and hydrophilic colloids. There are preferably used alkali-treated or acid-treated gelatin having a molecular weight of ca. 100,000, oxidized gelatin, and enzyme-treated gelatin described in Bull. Soc. Sci. Photo. Japan No. 16, page 30 (1966). Gelatin having an average molecular eight of 10,000 to 70,000 is preferably used in the stage of nucleation of the grain formation process and gelatin having an average molecular weight of 10,000 to 50,000 is more preferred. Gelatin degradation can be done using proteinase or hydrogen peroxide. It is preferred to use gelatin having a relatively low methionine content in the nucleation stage, specifically when forming tabular silver halide grains. The methionine content is not more than 50 $\mu$mol, and more preferably not more than 20 $\mu$mol per unit weight (g) of dispersing medium. A methionine content of gelatin can be reduced by oxidizing gelatin with hydrogen peroxide or the like.

Examples of hydrophilic colloid include gelatin derivatives, graft polymer of gelatin with other polymers, proteins such as albumin or casein, cellulose derivatives such as hydroxyethyl cellulose, carboxymethyl cellulose and cellulose sulfate ester, sodium alginate, saccharide derivatives such as starch derivatives, and hydrophilic synthetic polymer material such as polyvinyl alcohol, polyvinyl alcohol partial acetal, poly-N-vinyl pyrrolidone, polyacrylic acid, polyacrylamide, polyvinyl imidazole, polyvinyl pyrazole, and copolymers of the foregoing polymers. Besides lime-processed gelatin, acid-treated gelatin and enzyme-treated gelatin described in Bull. Soc. Sci. Photo. Japan No. 16, page 30 (1966) are usable, and hydrolysis product or enzymatic degradation product of gelatin are also usable.

Silver halide grains relating to the invention may be of any form so long as having a high chloride composition. One of preferred grain forms is a cubic grain having a (100) crystal surface. Octahedral, tetradecahedral or dodecahedral grains, which can be prepared according to methods described in U.S. Pat. Nos. 4,183,756 and 4,225,666, JP-A No. 55-26589 and JP-B No. 55-42737 (hereinafter, the term, JP-B refers to published Japanese Patent), and J. Photogr. Sci. 21, 39 (1973) are also usable. Silver halide twinned crystal grains may be used. Silver halide grains having a single form are preferred and it is specifically preferred that at least two kinds of monodisperse grain emulsions be included in the same layer.

Silver halide grains used in the invention are not limited with respect to grain size but the grain size is preferably 0.1 to 5.0 $\mu$m, and more preferably 0.2 to 3.0 $\mu$m in terms of rapid processability and sensitivity. In the case of cubic grains, the grain size is preferably 0.1 to 1.2 $\mu$m, and more preferably 0.15 to 1.0 $\mu$m. With regard to the grain size distribution is preferred monodisperse silver halide grains having a coefficient of variation of not more than 0.22, and more preferably not more than 0.15. The coefficient of variation is referred to as a coefficient representing a width of the grain size distribution and defined according to the following equation:

$$\text{Coefficient of variation}=S/R$$

where S is a standard deviation of grain size distribution and R is a mean grain size. Herein, the grain size is a diameter in the case of spherical grain, and in the case of being cubic, or shape other than spherical form, the grain size is a diameter of a circle having an area equivalent to the grain projected area.

There can be employed a variety of apparatuses and methods for preparing silver halide emulsions, which are generally known in the art. The silver halide can be prepared according to any of acidic precipitation, neutral precipitation and ammoniacal precipitation. Silver halide grains can formed through a single process, or through forming seed grains and growing them. A process for preparing seed grains and a growing process thereof may be the same with or different from each other.

Normal precipitation, reverse precipitation, double jet precipitation or a combination thereof is applicable as a reaction mode of a silver salt and halide salt, and the double jet precipitation is preferred. As one mode of the double jet precipitation is applicable a pAg-controlled double jet method described in JP-A 54-48521. There can be employed a apparatus for supplying a silver salt aqueous solution and a halide aqueous solution through an adding apparatus provided in a reaction mother liquor, as described in JP-A 57-92523 and 57-92524; an apparatus for adding silver salt and halide solutions with continuously varying the concentration thereof, as described in German Patent 2,921,164; and an apparatus for forming grains in which a reaction mother liquor is taken out from the reaction vessel and concentrated by ultra-filtration to keep constant the distance between silver halide grains.

Solvents for silver halide such as thioethers are optionally employed. A compound containing a mercapto group, nitrogen containing heterocyclic compound or a compound such as a sensitizing dye can also be added at the time of forming silver halide grains or after completion thereof.

In the silver halide emulsion of the invention, sensitization with a gold compound and sensitization with a chalcogen sensitizer can be employed in combination. The chalcogen sensitizer include a sulfur sensitizer, selenium sensitizer and tellurium sensitizer and of these is preferred the sulfur sensitizer. Exemplary examples of sulfur sensitizers include thiosulfates, triethylthiourea, allylthiocarbamide, thiourea, allylisothiocyanate, cystine, p-toluenethiosulfonate, rhodanine, and sulfur single substance. The amount of the sulfur sensitizer to be added to a silver halide emulsion layer, depending of the kind of a silver halide emulsion and expected effects, is preferably $5\times10^{-10}$ to $5\times10^{-5}$, and more preferably $5\times10^{-8}$ to $3\times10^{-5}$ mole per mole of silver halide. The gold sensitizer such as chloroauric acid or gold sulfide is added in the form of a complex. Compounds, such as dimethylrhodanine, thiocyanic acid, mercaptotetrazole and mercaptotriazole are used as a ligand. The amount of the gold compound to be added, depending of the kind of a silver halide emulsion, the kind of the compound and ripening conditions, is preferably $1\times10^{-8}$ to $1\times10^{-4}$, and more preferably $1\times10^{-8}$ to $1\times10^{-5}$ mole per mole of silver halide. Silver halide emulsions used in the invention may be chemically sensitized by reduction sensitization.

A antifoggant or a stabilizer known in the art are incorporated into the photographic material, for the purpose of preventing fog produced during the process of preparing the photographic material, reducing variation of photographic performance during storage or preventing fog produced in development. Examples of preferred compounds for the purpose include compounds represented by formula (II) described in JP-A 2-146036 at page 7, lower column. These compounds are added in the step of preparing a silver halide emulsion, the chemical sensitization step or during the course of from completion of chemical sensitization to preparation of a coating solution. In cases when chemical sensitization is undergone in the presence of these compounds, the amount thereof is preferably $1\times10^{-5}$ to $5\times10^{-4}$ mole per mole of silver halide. In cases when added after chemical sensitization, the amount thereof is preferably $1\times10^{-6}$ to $1\times10^{-2}$, and more preferably $1\times10^{-5}$ to $5\times10^{-3}$ mol per mole of silver halide. In cases when added at the stage of preparing a coating solution, the amount is preferably $1\times10^{-6}$ to $1\times10^{-1}$, and more preferably $1\times10^{-5}$ to $1\times10^{-2}$ mole per mol of silver halide. In case where added to a layer other than a silver halide emulsion layer, the amount is preferably $1\times10^{-9}$ to $1\times10^{-3}$ mole/$m^2$.

There are employed dyes having absorption at various wavelengths for anti-irradiation and anti-halation in the photographic material relating to the invention. A variety of dyes known in the art can be employed, including dyes having absorption in the visible range described in JP-A 3-251840 at page 30, AI-1 to 11, and JP-A No. 6-3770; infra-red absorbing dyes described in JP-A No. 1-280750 at page 2, left lower column, formula (I), (II) and (III). These dyes do not adversely affect photographic characteristics of a silver halide emulsion and there is no stain due to residual dyes. For the purpose of improving sharpness, the dye is preferably added in an amount that gives a reflection density at 680 nm of not less than 0.7 and more preferably not less than 0.8.

Fluorescent brightening agents are also incorporated into the photographic material to improve whiteness. Examples of preferred compounds include those represented by formula II described in JP-A No. 2-232652.

In cases when a silver halide photographic light sensitive material according to the invention is employed as a color photographic material, the photographic material comprises layer(s) containing silver halide emulsion(s) which are spectrally sensitized in the wavelength region of 400 to 900 nm, in combination with a yellow coupler, a magenta coupler and a cyan coupler. The silver halide emulsion contains one or more kinds of sensitizing dyes, singly or in combination thereof.

In the silver halide emulsions can be employed a variety of spectral-sensitizing dyes known in the art. Compounds BS-1 to 8 described in JP-A 3-251840 at page 28 are preferably employed as a blue-sensitive sensitizing dye. Compounds GS-1 to 5 described in JP-A 3-251840 at page 28 are preferably employed as a green-sensitive sensitizing dye. Compounds RS-1 to 8 described in JP-A 3-251840 at page 29 are preferably employed as a red-sensitive sensitizing dye. In cases where exposed to infrared ray with a semiconductor laser, infrared-sensitive sensitizing dyes are employed. Compounds IRS-1 to 11 described in JP-A 4-285950 at pages 6–8 are preferably employed as a blue-sensitive sensitizing dye. Supersensitizers SS-1 to SS-9 described in JP-A 4-285950 at pages 8–9 and compounds S-1 to S-17 described in JP-A 5-66515 at pages 5–17 are preferably included, in combination with these blue-sensitive, green-sensitive and red-sensitive sensitizing dyes. The sensitizing dye is added at any time during the course of silver halide grain formation to completion of chemical sensitization. The sensitizing dye is incorporated through solution in water-miscible organic solvents such as methanol, ethanol, fluorinated alcohol, acetone and dimethylformamide or water, or in the form of solid particle dispersion.

As couplers used in silver halide photographic materials relating to the invention is usable any compound capable of forming a coupling product exhibiting an absorption maximum at the wavelength of 340 nm or longer, upon coupling with an oxidation product of a developing agent. Representative examples thereof include yellow dye forming couplers exhibiting an absorption maximum at the wavelength of 350 to 500 nm, magenta dye forming couplers exhibiting an absorption maximum at the wavelength of 500 to 600 nm and cyan dye forming couplers exhibiting an absorption maximum at the wavelength of 600 to 750 nm.

Examples of preferred cyan couplers include those which are represented by general formulas (C-I) and (C-II) described in JP-A 4-114154 at page 5, left lower column. Exemplary compounds described therein (page 5, right lower column to page 6, left lower column) are CC-1 to CC-9.

Examples of preferred magenta couplers include those which are represented by general formulas (M-I) and (M-II) described in JP-A No. 4-114154 at page 4, right upper column. Exemplary compounds described therein (page 4, left lower column to page 5, right upper column) are MC-1 to MC-11. Of these magenta couplers are preferred couplers represented by formula (M-I) described in ibid, page 4, right upper column; and couplers in which $R_M$ in formula (M-I) is a tertiary alkyl group are specifically preferred. Further, couplers MC-8 to MC-11 are superior in color reproduction of blue to violet and red, and in representation of details. Examples of the foregoing coupler represented by formula (M-1) include exemplary compounds 1 through 64, described in JP-A No. 63-253943, page 5–9; compounds M-1 through M-29 described in JP-A No. 2-100048, page 5–6; compound (1) through (36) described in JP-A No. 7-175186, page 5–12; compound M-1 through M-33 described in JP-A No. 7-219170, page 14–22; compound M-1 through M-16 described in JP-A No. 8-304972, page 5–9; compound M-1 through M-26 described in JP-A No. 10-207024, page 5–10; compound M-1 through M-36 described in JP-A No. 10-207025, page 5–22; compound M-1 through M-24 described in U.S. Pat. No. 5,576,150, page 3–6; compound M-1 through M-48 escribed in U.S. Pat. No. 5,609,996, page 3–9; compound M-1 through M-23 described in U.S. Pat. No. 5,667,952, page 3–5; and compound M-1 through M-26 described in U.S. Pat. No. 5,698,386, page 3–6.

Examples of preferred yellow couplers include those which are represented by general formula (Y-I) described in JP-A No. 4-114154 at page 3, right upper column. Exemplary compounds described therein (page 3, left lower column) are YC-1 to YC-9. Of these yellow couplers are preferred couplers in which RY1 in formula (Y-I) is an alkoxy group are specifically preferred or couplers represented by formula [I] described in JP-A No. 6-67388. Specifically preferred examples thereof include YC-8 and YC-9 described in JP-A No. 4-114154 at page 4, left lower column and Nos. (1) to (47) described in JP-A No. 6-67388 at pages 13–14. Still more preferred examples include compounds represented by formula [Y-1] described in JP-A No. 4-81847 at page 1 and pages 11–17.

When an oil-in-water type-emulsifying dispersion method is employed for adding couplers and other organic compounds used for the photographic material of the present invention, in a water-insoluble high boiling organic solvent, whose boiling point is 150° C. or more, a low boiling and/or a water-soluble organic solvent are combined if necessary and dissolved. In a hydrophilic binder such as an aqueous gelatin solution, the above-mentioned solutions are emulsified and dispersed by the use of a surfactant. As a dispersing means, a stirrer, a homogenizer, a colloidal mill, a flow jet mixer and a supersonic dispersing machine may be used. Preferred examples of the high boiling solvents include phthalic acid esters such as dioctyl phthalate, diisodecyl phthalate, and dibutyl phthalate; and phosphoric acid esters such as tricresyl phosphate and trioctyl phosphate. High boiling solvents having a dielectric constant of 3.5 to 7.0 are also preferred. These high boiling solvents may be used in combination. Instead of or in combination with the high boiling solvent is employed a water-insoluble and organic solvent-soluble polymeric compound, which is optionally dissolved in a low boiling and/or water-soluble organic solvent and dispersed in a hydrophilic binder such as aqueous gelatin using a surfactant and various dispersing means. In this case, examples of the water-insoluble and organic solvent-soluble polymeric compound include poly(N-t-butylacrylamide).

As a surfactant used for adjusting surface tension when dispersing or coating photographic additives, the preferable compounds are those containing a hydrophobic group having 8 through 30 carbon atoms and a sulfonic acid group or its salts in a molecule. Exemplary examples thereof include A-1 through A-11 described in JP-A No. 64-26854. In addition, surfactants, in which a fluorine atom is substituted to an alkyl group, are also preferably used. The dispersion is conventionally added to a coating solution containing a silver halide emulsion. The elapsed time from dispersion until addition to the coating solution and the time from addition to the coating solution until coating are preferably short. They are respectively preferably within 10 hours, more preferably within 3 hours and still more preferably within 20 minutes.

To each of the above-mentioned couplers, to prevent color fading of the formed dye image due to light, heat and humidity, an anti-fading agent may be added singly or in combination. The preferable compounds or a magenta dye are phenyl ether type compounds represented by Formulas I and II in JP-A No. 2-66541, phenol type compounds represented by Formula IIIB described in JP-A No. 3-174150, amine type compounds represented by Formula A described in JP-A No. 64-90445 and metallic complexes represented by Formulas XII, XIII, XIV and XV described in JP-A No. 62-182741. The preferable compounds to form a yellow dye and a cyan dye are compounds represented by Formula I' described in JP-A No. 1-196049 and compounds represented by Formula II described in JP-A No. 5-11417.

A compound (d-11) described in JP-A No. 4-114154 at page 9, left lower column and a compound (A'-1) described in the same at page 10, left lower column are also employed for allowing the absorption wavelengths of a dye to shift. Besides can also be employed a compound capable of releasing a fluorescent dye described in U.S. Pat. No. 4,774,187.

It is preferable that a compound reacting with the oxidation product of a color developing agent be incorporated into a layer located between light-sensitive layers for preventing color staining and that the compound is added to the silver halide emulsion layer to decrease fogging. As a compound for such purposes, hydroquinone derivatives are preferable, and dialkylhydroquinone such as 2,5-di-t-octyl hydroquinone are more preferable. The specifically preferred compound is a compound represented by Formula II described in JP-A No. 4-133056, and compounds II-1 through II-14 described in the above-mentioned specification pp. 13 through 14 and compound 1 described on page 17.

In the photographic material according to the present invention, it is preferable that static fogging is prevented and light-durability of the dye image is improved by adding a UV absorber. The preferable UV absorbent is benzotriazoles. The specifically preferable compounds are those represented by Formula III-3 in JP-A No. 1-250944, those represented by Formula III described in JP-A No. 64-66646, UV-1L through UV-27L described in JP-A No. 63-187240, those represented by Formula I described in JP-A No. 4-1633 and those represented by Formulas (I) and (II) described in JP-A No. 5-165144.

In the photographic materials used in the invention is advantageously employed gelatin as a binder. Furthermore, there can be optionally employed other hydrophilic colloidal materials, such as gelatin derivatives, graft polymers of gelatin with other polymers, proteins other than gelatin, saccharide derivatives, cellulose derivatives and synthetic hydrophilic polymeric materials. A vinylsulfone type hardening agent or a chlorotriazine type hardening agent is employed as a hardener of the binder, and compounds described in JP-A 61-249054 and 61-245153 are preferably employed. An antiseptic or antimold described in JP-A 3-157646 is preferably incorporated into a hydrophilic colloid layer to prevent the propagation of bacteria and mold which adversely affect photographic performance and storage stability of images. A lubricant or a matting agent is also preferably incorporated to improve surface physical properties of raw or processed photographic materials.

A variety of supports are employed in the photographic material used in the invention, including paper coated with polyethylene or polyethylene terephthalate, paper support made from natural pulp or synthetic pulp, polyvinyl chloride sheet, polypropylene or polyethylene terephthalate supports which may contain a white pigment, and baryta paper. Of these supports a paper support coated, on both sides, with water-proof resin layer. As the water-proof resin are preferably employed polyethylene, ethylene terephthalate and a copolymer thereof. Inorganic and/or organic white pigments are employed, and inorganic white pigments are preferably employed. Examples thereof include alkaline earth metal sulfates such as barium sulfate, alkaline earth metal carbonates such as calcium carbonate, silica such as fine powdery silicate and synthetic silicate, calcium silicate, alumina, alumina hydrate, titanium oxide, zinc oxide, talc, and clay. Preferred examples of white pigments include barium sulfate and titanium oxide. The amount of the white pigment to be added to the water-proof resin layer on the support surface is preferably not less than 13% by weight, and more preferably not less than 15% by weight to improve sharpness. The dispersion degree of a white pigment in the water-proof resin layer of paper support can be measured in accordance with the procedure described in JP-a 2-28640. In this case, the dispersion degree, which is represented by a coefficient of variation, is preferably not more than 020, and more preferably not more than 0.15.

Supports having a center face roughness (Sra) of 0.15 nm or less (preferably, 0.12 nm or less) are preferably employed in terms of glossiness. Trace amounts of a blueing agent or reddening agent such as ultramarine or oil-soluble dyes are incorporated in a water-proof resin layer containing a white pigment or hydrophilic layer(s) of a reflection support to adjust the balance of spectral reflection density in a white portion of processed materials and improve its whiteness. The surface of the support may be optionally subjected to corona discharge, UV light exposure or flame treatment and further thereon, directly or through a sublayer (i.e., one or more sublayer for making improvements in surface properties of the support, such as adhesion property, antistatic property, dimensional stability, friction resistance, hardness, anti halation and/or other characteristics), are coated component layers of the photographic material relating to the invention. In coating of the photographic material, a thickening agent may be employed to enhance coatability of a coating solution. As a coating method are useful extrusion coating and curtain coating, in which two or more layers are simultaneously coated.

To form photographic images using a photographic material relating to the invention, an image recorded on the negative can optically be formed on a photographic material to be printed. Alternatively, the image is converted to digital information to form the image on a CRT (anode ray tube), and the resulting image can be formed on a photographic material to be printed by projecting or scanning with varying the intensity and/or exposing time of laser light, based on the digital information.

It is preferable to apply the present invention to a photographic material wherein a developing agent is not incorporated in the photographic material. Examples of such a photographic material include color paper, color reversal paper, positive image forming photographic material, photographic material used for display, and photographic material used for color proof. Application to photographic material having a reflective support is specifically preferred.

Commonly known aromatic primary amine developing agents are employed in the invention. Examples thereof include:

CD-1) N,N-diethyl-p-phenylendiamine,
CD-2) 2-amino-5-diethylaminotoluene,
CD-3) 2-amino-5-(N-ethyl-N-laurylamino)toluene,
CD-4) 4-(N-ethyl-N-(β-hydroxyethyl)amino)-aniline,
CD-5) 2-methyl-4-(N-ethyl-N-(β-hydroxyethyl)amino) aniline,
CD-6) 4-amino-3-methyl-N-ethyl-N-(β-methanesulfoneamidoethyl)aniline,
CD-7) 4-amino-3-β-methanesulfoneamidoethyl-N,N-diethylaniline
CD-8) N,N-dimethyl-p-phenylenediamine,
CD-9) 4-amino-3-methyl-N-ethyl-N-metoxyethylaniline,
CD-10) 4-amino-3-methyl-N-ethyl-N-(β-ethoxyethyl) aniline,
CD-11) 4-amino-3-methyl-N-ethyl-N-(γ-hydroxypropyl)-aniline.

The pH of a color developing solution is optional, but preferably 9.5 to 13.0, and more preferably 9.8 to 12.0 in terms of rapid access. The higher color development temperature enables more rapid access, but the temperature is preferably 35 to 70° C., and more preferably 37 to 60° C. in terms of stability of processing solutions. The color developing time is conventionally 3 min. 30 sec. but the developing time in the invention is preferably not longer than 40 sec., and more preferably not longer than 25 sec.

In addition to the developing agents described above, the developing solution is added with commonly known developer component compounds, including an alkaline agent having pH-buffering action, a development inhibiting agent such as chloride ion or benzotriazole, a preservative, and a chelating agent.

In the image forming method according to the invention, photographic materials, after color-developed, may be optionally subjected to bleaching and fixing. The bleaching and fixing may be carried out currently. After fixing, washing is conventionally carried out. Stabilizing may be conducted in place of washing. As a processing apparatus used in the invention is applicable a roller transport type processor in which a photographic material is transported with being nipped by rollers and an endless belt type processor in which a photographic material is transported with being fixed in a belt. Further thereto are also employed a method in which a processing solution supplied to a slit-formed processing bath and a photographic material is transported therethrough, a spraying method, a web processing method by contact with a carrier impregnated with a processing solution and a method by use of viscous processing solution. A large amount of photographic materials are conventionally processed using an automatic processor. In this case, the less replenishing rate is preferred and an environmentally friendly embodiment of processing is replenishment being made in the form of a solid tablet, as described in KOKAI-GIHO (Disclosure of Techniques) 94-16935.

EXAMPLES

The present invention will be further described based on examples but are by no means limited to these examples.

Example 1

Preparation of Silver Halide Emulsion

Preparation of Silver Halide Emulsion (B-1)

To 1 liter of an aqueous 2% solution of deionized ossein gelatin (containing 10 ppm calcium), maintained at 40° C. were solutions (A1) and (B1) for 30 min, while controlling the pAg and pH at 7.3 and 3.0, respectively. Subsequently, solutions (A2) and (B2) were added for 150 min with controlling the pAg and pH at 8.0 and 5.5, respectively. Then, solutions (A3) and (B3) were added over 30 min. with controlling the pAg and pH at 8.0 and 5.5, respectively. The pAg was controlled in accordance with the method described in JP-A No. 59-45437 and the pH was controlled using aqueous sulfuric acid or sodium hydroxide solution.

| | |
|---|---|
| Solution (A1) | |
| Sodium chloride | 3.42 g |
| Potassium bromide | 0.03 g |
| Water to make | 200 ml |
| Solution (A2) | |
| Sodium chloride | 71.9 g |
| $K_2IrCl_6$ | $4.0 \times 10^{-8}$ mol/mol AgX |
| $K_4Fe(CN)_6$ | $2.0 \times 10^{-5}$ mol/mol AgX |
| Potassium bromide | 0.7 g |
| Water to make | 420 ml |
| Solution (A3) | |
| Sodium chloride | 30.8 g |
| Potassium bromide | 0.3 g |
| Water to make | 180 ml |
| Solution (B1) | |
| Silver nitrate | 10 g |
| Water to make | 200 ml |

-continued

| | |
|---|---|
| Solution (B2) | |
| Silver nitrate | 210 g |
| Water to make | 420 ml |
| Solution (B3) | |
| Silver nitrate | 90 g |
| Water to make | 180 ml |

After completing addition, an aqueous 5% solution containing 30 g of chemically-modified gelatin (modification rate of 95%), in which an amino group of gelatin was phenylcarbamoylated, was added to perform desalting in accordance with the method described in JP-A No. 5-72658, and an aqueous gelatin solution was further added thereto to obtain silver halide emulsion (B-1) comprising monodisperse cubic grains having an average grain size (cubic equivalent edge length) of 0.64 μm, a coefficient of variation of grain size of 0.07, a chloride content of 99.5 mol % and a bromide content of 0.5 mol %.

In the silver halide emulsion (B-1), the grain growth portion formed by solutions (A1) and (B1) is designated "seed portion", the growth portion formed by solutions (A2) and (B2) is designated "core portion" and the growth portion formed by solutions (A3) and (B3) is designated "shell portion". The seed portion, core portion and shell portion accounted for 3.3%. 66.7% and 30.0% by volume, respectively.

Preparation of Silver Halide Emulsion (B-2)

Silver halide emulsion (B-2) was prepared similarly to the foregoing silver halide emulsion (B-1), except that an iridium compound of solution (A2) was varied as below.

| | |
|---|---|
| $K_2IrCl_6$ | $3.0 \times 10^{-8}$ mol/mol AgX |
| $K_2IrBr_6$ | $1.0 \times 10^{-8}$ mol/mol AgX |

Preparation of Silver Halide Emulsion (B-3)

Silver halide emulsion (B-3) was prepared similarly to the foregoing silver halide emulsion (B-2), except that compound (S-2-5) was added to solutions (A1), (A2) and (A3) in an amount of $2.1\times10^{-5}$ mol/mol.AgX, $4.3\times10^{-5}$ mol/mol.AgX and $1.9\times10^{-5}$ mol/mol.AgX, respectively, based on final grains.

Preparation of Silver Halide Emulsion (B-4)

Silver halide emulsion (B-4) was prepared similarly to the foregoing silver halide emulsion (B-3), except that an iridium compound of solution (A2) was varied as below.

| | |
|---|---|
| $K_2IrCl_6$ | $1.5 \times 10^{-8}$ mol/mol AgX |
| $K_2IrBr_6$ | $5.0 \times 10^{-8}$ mol/mol AgX |
| $K_2[IrCl_5(H_2O)]$ | $5.0 \times 10^{-8}$ mol/mol AgX |

Preparation of Silver Halide Emulsion (B-5)

Silver halide emulsion (B-5) was prepared similarly to the foregoing silver halide emulsion (B-2), except that compound (S-2-5) was added to solutions (A1), (A2) and (A3) in an amount of $2.1\times10^{-6}$ mol/mol.AgX, $5.3\times10^{-5}$ mol/mol.AgX and $9.0\times10^{-5}$ mol/mol.AgX, respectively, based on final grains, and iridium compounds of solution (A2) were varied as below.

| | |
|---|---|
| $K_2IrCl_6$ | $1.5 \times 10^{-8}$ mol/mol AgX |
| $K_2IrBr_6$ | $5.0 \times 10^{-8}$ mol/mol AgX |
| $K_2[IrCl_5(H_2O)]$ | $5.0 \times 10^{-8}$ mol/mol AgX |
| $K_2[IrCl_5(thiazole)]$ | $5.0 \times 10^{-9}$ mol/mol AgX |

Preparation of Silver Halide Emulsion (B-6)

Silver halide emulsion (B-6) was prepared similarly to the foregoing silver halide emulsion (B-5), except that after completing addition of all of silver nitrate and halide solutions, 0.0055 mol of fine silver bromide grains (grain size of 0.02 μm) was added to form bromide-localized phases in the vicinity of the corners of the grains. The thus prepared silver halide emulsion (B-6) was comprised of monodisperse cubic grains having an average grain size (cubic equivalent edge length) of 0.64 μm, a coefficient of variation of grain size of 0.07, a chloride content of 99.2 mol % and a bromide content of 0.8 mol %.

Preparation of Silver Halide Emulsion (B-7)

Silver halide emulsion (B-7) was prepared similarly to the foregoing silver halide emulsion (B-5), except that a ruthenium compound described below was added to solution (A1); when addition of solutions (A3) and (B3) reached 65% of the total, the addition of silver nitrate and halide solutions was interrupted and 7.2 ml of aqueous 0.5 M potassium iodide solution was added; then, the addition of silver nitrate and halide solutions was restarted and after completing the addition of silver nitrate and halide solutions, 0.0055 mol of fine silver bromide grains (grain size of 0.02 μm) was further added to form bromide-localized phases in the vicinity of corners of the grain. The thus prepared silver halide emulsion (B-7) was comprised of monodisperse cubic grains having an average grain size (cubic equivalent edge length) of 0.64 μm, a coefficient of variation of grain size of 0.07, a chloride content of 99.0 mol %, a bromide content of 0.8 mol % and a iodide content of 0.2 mol %.

| | |
|---|---|
| $K_2[Ru(NO)Cl_5]$ | $9.0 \times 10^{-9}$ mol/mol AgX |

Preparation of Blue-sensitive Silver Halide Emulsion (B-1a)

To the foregoing silver halide emulsion (B-1), sensitizing dyes (BS-1) and (BS-2) were added at 60° C., a pH of 5.8 and a pAg of 7.5, subsequently, sodium thiosulfate and chloroauric acid were added to perform spectral sensitization and chemical sensitization. Following the addition of chemical sensitizers and when optimally ripened, compounds (S-2-5), (S-2-2) and (S-2-3) were successively added to stop ripening. A blue-sensitive silver halide emulsion (B-1a) was thus obtained.

| | |
|---|---|
| Sodium thiosulfate | $5.0 \times 10^{-6}$ mol/mol AgX |
| Chloroauric acid | $1.5 \times 10^{-5}$ mol/mol AgX |
| Compound S-2-5 | $3.0 \times 10^{-4}$ mol/mol AgX |
| Compound S-2-2 | $3.0 \times 10^{-4}$ mol/mol AgX |
| Compound S-2-3 | $3.0 \times 10^{-4}$ mol/mol AgX |
| Sensitizing dye BS-1 | $4.0 \times 10^{-4}$ mol/mol AgX |
| Sensitizing dye BS-2 | $1.0 \times 10^{-4}$ mol/mol AgX |

Preparation of Blue-sensitive Silver Halide Emulsion (B-1b)

A blue-sensitive silver halide emulsion (B-1b) was prepared similarly to the foregoing blue-sensitive silver halide emulsion (B-1a), except that compound (1-21) was added in an amount of $2.0\times10^{-4}$ mol/mol.AgX at the completion of 70% of the chemical sensitization time from the addition of sodium thiosulfate to the addition of compound (S-2-5).

Preparation of Blue-sensitive Silver Halide Emulsion (B-1c)

A blue-sensitive silver halide emulsion (B-1c) was prepared similarly to the blue-sensitive silver halide emulsion (B-1a), except that immediately before adding the sensitizing dyes (BS-1) and (BS-2), compound (1-21) was added in an amount of $1.0\times10^{-4}$ mol/mol.AgX.

Preparation of Blue-sensitive Silver Halide Emulsion, (B-1d)

A blue-sensitive silver halide emulsion (B-1d) was prepared similarly to the blue-sensitive silver halide emulsion (B-1a), except that immediately before adding the sensitizing dyes (BS-1) and (BS-2), compound (1-21) was added in an amount of $1.0\times10^{-4}$ mol/mol.AgX and the compound (1-21) was further added in an amount of $2.0\times10^{-4}$ mol/mol.AgX at the completion of 70% of the chemical sensitization time of from addition of sodium thiosulfate to addition of compound (S-2-5).

Preparation of Blue-sensitive Silver Halide Emulsion (B-1e)

A blue-sensitive silver halide emulsion (B-1e) was prepared similarly to the blue-sensitive silver halide emulsion (B-1a), except that immediately before adding the sensitizing dyes (BS-1) and (BS-2), compound (1-21) was added in an amount of $1.0\times10^{-4}$ mol/mol.AgX and the compound (1-21) was further added in an amount of $2.0\times10^{-4}$ mol/mol.AgX at the completion of 90% of the chemical sensitization time of from addition of sodium thiosulfate to addition of compound (S-2-5).

Preparation of Blue-sensitive Silver Halide Emulsion (B-2a)

To the foregoing silver halide emulsion (B-2), $1.0\times10^{-4}$ mol/mol.AgX of compound (1-21) was added at 60° C., a pH of 5.8 and a pAg of 7.5, and immediately, sensitizing dyes (BS-1) and (BS-2) were added. Subsequently, sodium thiosulfate and chloroauric acid were added to perform spectral sensitization and chemical sensitization. Following addition of chemical sensitizers and when optimally ripened, compounds (S-2-5), (S-2-2) and (S-2-3) were successively added to stop ripening. In the course of ripening, the compound (1-21) was further added in an amount of $2.0\times10^{-4}$ mol/mol.AgX at the completion of 90% of the chemical sensitization time of from addition of sodium thiosulfate to addition of compound (S-2-5). According to the foregoing procedure was obtained a blue-sensitive silver halide emulsion (B-2a).

| | |
|---|---|
| Sodium thiosulfate | $5.0\times10^{-6}$ mol/mol AgX |
| Chloroauric acid | $1.5\times10^{-5}$ mol/mol AgX |
| Compound S-2-5 | $2.0\times10^{-4}$ mol/mol AgX |
| Compound S-2-2 | $3.0\times10^{-4}$ mol/mol AgX |
| Compound S-2-3 | $3.0\times10^{-4}$ mol/mol AgX |
| Sensitizing dye BS-1 | $4.0\times10^{-4}$ mol/mol AgX |
| Sensitizing dye BS-2 | $1.0\times10^{-4}$ mol/mol AgX |

Preparation of Blue-sensitive Silver Halide Emulsion (B-3a)

To the foregoing silver halide emulsion (B-3), $1.0\times10^{-4}$ mol/mol.AgX of compound (1-21) was added at 60° C., a pH of 5.8 and a pAg of 7.5, and sensitizing dyes (BS-1) and (BS-2) were added immediately. Subsequently, sodium thiosulfate and chloroauric acid were added to perform spectral sensitization and chemical sensitization. Following addition of chemical sensitizers and when optimally ripened, compounds (S-2-5), (S-2-2) and (S-2-3) were successively added to stop ripening. In the course of ripening, compound (1-21) was further added in an amount of $2.0\times10^{-4}$ mol/mol.AgX at the completion of 90% of the chemical sensitization time of from addition of sodium thiosulfate to addition of compound (S-2-5). According to the foregoing procedure was obtained a blue-sensitive silver halide emulsion (B-3a).

| | |
|---|---|
| Sodium thiosulfate | $5.0\times10^{-6}$ mol/mol AgX |
| Chloroauric acid | $1.5\times10^{-5}$ mol/mol AgX |
| Compound S-2-5 | $2.0\times10^{-4}$ mol/mol AgX |
| Compound S-2-2 | $3.0\times10^{-4}$ mol/mol AgX |
| Compound S-2-3 | $3.0\times10^{-4}$ mol/mol AgX |
| Sensitizing dye BS-1 | $4.0\times10^{-4}$ mol/mol AgX |
| Sensitizing dye BS-2 | $1.0\times10^{-4}$ mol/mol AgX |

Preparation of Blue-sensitive Silver Halide Emulsion (B-3b)

A blue-sensitive silver halide emulsion (B-3b) was prepared similarly to the foregoing blue-sensitive silver halide emulsion (B-3a), except that the addition of the compound (1-21) at the completion of 90% of the chemical sensitization time of from addition of sodium thiosulfate to addition of compound (S-2-5) was canceled and $2.0\times10^{-4}$ mol/mol.AgX of the compound (1-21) was added after the addition of compounds (S-2-5), (S-2-2) and (S-2-3).

Preparation of Blue-sensitive Silver Halide Emulsion (B-3c)

A blue-sensitive silver halide emulsion (B-3c) was prepared similarly to the blue-sensitive silver halide emulsion (B-3a), except that the addition of sensitizing dyes (BS-1) and (BS-2) before the addition of sodium thiosulfate and chloroauric acid was canceled and sensitizing dyes (BS-1) and (BS-2) were added after the addition of compounds (S-2-5), (S-2-2) and (S-2-3).

Preparation of Blue-sensitive Silver Halide Emulsion (B-4a), (B-5a), (B-6a) and (B-7a)

Similarly to the blue-sensitive silver halide emulsion (B-3a), blue-sensitive silver halide emulsions (B-4a), (B-5a), (B-6a) and (B-7a) were prepared using silver halide emulsions (B-4), (B-5), (B-6) and (B-7), respectively.

Preparation of Blue-sensitive Silver Halide Emulsion (B-7b)

A blue-sensitive silver halide emulsion (B-7b) was prepared similarly to the foregoing blue-sensitive silver halide emulsion (B-7a), except that the compound (1-21) was replaced by compound (1-2).

Preparation of Blue-sensitive Silver Halide Emulsion (B-7c)

A blue-sensitive silver halide emulsion (B-7c) was prepared similarly to the blue-sensitive silver halide emulsion (B-7a), except that the first addition of compound (1-21) was changed from $1.0\times10^{-4}$ mol/mol.AgX to $1.5\times10^{-4}$ mol/mol.AgX and the second addition of compound (1-21) was changed from $2.0\times10^{-4}$ mol/mol.AgX to $1.5\times10^{-4}$ mol/mol.AgX.

Preparation of Blue-sensitive Silver Halide Emulsion (B-7d)

A blue-sensitive silver halide emulsion (B-7d) was prepared similarly to the blue-sensitive silver halide emulsion (B-7a), except that the first addition of the compound (1-21) was replaced by that of compound (1-2).

Preparation of Blue-sensitive Silver Halide Emulsion (B-7e)

A blue-sensitive silver halide emulsion (B-7e) was prepared similarly to the blue-sensitive silver halide emulsion (B-7a), except that the first addition of the compound (1-21) was replaced by that of compound (1-2), the second addition of compound (1-21) was changed to $1.0\times10^{-4}$ mol/mol.AgX and $1.4\times10^{-4}$ mol/mol.AgX of compound (1-2) was further added at the completion of 95% of the chemical sensitization time of from addition of sodium thiosulfate to addition of compound (S-2-5).

Preparation of Silver Halide Emulsion

Silver halide emulsions (G-1) to (G-5), which were each comprised of monodisperse cubic silver halide grains having an average grain size (cubic equivalent edge length) of 0.50 μm, a coefficient of variation of grain size of 0.08, a chloride content of 99.5 mol % and a bromide content of 0.5 mol %, were each prepared similarly to the foregoing silver halide emulsions (B-1) to (B-5), except that the time of addition of solutions (A1), (B1), (A2), (B2), (A3) and (B3) was optimally varied.

A silver halide emulsion (G-6), which was comprised of monodisperse cubic silver halide grains having an average grain size (cubic equivalent edge length) of 0.50 μm, a coefficient of variation of grain size of 0.08, a chloride content of 99.2 mol % and a bromide content of 0.8 mol %, was prepared similarly to the foregoing silver halide emulsions (B-6), except that the time of addition of solutions (A1), (B1), (A2), (B2), (A3) and (B3) was optimally varied.

A silver halide emulsion (G-7), which was comprised of monodisperse cubic silver halide grains having an average grain size (cubic equivalent edge length) of 0.50 μm, a coefficient of variation of grain size of 0.08, a chloride content of 99.0 mol %, a bromide content of 0.8 mol % and an iodide content of 0.2 mol %, was prepared similarly to the foregoing silver halide emulsions (B-7), except that the time of addition of solutions (A1), (B1), (A2), (B2), (A3) and (B3) was optimally varied.

Preparation of Green-sensitive Silver Halide Emulsion (G-1a)

To the foregoing silver halide emulsion (G-1), sensitizing dye (GS-1) was added at 60° C., a pH of 5.8 and a pAg of 7.5 and subsequently, sodium thiosulfate and chloroauric acid were successively added to perform spectral sensitization and chemical sensitization. Following addition of the chemical sensitizers and when optimally ripened, compound (S-2-5) was added to stop ripening. A green-sensitive silver halide emulsion (G-1a) was thus obtained.

| | |
|---|---|
| Sensitizing dye GS-1 | $4.0 \times 10^{-4}$ mol/mol AgX |
| Sodium thiosulfate | $4.5 \times 10^{-6}$ mol/mol AgX |
| Chloroauric acid | $1.5 \times 10^{-5}$ mol/mol AgX |
| Compound S-2-5 | $1.5 \times 10^{-4}$ mol/mol AgX |

Preparation of Green-sensitive Silver Halide Emulsion (G-1b)

A green-sensitive silver halide emulsion (G-1b) was prepared similarly to the foregoing green-sensitive silver halide emulsion (G-1a), except that compound (1-21) was added in an amount of $1.5\times10^{-4}$ mol/mol.AgX at the completion of 70% of the chemical sensitization time from the addition of sodium thiosulfate to the addition of compound (S-2-5).

Preparation of Green-sensitive Silver Halide Emulsion (G-1c)

A green-sensitive silver halide emulsion (G-1c) was prepared similarly to the green-sensitive silver halide emulsion (G-1a), except that immediately before adding sensitizing dye (GS-1), compound (1-21) was added in an amount of $1.0\times10^{-4}$ mol/mol.AgX.

Preparation of Green-sensitive Silver Halide Emulsion (G-1d)

A green-sensitive silver halide emulsion (G-1d) was prepared similarly to the green-sensitive silver halide emulsion (G-1a), except that immediately before adding sensitizing dye (GS-1), compound (1-21) was added in an amount of $1.0\times10^{-4}$ mol/mol.AgX and the compound (1-21) was further added in an amount of $2.0\times10^{-4}$ mol/mol.AgX at the completion of 70% of the chemical sensitization time of from addition of sodium thiosulfate to addition of compound (S-2-5).

Preparation of Green-sensitive Silver Halide Emulsion (G-1e)

A green-sensitive silver halide emulsion (G-1e) was prepared similarly to the green-sensitive silver halide emulsion (G-1a), except that immediately before adding sensitizing dye (GS-1), compound (1-21) was added in an amount of $1.0\times10^{-4}$ mol/mol.AgX and the compound (1-21) was further added in an amount of $2.0\times10^{-4}$ mol/mol.AgX at the completion of 90% of the chemical sensitization time of from addition of sodium thiosulfate to addition of compound (S-2-5).

Preparation of Green-sensitive Silver Halide Emulsion (G-2a)

To the foregoing silver halide emulsion (G-2), $1.0\times10^{-4}$ mol/mol.AgX of compound (1-21) was added at 60° C., a pH of 5.8 and a pAg of 7.5, and immediately thereafter, sensitizing dye (GS-1) was added. Subsequently, sodium thiosulfate and chloroauric acid were added to perform spectral sensitization and chemical sensitization. Following addition of chemical sensitizers and when optimally ripened, compounds (S-2-5) was added to stop ripening. In the course of ripening, the compound (1-21) was further added in an amount of $2.0\times10^{-4}$ mol/mol.AgX at the completion of 90% of the chemical sensitization time of from addition of sodium thiosulfate to addition of compound (S-2-5). According to the foregoing procedure was obtained a green-sensitive silver halide emulsion (G-2a).

| | |
|---|---|
| Sensitizing dye GS-1 | $4.0 \times 10^{-4}$ mol/mol AgX |
| Sodium thiosulfate | $4.5 \times 10^{-6}$ mol/mol AgX |
| Chloroauric acid | $1.5 \times 10^{-5}$ mol/mol AgX |
| Compound S-2-5 | $1.5 \times 10^{-4}$ mol/mol AgX |

Preparation of Green-sensitive Silver Halide Emulsion (G-3a)

To the foregoing silver halide emulsion (G-3), $1.0\times10^{-4}$ mol/mol.AgX of compound (1-21) was added at 60° C., a pH of 5.8 and a pAg of 7.5, and sensitizing dye (GS-1) was immediately added. Subsequently, sodium thiosulfate and chloroauric acid were added to perform spectral sensitization and chemical sensitization. Following addition of chemical sensitizers and when optimally ripened, compound (S-2-5) was added to stop ripening. In the course of ripening, the compound (1-21) was further added in an amount of $2.0\times10^{-4}$ mol/mol.AgX at the completion of 90% of the chemical sensitization time of from addition of sodium thiosulfate to addition of compound (S-2-5). According to the foregoing procedure was obtained a green-sensitive silver halide emulsion (G-3a).

| | |
|---|---|
| Sensitizing dye GS-1 | $4.0 \times 10^{-4}$ mol/mol AgX |
| Sodium thiosulfate | $4.5 \times 10^{-6}$ mol/mol AgX |
| Chloroauric acid | $1.5 \times 10^{-5}$ mol/mol AgX |
| Compound S-2-5 | $1.8 \times 10^{-4}$ mol/mol AgX |

Preparation of Green-sensitive Silver Halide Emulsion (G-3b)

A green-sensitive silver halide emulsion (G-3b) was prepared similarly to the foregoing green-sensitive silver halide emulsion (G-3a), except that the addition of the compound (1-21) at the completion of 90% of the chemical sensitization time of from addition of sodium thiosulfate to addition of compound (S-2-5) was canceled and $2.0\times10^{-4}$ mol/mol.AgX of the compound (1-21) was added after the addition of compound (S-2-5).

Preparation of Green-sensitive Silver Halide Emulsion (G-3c)

A green-sensitive silver halide emulsion (B-3c) was prepared similarly to the green-sensitive silver halide emulsion (G-3a), except that the addition of sensitizing dye (GS-1) before the addition of sodium thiosulfate and chloroauric acid was canceled and sensitizing dye (GS-1) was added after the addition of compounds (S-2-5).

Preparation of Green-sensitive Silver Halide Emulsion (G-4a), (G-5a), (G-6a) and (G-7a)

Similarly to the green-sensitive silver halide emulsion (G-3a), green-sensitive silver halide emulsions (G-4a), (G-5a), (G-6a) and (G-7a) were prepared using silver halide emulsions (G-4), (G-5), (G-6) and (G-7), respectively.

Preparation of Green-sensitive Silver Halide Emulsion (G-7b)

A green-sensitive silver halide emulsion (G-7b) was prepared similarly to the foregoing green-sensitive silver halide emulsion (G-7a), except that the compound (1-21) was replaced by compound (1-2).

Preparation of Green-sensitive Silver Halide Emulsion (G-7c)

A green-sensitive silver halide emulsion (G-7c) was prepared similarly to the green-sensitive silver halide emulsion (G-7a), except that the first addition of compound (1-21) was changed from $1.0\times10^{-4}$ mol/mol.AgX to $1.5\times10^{-4}$ mol/mol.AgX and the second addition of compound (1-21) was changed from $2.0\times10^{-4}$ mol/mol.AgX to $1.5\times10^{-4}$ mol/mol.AgX.

Preparation of Green-sensitive Silver Halide Emulsion (G-7d)

A green-sensitive silver halide emulsion (G-7d) was prepared similarly to the green-sensitive silver halide emulsion (G-7a), except that the first addition of the compound (1-21) was replaced by that of compound (1-2).

Preparation of Green-sensitive Silver Halide Emulsion (G-7e)

A green-sensitive silver halide emulsion (G-7e) was prepared similarly to the green-sensitive silver halide emulsion (G-7a), except that the first addition of the compound (1-21) was replaced by that of compound (1-2), the second addition of compound (1-21) was changed to $1.0\times10^{-4}$ mol/mol.AgX and $1.4\times10^{-4}$ mol/mol.AgX of compound (1-2) was further added at the completion of 95% of the chemical sensitization time of from addition of sodium thiosulfate to addition of compound (S-2-5).

Preparation of Silver Halide Emulsion

Silver halide emulsions (R-1) to (R-5), which were each comprised of monodisperse cubic silver halide grains having an average grain size (cubic equivalent edge length) of 0.40 μm, a coefficient of variation of grain size of 0.08, a chloride content of 99.5 mol % and a bromide content of 0.5 mol %, were each prepared similarly to the foregoing silver halide emulsions (B-1) to (B-5), except that the time of addition of solutions (A1), (B1), (A2), (B2), (A3) and (B3) was optimally varied.

A silver halide emulsion (R-6), which was comprised of monodisperse cubic silver halide grains having an average grain size (cubic equivalent edge length) of 0.40 μm, a coefficient of variation of grain size of 0.08, a chloride content of 99.2 mol % and a bromide content of 0.8 mol %, were each prepared similarly to the foregoing silver halide emulsions (B-6), except that the time of addition of solutions (A1), B1), (A2), (B2), (A3) and (B3) was optimally varied.

A silver halide emulsion (R-7), which was comprised of monodisperse cubic silver halide grains having an average grain size (cubic equivalent edge length) of 0.40 μm, a coefficient of variation of grain size of 0.08, a chloride content of 99.0 mol %, a bromide content of 0.8 mol % and an iodide content of 0.2 mol %, were each prepared similarly to the foregoing silver halide emulsions (B-7), except that the time of addition of solutions (A1), (B1), (A2), (B2), (A3) and (B3) was optimally varied.

Preparation of Red-sensitive Silver Halide Emulsion (R-1a)

To the foregoing silver halide emulsion (R-1), sensitizing dyes (RS-1) and (RS-2) were added at 60° C., a pH of 5.0 and a pAg of 7.1 and subsequently, sodium thiosulfate and chloroauric acid were added to perform spectral sensitization and chemical sensitization. Following the addition of chemical sensitizers and when optimally ripened, compound (S-2-5) was added to stop ripening. A red-sensitive silver halide emulsion (R-1a) was thus obtained.

| | |
|---|---|
| Sodium thiosulfate | $1.2\times10^{-5}$ mol/mol AgX |
| Chloroauric acid | $1.5\times10^{-5}$ mol/mol AgX |
| Compound S-2-5 | $1.2\times10^{-4}$ mol/mol AgX |
| Sensitizing dye RS-1 | $1.0\times10^{-4}$ mol/mol AgX |
| Sensitizing dye RS-2 | $1.0\times10^{-4}$ mol/mol AgX |

Preparation of Red-sensitive Silver Halide Emulsion (R-1b)

A red-sensitive silver halide emulsion (R-1b) was prepared similarly to the foregoing red-sensitive silver halide emulsion (R-1a), except that compound (1-21) was added in an amount of $1.5\times10^{-4}$ mol/mol.AgX at the completion of 70% of the chemical sensitization time from the addition of sodium thiosulfate to the addition of compound (S-2-5).

Preparation of Red-sensitive Silver Halide Emulsion (R-1c)

A red-sensitive silver halide emulsion (R-1c) was prepared similarly to the red-sensitive silver halide emulsion (R-1a), except that immediately before adding sensitizing dyes (RS-1) and (RS-2), compound (1-21) was added in an amount of $1.0\times10^{-4}$ mol/mol.AgX.

Preparation of Red-sensitive Silver Halide Emulsion, (R-1d)

A red-sensitive silver halide emulsion (R-1d) was prepared similarly to the red-sensitive silver halide emulsion (R-1a), except that immediately before adding sensitizing dyes (RS-1) and (RS-2), compound (1-21) was added in an amount of $1.0\times10^{-4}$ mol/mol.AgX and the compound (1-21) was further added in an amount of $2.0\times10^{-4}$ mol/mol.AgX at the completion of 70% of the chemical sensitization time of from addition of sodium thiosulfate to addition of compound (S-2-5).

Preparation of Red-sensitive Silver Halide Emulsion (R-1e)

A red-sensitive silver halide emulsion (R-1e) was prepared similarly to the red-sensitive silver halide emulsion (R-1a), except that immediately before adding sensitizing dyes (RS-1) and (RS-2), compound (1-21) was added in an amount of $1.0\times10^{-4}$ mol/mol.AgX and the compound (1-21) was further added in an amount of $2.0\times10^{-4}$ mol/mol.AgX at the completion of 90% of the chemical sensitization time of from addition of sodium thiosulfate to addition of compound (S-2-5).

Preparation of Red-sensitive Silver Halide Emulsion (R-2a)

To the foregoing silver halide emulsion (R-2), $1.0\times10^{-4}$ mol/mol.AgX of compound (1-21) was added at 60° C., a pH of 5.0 and a pAg of 7.1, and immediately, sensitizing dyes (RS-1) and (RS-2) were added; subsequently, sodium thiosulfate and chloroauric acid were added to perform spectral sensitization and chemical sensitization. Following addition of chemical sensitizers and when optimally ripened, compound (S-2-5) was added to stop ripening. In the course of ripening, the compound (1-21) was further added in an amount of $2.0\times10^{-4}$ mol/mol.AgX at the completion of 90% of the chemical sensitization time of from addition of sodium thiosulfate to addition of compound (S-2-5).

According to the foregoing procedure was obtained a red-sensitive silver halide emulsion (B-2a).

| | |
|---|---|
| Sodium thiosulfate | $1.2 \times 10^{-5}$ mol/mol AgX |
| Chloroauric acid | $1.5 \times 10^{-5}$ mol/mol AgX |
| Compound S-2-5 | $1.5 \times 10^{-4}$ mol/mol AgX |
| Sensitizing dye RS-1 | $1.0 \times 10^{-4}$ mol/mol AgX |
| Sensitizing dye RS-2 | $1.0 \times 10^{-4}$ mol/mol AgX |

Preparation of Red-sensitive Silver Halide Emulsion (R-3a)

To the foregoing silver halide emulsion (R-3), $1.0\times10^{-4}$ mol/mol.AgX of compound (1-21) was added at 60° C., a pH of 5.0 and a pAg of 7.1, and sensitizing dyes (RS-1) and (RS-2) were immediately added. Subsequently, sodium thiosulfate and chloroauric acid were added to perform spectral sensitization and chemical sensitization. Following addition of chemical sensitizers and when optimally ripened, compound (S-2-5) was added to stop ripening. In the course of ripening, compound (1-21) was further added in an amount of $2.0\times10^{-4}$ mol/mol.AgX at the completion of 90% of the chemical sensitization time of from addition of sodium thiosulfate to addition of compound (S-2-5). According to the foregoing procedure was obtained a red-sensitive silver halide emulsion (R-3a).

| | |
|---|---|
| Sodium thiosulfate | $1.2 \times 10^{-5}$ mol/mol AgX |
| Chloroauric acid | $1.5 \times 10^{-5}$ mol/mol AgX |
| Compound S-2-5 | $1.5 \times 10^{-4}$ mol/mol AgX |
| Sensitizing dye RS-1 | $1.0 \times 10^{-4}$ mol/mol AgX |
| Sensitizing dye RS-2 | $1.0 \times 10^{-4}$ mol/mol AgX |

Preparation of Red-sensitive Silver Halide Emulsion (R-3b)

A red-sensitive silver halide emulsion (R-3b) was prepared similarly to the foregoing red-sensitive silver halide emulsion (R-3a), except that the addition of the compound (1-21) at the completion of 90% of the chemical sensitization time of from addition of sodium thiosulfate to addition of compound (S-2-5) was canceled and $2.0\times10^{-4}$ mol/mol.AgX of the compound (1-21) was added after the addition of compound (S-2-5).

Preparation of Red-sensitive Silver Halide Emulsion (R-3c)

A red-sensitive silver halide emulsion (R-3c) was prepared similarly to the red-sensitive silver halide emulsion (R-3a), except that the addition of sensitizing dyes (RS-1) and (RS-2) before the addition of sodium thiosulfate and chloroauric acid was canceled and sensitizing dyes (RS-1) and (RS-2) were added after the addition of compound (S-2-S).

Preparation of Red-sensitive Silver Halide Emulsion (R-4a), (R-5a), (R-6a) and (R-7a)

Similarly to the red-sensitive silver halide emulsion (R-3a), red-sensitive silver halide emulsions (R-4a), (R-5a), (R-6a) and (R-7a) were prepared using silver halide emulsions (R-4), (R-5), (R-6) and (R-7), respectively.

Preparation of Red-sensitive Silver Halide Emulsion (R-7b)

A red-sensitive silver halide emulsion (R-7b) was prepared similarly to the foregoing red-sensitive silver halide emulsion (R-7a), except that the compound (1-21) was replaced by compound (1-2).

Preparation of Red-sensitive Silver Halide Emulsion (R-7c)

A red-sensitive silver halide emulsion (R-7c) was prepared similarly to the red-sensitive silver halide emulsion (R-7a), except that the first addition of compound (1-21) was changed from $1.0\times10^{-4}$ mol/mol.AgX to $1.5\times10^{-4}$ mol/mol.AgX and the second addition of compound (1-21) was changed from $2.0\times10^{-4}$ mol/mol.AgX to $1.5\times10^{-4}$ mol/mol.AgX.

Preparation of Red-sensitive Silver Halide Emulsion (R-7d)

A red-sensitive silver halide emulsion (R-7d) was prepared similarly to the red-sensitive silver halide emulsion (R-7a), except that the first addition of the compound (1-21) was replaced by that of compound (1-2).

Preparation of Red-sensitive Silver Halide Emulsion (R-7e)

A red-sensitive silver halide emulsion (R-7e) was prepared similarly to the red-sensitive silver halide emulsion (R-7a), except that the first addition of the compound (1-21) was replaced by that of compound (1-2), the second addition of compound (1-21) was changed to $1.0\times10^{-4}$ mol/mol.AgX and $1.4\times10^{-4}$ mol/mol.AgX of compound (1-2) was further added at the completion of 95% of the chemical sensitization time of from addition of sodium thiosulfate to addition of compound (S-2-5).

In the foregoing preparation of red-sensitive silver halide emulsions, $2.0\times10^{-3}$ mol/mol.AgX of SS-1 was added at the completion of the preparation.

BS-1

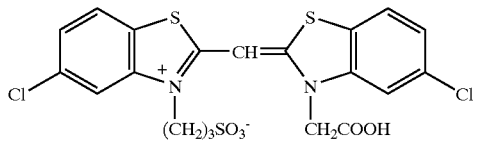

BS-2

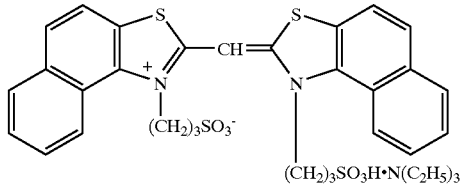

GS-1

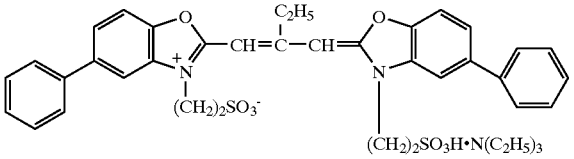

RS-1

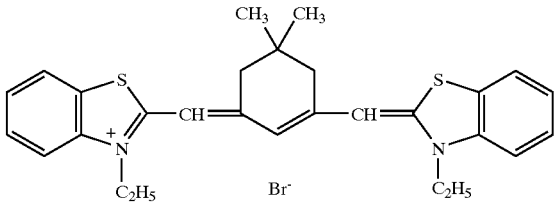

RS-2

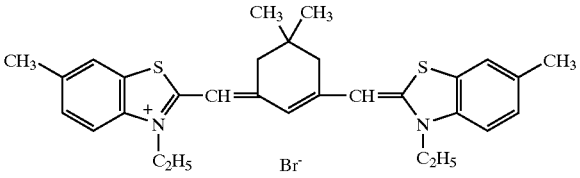

-continued

SS-1

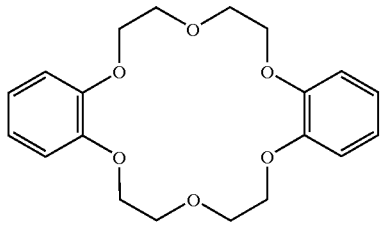

Preparation of Silver Halide Color Photographic Material

Preparation of Sample 101

There was prepared a paper support laminated, on the light-sensitive layer coating side of paper having a weight of 180 g/m$^2$, with high density polyethylene, provided that the light-sensitive layer side was laminated with polyethylene melt containing surface-treated anatase type titanium oxide in an amount of 15% by weight. This reflection support was subjected to corona discharge and provided with a gelatin sublayer, and further thereon, the following component layers, as shown below were provided to prepare a silver halide color photographic material Sample 101.

Coating solutions were prepared according to the following procedure.

1st Layer Coating Solution

To 3.34 g of yellow coupler (Y-1), 10.02 of yellow coupler (Y-2) and 1.67 g of yellow coupler (Y-3), 1.67 g of dye image stabilizer (ST-1), 1.67 g of dye image stabilizer (ST-2), 3.34 g of dye image stabilizer (ST-5), 0.167 g of antistaining agent (HQ-1), 2.67 g of image stabilizer A, 1.34 g of image stabilizer B, 5.0 g of high boiling organic solvent (DBP) and 1.67 g of high boiling solvent (DNP) was added 60 ml of ethyl acetate. Using an ultrasonic homogenizer, the resulting solution was dispersed in 320 ml of an aqueous 10% gelatin solution containing 5 ml of an aqueous 20% surfactant (SU-1) solution to obtain a yellow coupler emulsified dispersion. The obtained dispersion was mixed with the blue-sensitive silver halide emulsion (B-1a) to prepare a 1st layer coating solution.

2nd to 7th Layer Coating Solution

Coating solutions for the 2nd layer to 7th layer were each prepared similarly to the 1st layer coating solution, and the respective coating solutions were coated so as to have a coating amount as shown below.

Hardeners (H-1) and (H-2) were incorporated into the 2nd, 4th and 7th layers. There were also incorporated surfactants, (SU-2) and (SU-3) as a coating aid to adjust surface tension. Further to each layer was a fungicide (F-1) so as to have a total amount of 0.04/m$^2$. The amount of silver halide contained in the respective layers was represented by equivalent converted to silver. Additives used in sample 101 are as follows:

SU-1: Sodium tri-i-ptopylnaphthalenesulfonate
SU-2: Di(2-ethylhexyl) sulfosuccinate sodium salt
SU-3: 2,2,3,3,4,4,5,5-Octafluoropentyl sulfosuccinate sodium salt
DBP: Dibutyl phthalate
DNP: Dinonyl phthalate
DOP: Dioctyl phthalate
DIDP: Diisodecyl phthalate
H-1: Tetrakis(vinylsulfonylmethyl)methane
H-2: 2,4-Dichloro-6-hydroxy-s-triazine sodium salt
HQ-1: 2,5-di-t-octylhydroquinone
HQ-2: 2,5-di-sec-dodecylhydroquinone
HQ-3: 2,5-di-sec-tetradecylhydroquinone
HQ-4: 2-sec-dodecyl-5-sec-tetradecyhydroquinone
HQ-5: 2,5-di[(1,1-dimethyl-4-hexyloxycarbonyl)butyl]-hydroquinone
Image stabilizer A: p-t-Octylphenol
Image stabilizer B: poly(t-butylacrylamide)

| Layer | Constitution | Amount (g/m$^2$) |
|---|---|---|
| 7th Layer (Protective layer) | Gelatin | 0.70 |
| | DIDP | 0.002 |
| | DBP | 0.002 |
| | Silicon dioxide | 0.003 |
| 6th Layer (UV absorbing layer) | Gelatin | 0.40 |
| | AI-1 | 0.01 |
| | UV absorbent (UV-1) | 0.07 |
| | UV absorbent (UV-2) | 0.12 |
| | Antistaining agent (HQ-5) | 0.02 |
| 5th Layer (Red-sensitive layer) | Gelatin | 1.00 |
| | Red-sensitive emulsion (R-1a) | 0.17 |
| | Cyan coupler (C-1) | 0.22 |
| | Cyan coupler (C-2) | 0.06 |
| | Dye image stabilizer (ST-1) | 0.06 |
| | Antistaining agent (HQ-1) | 0.003 |
| | DBP | 0.10 |
| | DOP | 0.20 |
| 4th Layer (UV absorbing layer) | Gelatin | 0.94 |
| | AI-1 | 0.02 |
| | UV absorbent (UV-1) | 0.17 |
| | UV absorbent (UV-2) | 0.27 |
| | Antistaining agent (HQ-5) | 0.06 |
| 3rd Layer (Green-sensitive layer) | Gelatin | 1.30 |
| | AI-2 | 0.01 |
| | Green-sensitive Emulsion (G-1a) | 0.12 |
| | Magenta coupler (M-1) | 0.05 |
| | Magenta coupler (M-2) | 0.15 |
| | Dye image stabilizer (ST-3) | 0.10 |
| | Dye image stabilizer (ST-4) | 0.02 |
| | DIDP | 0.10 |
| | DBP | 0.10 |
| 2nd layer (Interlayer) | Gelatin | 1.20 |
| | AI-3 | 0.01 |
| | Antistaining agent (HQ-1) | 0.02 |
| | Antistaining agent (HQ-2) | 0.03 |
| | Antistaining agent (HQ-3) | 0.06 |
| | Antistaining agent (HQ-4) | 0.03 |
| | Antistaining agent (HQ-5) | 0.03 |
| | DIDP | 0.04 |
| | DBP | 0.02 |
| 1st layer (Blue-sensitive layer) | Gelatin | 1.10 |
| | Blue-sensitive Emulsion (B-1a) | 0.24 |
| | Yellow coupler (Y-1) | 0.10 |
| | Yellow coupler (Y-2) | 0.30 |
| | Yellow coupler (Y-3) | 0.05 |
| | Dye image stabilizer (ST-1) | 0.05 |
| | Dye image stabilizer (ST-2) | 0.05 |
| | Dye image stabilizer (ST-5) | 0.10 |
| | Antistaining agent (HQ-1) | 0.005 |
| | Image stabilizer A | 0.08 |
| | Image stabilizer B | 0.04 |
| | DNP | 0.05 |
| | DBP | 0.15 |
| Support | Polyethylene-laminated paper containing a small amount of colorant | |

Y-1
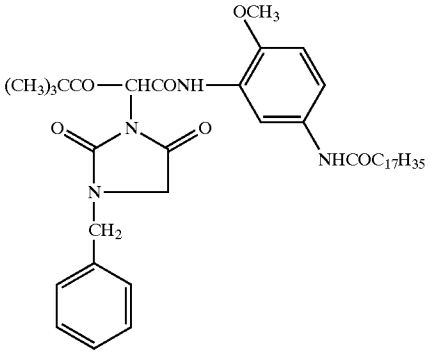
Y-2
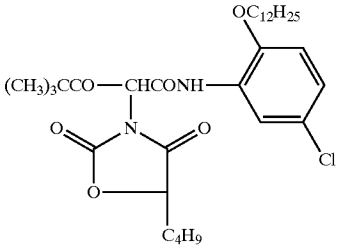
Y-3
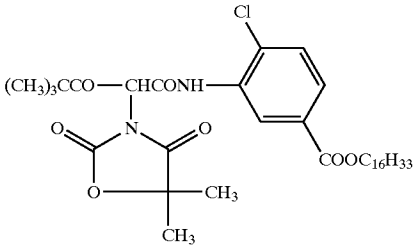
M-1
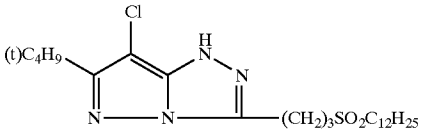
M-2
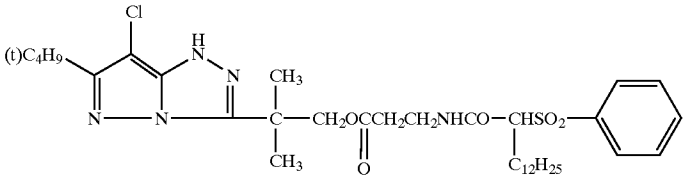

-continued
C-1
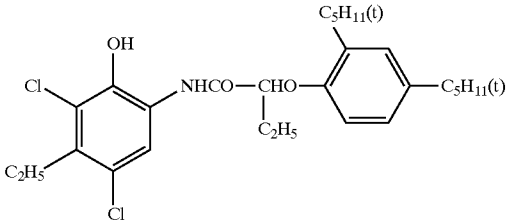
C-2
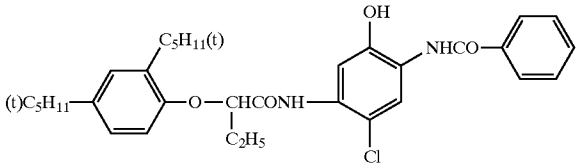
ST-1
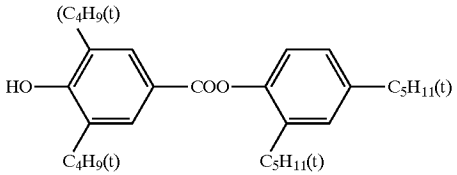
ST-2
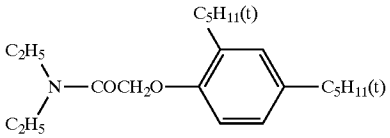
ST-3
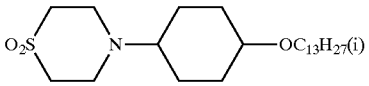
ST-4
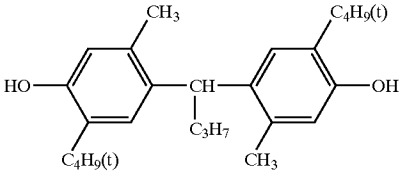
ST-5
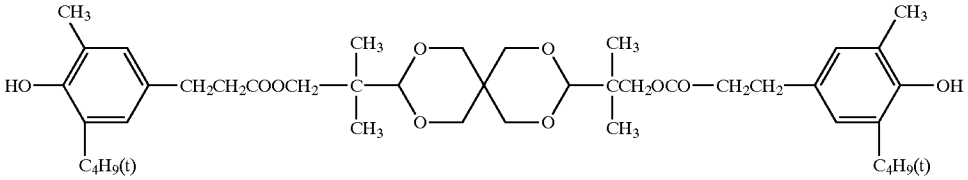

-continued
Al-1
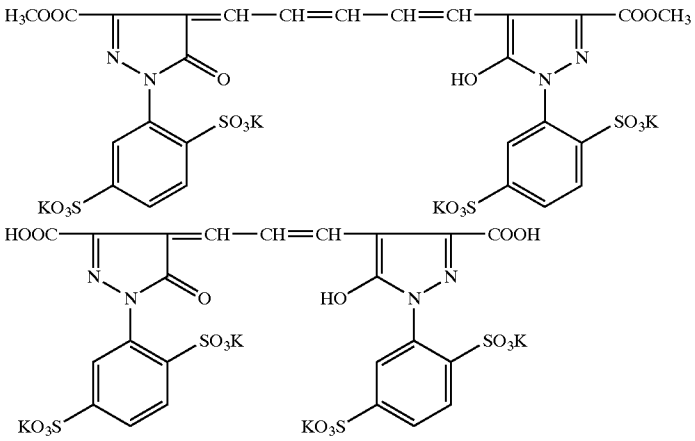
Al-3
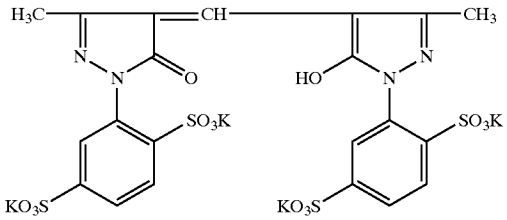
F-1
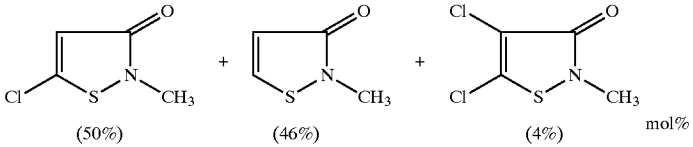
Mixture (molar ratio 50:46:4)
UV-1
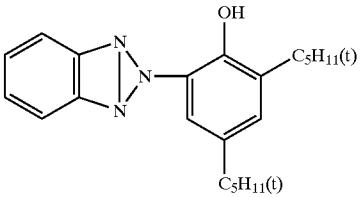
UV-2
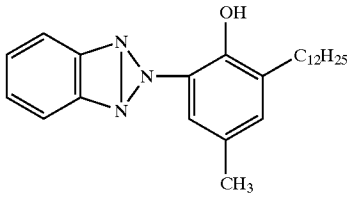

Preparation of Samples 102 to 117

Samples 102 to 117 were prepared similarly to Sample 101, except that blue-sensitive silver halide emulsion (B-1a), green-sensitive silver halide emulsion (G-1a) and red-sensitive silver halide emulsion (R-1a) were respectively replace by silver halide emulsions shown in Table 1.

TABLE 1

| Sample | Silver Halide Emulsion | | | |
|---|---|---|---|---|
| No. | 1st Layer | 3rd Layer | 5th Layer | Remark |
| 101 | B-1a | G-1a | R-1a | Comp. |
| 102 | B-1b | G-1b | R-1b | Comp. |
| 103 | B-1c | G-1c | R-1c | Comp. |
| 104 | B-1d | G-1d | R-1d | Inv. |
| 105 | B-1e | G-1e | R-1e | Inv. |
| 106 | B-2a | G-2a | R-2a | Inv. |
| 107 | B-3a | G-3a | R-3a | Inv. |
| 108 | B-3b | G-3b | R-3b | Inv. |
| 109 | B-3c | G-3c | R-3c | Inv. |
| 110 | B-4a | G-4a | R-4a | Inv. |
| 111 | B-5a | G-5a | R-5a | Inv. |
| 112 | B-6a | G-6a | R-6a | Inv. |
| 113 | B-7a | G-7a | R-7a | Inv. |
| 114 | B-7b | G-7b | R-7b | Inv. |
| 115 | B-7c | G-7c | R-7c | Inv. |
| 116 | B-7d | G-7d | R-7d | Inv. |
| 117 | B-7e | G-7e | R-7e | Inv. |

Evaluation of Photographic Material

The thus prepared samples 101 to 117 were each evaluated with respect to sensitivity, contrast (γ), storage stability and pressure resistance in accordance with the following procedure.

Evaluation of Sensitivity and Fog at High Intensity Exposure

Samples were each exposed through an optical wedge to a xenon flash at $10^{-6}$ sec. using a sensitometer for use in high intensity exposure (available from YAMASHITA DENSO Co., Ltd., SX-20 Type). After being allowed to stand for 5 min., exposed samples were processed according to the following color process. The processed samples were each subjected to densitometry using an optical densitometer (PDA-65 Type, available from Konica Corp.), with respect to yellow reflection image density. Characteristic curves for yellow images, comprising an ordinate (reflection density, D) and an abscissa (exposure, LogE) were prepared and the respective characteristic values were each evaluated as follows.

Sensitivity (or denoted as S) of each sample was determined according to the equation (1) described below. Sensitivity was represented by a relative value, based on the sensitivity of sample 101 being 100. The minimum density value in the respective characteristic curves was represented as a fog density (or denoted simply as fog) by a relative value, based on the fog density of sample 101 being 100.

$$\text{Sensitivity } (S)=1/(\text{exposure amount giving a density of fog plus } 1.0) \quad (1)$$

Evaluation of Contrast (γ)

Contrast (γ) was calculated according to the following equation (2) and represented by a relative value, based on the contrast (g) of sample 101 being 100:

$$\text{Contrast } (\gamma)=1/[\log(\text{exposure amount giving a density of fog plus } 0.8)-\text{Log}(\text{exposure amount giving a density of fog plus } 1.8)] \quad (2)$$

Evaluation Storage Stability

After being aged over a period of 6 days at 55° C. and 40% RH, samples were processed similarly to the foregoing and a fog density of the respective aged sample was represented as a measure of storage stability by a relative value, based on the fog density of fresh sample 101 immediately after sample preparation being 100.

Evaluation of Pressure Resistance

Samples were each exposed to blue light through a blue filter and an optical wedge using xenon flash at $10^{-6}$ sec. in a sensitometer for use in high intensity exposure (available from YAMASHITA DENSO Co., Ltd., SX-20 Type). Exposed samples were immersed in 38° C. water for 45 sec., followed by being pressed according to the following procedure. Thus, samples were each fixed on a horizontal board and a needle under a load was moved at a constant speed in the direction vertical to the wedge step used in exposure to apply pressure onto the sample surface, in which a sapphire needle having a contact section with the sample of 0.3 mm was used and the needle was moved at a scanning speed of 1 cm/sec, while the applied load was successively varied from 10 g to 100 g. Then, samples were processed according to the processing steps described below.

The thus processed samples were visually evaluated with respect to pressure resistance from the viewpoint of the relationship between density variation due to pressure in unexposed and exposed areas and the load. Evaluation was made based on grades "A" through "E" with the most superior sample exhibiting no density change due to pressure was designated as A and a sample, which produced a density change due to pressure even at a relatively low load and resulted in the most inferior pressure resistance, was designated as E. Levels between A to E were equally divided, designated as B, C and D.

Color Process

| Processing step | Temperature | Time | Repl. Amt.* |
|---|---|---|---|
| Color developing | 38.0 ± 0.3° C. | 45 sec. | 80 ml |
| Bleach-fixing | 35.0 ± 0.5° C. | 45 sec. | 120 ml |
| Stabilizing | 30–34° C. | 60 sec. | 150 ml |
| Drying | 60–80° C. | 30 sec. | |

*: Replenishing amount

Color Developer (Tank Solution, Replenisher)

| | Tank soln. | Replenisher |
|---|---|---|
| Water | 800 ml | 800 ml |
| Triethylenediamine | 2 g | 3 g |
| Diethylene glycol | 10 g | 10 g |
| Potassium bromide | 0.01 g | — |
| Potassium chloride | 3.5 g | — |
| Potassium sulfite | 0.25 g | 0.5 g |
| N-ethyl-N(β-methanesulfonamidoethyl)-3-methyl-4-aminoaniline sulfate | 6.0 g | 10.0 g |
| N,N-diethylhydroxyamine | 6.8 g | 6.0 g |
| Triethanolamine | 10.0 g | 10.0 g |
| Sodium diethyltriaminepentaacetate | 2.0 g | 2.0 g |
| Brightener (4,4'-diaminostilbene-disulfonate derivative) | 2.0 g | 2.5 g |
| Potassium carbonate | 30 g | 30 g |

Water is added to make 1 liter, and the pH of the tank solution and replenisher were respectively adjusted to 10.10 and 10.60 with sulfuric acid or potassium hydroxide.

Bleach-fixer (Tank Solution, Replenisher)

| | |
|---|---|
| Ammonium ferric diethyltriaminepenta-acetate dihydrate | 65 g |
| diethyltriaminepentaacetic acid | 3 g |
| Ammonium thiosulfate (70% aqueous solution) | 100 ml |
| 2-Amino-5-mercapto-1,3,4-thiadiazole | 2.0 g |
| Ammonium sulfite (40% aqueous solution) | 27.5 ml |

Water is added to make 1 liter, and the pH is adjusted to 5.0.

Stabilizer (Tank Solution, Replenisher)

| | |
|---|---|
| o-Phenylphenol | 1.0 g |
| 5-Chloro-2-methyl-4-isothiazoline-3-one | 0.02 g |
| 2-Methyl-4-isothiazoline-3-one | 0.02 g |
| Diethylene glycol | 1.0 g |
| Brightener (Chinopal SFP) | 2.0 g |
| 1-Hydroxyethylidene-1,1-diphosphonic acid | 1.8 g |
| Bismuth chloride (40% aqueous solution) | 0.65 g |
| Magnesium sulfate heptahydrate | 0.2 g |
| Polyvinyl pyrrolidine (PVP) | 1.0 g |
| Ammonia water (25% aqueous ammonium hydroxide solution) | 2.5 g |
| Trisodium nitrilotriacetate | 1.5 g |

Water is added to make 1 liter, and the pH is adjusted to 7.5 with sulfuric acid or potassium hydroxide.

The thus obtained results are shown in Table 2.

TABLE 2

| Sample No. | S | Fog | γ | Storage Stability | Pressure Resistance | Remark |
|---|---|---|---|---|---|---|
| 101 | 100 | 100 | 100 | 143 | E | Comp. |
| 102 | 108 | 95 | 107 | 130 | D | Comp. |
| 103 | 106 | 93 | 106 | 128 | E | Comp. |
| 104 | 118 | 92 | 111 | 114 | C | Inv. |
| 105 | 120 | 85 | 112 | 105 | C | Inv. |
| 106 | 123 | 84 | 124 | 103 | C | Inv. |
| 107 | 125 | 74 | 125 | 91 | B | Inv. |
| 108 | 123 | 77 | 124 | 96 | B | Inv. |
| 109 | 126 | 72 | 125 | 87 | B | Inv. |
| 110 | 130 | 73 | 128 | 85 | B | Inv. |
| 111 | 130 | 74 | 133 | 84 | A | Inv. |
| 112 | 138 | 73 | 133 | 79 | A | Inv. |
| 113 | 148 | 72 | 136 | 79 | B | Inv. |
| 114 | 144 | 70 | 143 | 75 | A | Inv. |
| 115 | 143 | 69 | 142 | 76 | A | Inv. |
| 116 | 142 | 72 | 142 | 77 | A | Inv. |
| 117 | 144 | 71 | 143 | 77 | A | Inv. |

As is apparent from Table 2, it was proved that samples using the silver halide emulsion relating to this invention resulted in enhanced sensitivity, minimized fogging and higher contrast (γ) when exposed at a high intensity and improved storage stability and pressure resistance, as compared to comparative samples. Further, green-sensitive and red-sensitive silver halide emulsions were similarly evaluated and it was also proved that similarly to the blue-sensitive emulsions, samples using silver halide emulsions relating to this invention led to superior results.

Example 2

Using photographic materials prepared in Example 1, 127 mm wide roll form samples were prepared and evaluated with respect to suitability for digital exposure.

Thus, negative images of processed negative film (Konica Color New CENTURIA 400) were digitized using a film scanner, Q scan 1202JW (available from Konica Corp.) so as to be treatable using computer software, photoshop (Ver. 5.5, available from Adobe Co.). Further to the thus treated images, letters of various sizes and fine lines were added to form image data and operated so as to perform exposure using the following digital scanning exposure apparatus.

As light sources were used a 473 nm laser which was obtained by subjecting YAG solid laser (oscillation wavelength: 946 nm) using semiconductor laser GaAlAs (oscillation wavelength: 808.5 nm) as an exciting light to wavelength conversion by a SHG crystal of $KnbO_3$; a 532 nm laser which was obtained by subjecting $YVO_4$ solid laser (oscillation wavelength: 1064 nm) using semiconductor laser GaAlAs (oscillation wavelength: 808.7 nm) as an exciting light to wavelength conversion by a SHG crystal of KTP; and AlGaInP laser (oscillation wavelength: 670 nm). There was prepared an apparatus, in which three color laser lights were each moved in the direction vertical to the scanning direction, using a polygon mirror so that scanning exposure was successively performed onto color print paper. The exposure amount was controlled by electrical adjustment of the light quantity of the semiconductor lasers. Scanning exposure was conducted at 400 dpi (dpi represents the number of dots per inch or 2.54 cm) and the exposure time per picture element (or pixel) was $5\times10^{-8}$ sec. The exposure amount was adjusted so that the best print images were obtained in the respective samples. After performing scanning exposure, cabinet-size print images were obtained in accordance with the following process.

Color Process

| Processing step | Temperature | Time | Repl. Amt.* |
|---|---|---|---|
| Color developing | 38.0 ± 0.3° C. | 22 sec. | 81 ml |
| Bleach-fixing | 35.0 ± 0.5° C. | 22 sec. | 54 ml |
| Stabilizing | 30–34° C. | 25 sec. | 150 ml |
| Drying | 60–80° C. | 30 sec. | |

*: Replenishing amount

Color Developer (Tank Solution, Replenisher)

| | Tank soln. | Replenisher |
|---|---|---|
| Water | 800 ml | 800 ml |
| Diethylene glycol | 10 g | 10 g |
| Potassium bromide | 0.01 g | — |
| Potassium chloride | 3.5 g | — |
| Potassium sulfite | 0.25 g | 0.5 g |
| N-ethyl-N(β-methanesulfonamidoethyl)-3-methyl-4-aminoaniline sulfate | 6.0 g | 10.5 g |
| N,N-diethylhydroxyamine | 3.5 g | 6.0 g |
| N,N-bis(2-sulfoethyl)hydroxylamine | 3.5 g | 6.0 g |
| Triethanolamine | 10.0 g | 10.0 g |
| Sodium diethyltriaminepentaacetate | 2.0 g | 2.0 g |
| Brightener (4,4'-diaminostilbene-disulfonate derivative) | 2.0 g | 2.5 g |
| Potassium carbonate | 30 g | 30 g |

Water is added to make 1 liter, and the pH of the tank solution and replenisher were respectively adjusted to 10.1 and 10.6 with sulfuric acid or potassium hydroxide.

Bleach-fixer (Tank Solution, Replenisher)

| | Tank soln. | Replenisher |
|---|---|---|
| Ammonium ferric diethyltriaminepenta-acetate dihydrate | 100 g | 50 g |
| diethyltriaminepentaacetic acid | 3 g | 3 g |
| Ammonium thiosulfate (70% aqueous solution) | 200 ml | 100 ml |
| 2-Amino-5-mercapto-1,3,4-thiadiazole | 2.0 g | 1.0 g |
| Ammonium sulfite (40% aqueous solution) | 50 ml | 25 ml |

Water is added to make 1 liter, and the pH is adjusted to 7.0 with potassium carbonate or glacial acetic acid.

Stabilizer (Tank Solution, Replenisher)

| | |
|---|---|
| o-Phenylphenol | 1.0 g |
| 5-Chloro-2-methyl-4-isothiazoline-3-one | 0.02 g |
| 2-Methyl-4-isothiazoline-3-one | 0.02 g |
| Diethylene glycol | 1.0 g |
| Brightener (Chinopal SFP) | 2.0 g |
| 1-Hydroxyethylidene-1,1-diphosphonic acid | 1.8 g |
| PVP | 1.0 g |
| Ammonia water (25% aqueous ammonium hydroxide solution) | 2.5 g |
| Ethylenediaminetetraacetic acid | 1.0 g |
| Ammonium sulfite (40% aqueous solution) | 10 ml |

Water is added to make 1 liter, and the pH is adjusted to 7.5 with sulfuric acid or potassium hydroxide.

The thus obtained print images were visually evaluated by 20 observers with respect to clearness of fine lines and letters, human skin tone reproduction and color reproduction of green foliage. Further, 100 sheets were exposed for each sample and successively processed. The first and 100th prints were evaluated with respect to print reproducibility, based on the following criteria.

(1) Clearness of fine line and letter

A: neutral fine lines and letters were clearly distinguishable

B: neutral fine lines and letters were clearly distinguishable but outlines becoming slightly blurred C: neutral fine lines and letters were clearly distinguishable but blurred D: neutral fine lines and letters were blurred and undistinguishable.

(2) Human skin tone reproduction

A: bright and natural reproduction;

B: natural reproduction;

C: being slightly muted;

D: being muted.

(3) Color reproduction of green foliage

A: bright and clear reproduction

B: clear reproduction

C: slightly muted reproduction;

D: definitely muted reproduction (4) Print reproducibility

A: no difference in prints ere noticed;

B: slight difference in prints were noticed but treated as the same;

C: some differences in prints were noticed and weighed;

D: clear differences in prints were noticed and unacceptable in practice

Evaluation results are shown in Table 3. As is apparent from Table 3, it was proved that samples relating to this invention exhibited superior performance with respect to clearness of fine lines and letters, human skin tone reproduction, color reproduction of green foliage and print reproducibility.

TABLE 3

| Sample No. | Clearness of Fine Line and Letter | Skin Tone Reproduction | Reproduction of Leaves Green | Print reproducibility | Remark |
|---|---|---|---|---|---|
| 101 | D | D | D | D | Comp. |
| 102 | C | D | D | C | Comp. |
| 103 | C | D | D | C | Comp. |
| 104 | B | B | B | B | Inv. |
| 105 | B | B | B | B | Inv. |
| 106 | B | B | B | B | Inv. |
| 107 | B | A | A | A | Inv. |
| 108 | B | A | A | A | Inv. |
| 109 | B | A | A | A | Inv. |
| 110 | B | A | A | A | Inv. |
| 111 | A | A | A | A | Inv. |
| 112 | A | A | A | A | Inv. |
| 113 | A | A | A | A | Inv. |
| 114 | A | A | A | A | Inv. |
| 115 | A | A | A | A | Inv. |
| 116 | A | A | A | A | Inv. |
| 117 | A | A | A | A | Inv. |

Example 3

From negative images of processed negative film (Konica Color New CENTURIA 400), positive images of processed reversal film (Konica Chrome SINBI 1200 High Quality) and photographing image data taken by a digital camera Digital Revio KD-200Z (available from Konica Corp.), print images were obtained in accordance with the following procedure.

There were prepared roll form samples of 127 mm width, using photographic materials prepared in Example 1. The samples were exposed and processed in Konica digital minilab system QD-21 SUPER (in which print processor QDP-1500 SUPER and processing chemicals ECOJET-HQA-P were employed and processing is conducted in accordance with process CPK-HQA-P). The obtained print samples were evaluated similarly to Example 2. Results thereof are shown in Table 4. Similarly to Example 2, it was proved that samples relating to this invention achieved superior effects.

TABLE 4

| Sample No. | Clearness of Fine Line and Letter | Skin Tone Reproduction | Reproduction of Leaves Green | Print reproducibility | Remark |
|---|---|---|---|---|---|
| 101 | D | D | D | D | Comp. |
| 102 | C | D | D | C | Comp. |
| 103 | C | D | D | C | Comp. |
| 104 | B | B | B | B | Inv. |
| 105 | B | A | B | B | Inv. |
| 106 | A | A | B | B | Inv. |
| 107 | A | A | A | A | Inv. |
| 108 | A | A | A | A | Inv. |
| 109 | A | A | A | A | Inv. |
| 110 | A | A | A | A | Inv. |
| 111 | A | A | A | A | Inv. |
| 112 | A | A | A | A | Inv. |
| 113 | A | A | A | A | Inv. |
| 114 | A | A | A | A | Inv. |
| 115 | A | A | A | A | Inv. |

TABLE 4-continued

| Sample No. | Clearness of Fine Line and Letter | Skin Tone Reproduction | Reproduction of Leaves Green | Print reproducibility | Remark |
|---|---|---|---|---|---|
| 116 | A | A | A | A | Inv. |
| 117 | A | A | A | A | Inv. |

Example 4

Preparation of Blue-sensitive Silver Halide Emulsion (B-1g)

To silver halide emulsion (B-1) prepared in Example 1, sensitizing dyes (Bs-1) and (BS-2) were added at 60° C., a pH of 5.8 and a pAg of 7.5 and subsequently, sodium thiosulfate and chloroauric acid were successively added to perform spectral sensitization and chemical sensitization. Following the addition of chemical sensitizers and when optimally ripened, compounds (S-2-5), (S-2-2) and (S-2-3) were successively added to stop ripening. A blue-sensitive silver halide emulsion (B-1g) was thus obtained.

| | |
|---|---|
| Sodium thiosulfate | $5.0 \times 10^{-6}$ mol/mol AgX |
| Chloroauric acid | $1.5 \times 10^{-5}$ mol/mol AgX |
| Compound S-2-5 | $3 \times 10^{-4}$ mol/mol AgX |
| Compound S-2-2 | $3 \times 10^{-4}$ mol/mol AgX |
| Compound S-2-3 | $2 \times 10^{-4}$ mol/mol AgX |
| Sensitizing dye BS-1 | $4 \times 10^{-4}$ mol/mol AgX |
| Sensitizing dye BS-2 | $1 \times 10^{-4}$ mol/mol AgX |

Preparation of Blue-sensitive Silver Halide Emulsion (B-1h)

A blue-sensitive silver halide emulsion (B-1h) was prepared similarly to the foregoing green-sensitive silver halide emulsion (B-1g), except that compound (4-6) was added in an amount of $1.1\times10^{-4}$ mol/mol.AgX at the completion of 70% of the chemical sensitization time from the addition of sodium thiosulfate to the addition of compound (S-2-5).

Preparation of Blue-sensitive Silver Halide Emulsion (B-1i)

Blue-sensitive silver halide emulsion (B-1h) was prepared similarly to the foregoing blue-sensitive silver halide emulsion (B-1g), except that immediately before sensitizing dyes (BS-1) and (BS-2), compound (4-0) was added in an amount of $3.0\times10^{-6}$ mol/mol AgX.

Preparation of Blue-sensitive Silver Halide Emulsion (B-1j)

Blue-sensitive silver halide emulsion (B-1j) was prepared similarly to the foregoing blue-sensitive silver halide emulsion (B-1g), except that immediately before sensitizing dyes (BS-1) and (BS-2), compound (4-0) was added in an amount of $2.0\times10^{-6}$ mol/mol AgX and compound (4-0) was added in an amount of $3.0\times10^{-6}$ mol/mol AgX at the completion of 70% of the chemical sensitization time of from addition of sodium thiosulfate to addition of compound (S-2-5).

Preparation of Blue-sensitive Silver Halide Emulsion (B-1k)

Blue-sensitive silver halide emulsion (B-1k) was prepared similarly to the foregoing blue-sensitive silver halide emulsion (B-1g), except that immediately before sensitizing dyes (BS-1) and (BS-2), compound (4-0) was added in an amount of $2.0\times10^{-6}$ mol/mol AgX and compound (4-0) was added in an amount of $3.0\times10^{-6}$ mol/mol AgX at the completion of 90% of the chemical sensitization time of from addition of sodium thiosulfate to addition of compound (S-2-5).

Preparation of Blue-sensitive Silver Halide Emulsion (B-2g)

To silver halide emulsion (B-2) prepared in Example 1, sensitizing dyes (Bs-1) and (BS-2) were added at 60° C., a pH of 5.8 and a pAg of 7.5. Subsequently, sodium thiosulfate and chloroauric acid were successively added, as shown below, to perform spectral sensitization and chemical sensitization. Following the addition of chemical sensitizers and when optimally ripened, compound compounds (S-2-5), (S-2-2) and (S-2-3) were successively added to stop ripening. In the course of ripening, the compound (4-0) was further added in an amount of $2.0\times10^{-6}$ mol/mol.AgX at the completion of 90% of the chemical sensitization time of from addition of sodium thiosulfate to addition of compound (S-2-5). According to the foregoing procedure was obtained a blue-sensitive silver halide emulsion (B-2g).

| | |
|---|---|
| Sodium thiosulfate | $5.0 \times 10^{-6}$ mol/mol AgX |
| Chloroauric acid | $1.5 \times 10^{-5}$ mol/mol AgX |
| Compound S-2-5 | $2 \times 10^{-4}$ mol/mol AgX |
| Compound S-2-2 | $3 \times 10^{-4}$ mol/mol AgX |
| Compound S-2-3 | $2 \times 10^{-4}$ mol/mol AgX |
| Sensitizing dye BS-1 | $4 \times 10^{-4}$ mol/mol AgX |
| Sensitizing dye BS-2 | $1 \times 10^{-4}$ mol/mol AgX |

Preparation of Blue-sensitive Silver Halide Emulsion (B-3g)

To silver halide-emulsion (B-3) prepared in Example 1, sensitizing dyes (Bs-1) and (BS-2) were added at 60° C., a pH of 5.8 and a pAg of 7.5 and subsequently, sodium thiosulfate and chloroauric acid were successively added, as shown below, to perform spectral sensitization and chemical sensitization. Following the addition of chemical sensitizers and when optimally ripened, compound compounds (S-2-5), (S-2-2) and (S-2-3) were successively added to stop ripening. In the course of ripening, the compound (4-0) was further added in an amount of $2.0\times10^{-6}$ mol/mol.AgX at the completion of 90% of the chemical sensitization time of from addition of sodium thiosulfate to addition of compound (S-2-5). According to the foregoing procedure was obtained a blue-sensitive silver halide emulsion (B-3g).

| | |
|---|---|
| Sodium thiosulfate | $5.0 \times 10^{-6}$ mol/mol AgX |
| Chloroauric acid | $1.5 \times 10^{-5}$ mol/mol AgX |
| Compound S-2-5 | $2 \times 10^{-4}$ mol/mol AgX |
| Compound S-2-2 | $3 \times 10^{-4}$ mol/mol AgX |
| Compound S-2-3 | $2 \times 10^{-4}$ mol/mol AgX |
| Sensitizing dye BS-1 | $4 \times 10^{-4}$ mol/mol AgX |
| Sensitizing dye BS-2 | $1 \times 10^{-4}$ mol/mol AgX |

Preparation of Blue-sensitive Silver Halide Emulsion (B-3h)

A blue-sensitive silver halide emulsion (B-3h) was prepared similarly to the foregoing blue-sensitive silver halide emulsion (B-3a), except that the addition of the compound (1-21) at the completion of 90% of the chemical sensitization time of from addition of sodium thiosulfate to addition of compound (S-2-5) was canceled and $2.0\times10^{-4}$ mol/mol.AgX of the compound (4-0) was added after the addition of compounds (S-2-5), (S-2-2) and (S-2-3).

Preparation of Blue-sensitive Silver Halide Emulsion (B-3i)

A blue-sensitive silver halide emulsion (B-3i) was prepared similarly to the blue-sensitive silver halide emulsion (B-3g), except that the addition of sensitizing dyes (BS-1) and (BS-2) before the addition of sodium thiosulfate and chloroauric acid was canceled and sensitizing dyes (BS-1) and (BS-2) were added after the addition of compounds (S-2-5), (S-2-2) and (S-2-3).

Preparation of Blue-sensitive Silver Halide Emulsion (B-4g), (B-5g), (B-6g) and (B-7g)

Similarly to the blue-sensitive silver halide emulsion (B-3g), blue-sensitive silver halide emulsions (B-4g), (B-5g), (B-6g) and (B-7g) were prepared using silver halide emulsions (B-4), (B-5), (B-6) and (B-7), respectively.

Preparation of Blue-sensitive Silver Halide Emulsion (B-7h)

A blue-sensitive silver halide emulsion (B-7h) was prepared similarly to the foregoing blue-sensitive silver halide emulsion (B-7g), except that the compound (4-0) was replaced by compound (9-2).

Preparation of Blue-sensitive Silver Halide Emulsion (B-7i)

A blue-sensitive silver halide emulsion (B-7i) was prepared similarly to the blue-sensitive silver halide emulsion (B-7g), except that the first addition of compound (4-0) was changed from $2.0\times10^{-6}$ mol/mol.AgX to $3\times10^{-6}$ mol/mol.AgX and the second addition of compound (4-0) was changed from $2.0\times10^{-6}$ mol/mol.AgX to $1.0\times10^{-6}$ mol/mol.AgX.

Preparation of Blue-sensitive Silver Halide Emulsion (B-7j)

A blue-sensitive silver halide emulsion (B-7j) was prepared similarly to the blue-sensitive silver halide emulsion (B-7g), except that the first addition of the compound (4-0) was replaced by that of compound (9-2).

Preparation of Blue-sensitive Silver Halide Emulsion (B-7k)

A blue-sensitive silver halide emulsion (B-7k) was prepared similarly to the blue-sensitive silver halide emulsion (B-7g), except that the first addition of the compound (4-0) was replaced by that of compound (9-2), the second addition of compound (4-0) was changed to $1.0\times10^{-6}$ mol/mol.AgX and $1.5\times10^{-6}$ mol/mol.AgX of compound (4-0) was further added at the completion of 95% of the chemical sensitization time of from addition of sodium thiosulfate to addition of compound (S-2-5).

Preparation of Green-sensitive Silver Halide Emulsion (G-1g)

To the silver halide emulsion (G-1) of Example 1, sensitizing dyes (GS-1) was added at 60° C., a pH of 5.8 and a pAg of 7.5 and subsequently, sodium thiosulfate and chloroauric acid were successively added to perform spectral sensitization and chemical sensitization. Following addition of the chemical sensitizers and when optimally ripened, compound (S-2-5) was added to stop ripening. A green-sensitive silver halide emulsion (G-1g) was thus obtained.

| | |
|---|---|
| Sensitizing dye (GS-1) | $4.0\times10^{-4}$ mol/mol AgX |
| Sodium thiosulfate | $4.5\times10^{-6}$ mol/mol AgX |
| Chloroauric acid | $1.5\times10^{-5}$ mol/mol AgX |
| Compound S-2-5 | $2.0\times10^{-4}$ mol/mol AgX |

Preparation of Green-sensitive Silver Halide Emulsion (G-1h)

A green-sensitive-silver halide emulsion (G-1h) was prepared similarly to the foregoing green-sensitive silver halide emulsion (G-1g), except that compound (4-6) was added in an amount of $1.5\times10^{-4}$ mol/mol.AgX at the completion of 70% of the chemical sensitization time from the addition of sodium thiosulfate to the addition of compound (S-2-5).

Preparation of Green-sensitive Silver Halide Emulsion (G-1i)

A green-sensitive silver halide emulsion (G-1i) was prepared similarly to the green-sensitive silver halide emulsion (G-1g), except that immediately before adding sensitizing dye (GS-1), compound (4-0) was added in an amount of $3.0\times10^{-6}$ mol/mol.AgX.

Preparation of Green-sensitive Silver Halide Emulsion (G-1j)

A green-sensitive silver halide emulsion (G-1j) was prepared similarly to the green-sensitive silver halide emulsion (G-1g), except that immediately before adding sensitizing dye (GS-1), compound (4-0) was added in an amount of $3.0\times10^{-6}$ mol/mol.AgX and the compound (4-0) was further added in an amount of $2.0\times10^{-6}$ mol/mol.AgX at the completion of 70% of the chemical sensitization time of from addition of sodium thiosulfate to addition of compound (S-2-5).

Preparation of Green-sensitive Silver Halide Emulsion (G-1k)

A green-sensitive silver halide emulsion (G-1k) was prepared similarly to the green-sensitive silver halide emulsion (G-1g), except that immediately before adding sensitizing dye (GS-1), compound (4-0) was added in an amount of $3.0\times10^{-6}$ mol/mol.AgX and the compound (4-0) was further added in an amount of $2.0\times10^{-6}$ mol/mol.AgX at the completion of 90% of the chemical sensitization time of from addition of sodium thiosulfate to addition of compound (S-2-5).

Preparation of Green-sensitive Silver Halide Emulsion (G-2g)

To the foregoing silver halide emulsion (G-2) of Example 1, $3.0\times10^{-6}$ mol/mol.AgX of compound (4-0) was added at 60° C., a pH of 5.8 and a pAg of 7.5, and immediately thereafter, sensitizing dye (GS-1) was added. Subsequently, sodium thiosulfate and chloroauric acid were added to perform spectral sensitization and chemical sensitization. Following addition of chemical sensitizers and when optimally ripened, compounds (S-2-5) was added to stop ripening. In the course of ripening, the compound (4-0) was further added in an amount of $2.0\times10^{-6}$ mol/mol.AgX at the completion of 90% of the chemical sensitization time of from addition of sodium thiosulfate to addition of compound (S-2-5). According to the foregoing procedure was obtained a green-sensitive silver halide emulsion (G-2g).

| | |
|---|---|
| Sensitizing dye GS-1 | $4.0\times10^{-4}$ mol/mol AgX |
| Sodium thiosulfate | $4.5\times10^{-6}$ mol/mol AgX |
| Chloroauric acid | $1.5\times10^{-5}$ mol/mol AgX |
| Compound S-2-5 | $2.0\times10^{-4}$ mol/mol AgX |

Preparation of Green-sensitive Silver Halide Emulsion (G-3g)

To the foregoing silver halide emulsion (G-3) of Example 1, $3.0\times10^{-6}$ mol/mol.AgX of compound (4-0) was added at 60° C., a pH of 5.8 and a pAg of 7.5, and sensitizing dye (GS-1) was immediately added. Subsequently, sodium thiosulfate and chloroauric acid were added to perform spectral sensitization and chemical sensitization. Following addition of chemical sensitizers and when optimally ripened, compound (S-2-5) was added to stop ripening. In the course of ripening, the compound (4-0) was further added in an amount of $2.0\times10^{-6}$ mol/mol.AgX at the completion of 90% of the chemical sensitization time of from addition of sodium thiosulfate to addition of compound (S-2-5). According to the foregoing procedure was obtained a green-sensitive silver halide emulsion (G-3g).

| | |
|---|---|
| Sensitizing dye GS-1 | $4.0\times10^{-4}$ mol/mol AgX |
| Sodium thiosulfate | $4.5\times10^{-6}$ mol/mol AgX |
| Chloroauric acid | $1.5\times10^{-5}$ mol/mol AgX |
| Compound S-2-5 | $2.5\times10^{-4}$ mol/mol AgX |

Preparation of Green-sensitive Silver Halide Emulsion (G-3h)

A green-sensitive silver halide emulsion (G-3h) was prepared similarly to the foregoing green-sensitive silver halide emulsion (G-3g), except that the addition of the compound (4-0) at the completion of 90% of the chemical sensitization time of from addition of sodium thiosulfate to addition of compound (S-2-5) was canceled and $2.0\times10^{-6}$ mol/mol.AgX of the compound (4-0) was added after the addition of compound (S-2-5).

Preparation of Green-sensitive Silver Halide Emulsion (G-3i)

A green-sensitive silver halide emulsion (B-3i) was prepared similarly to the green-sensitive silver halide emulsion (G-3g), except that the addition of sensitizing dye (GS-1) before the addition of sodium thiosulfate and chloroauric acid was canceled and sensitizing dye (GS-1) was added after the addition of compounds (S-2-5).

Preparation of Green-sensitive Silver Halide Emulsion (G-4g), (G-5g), (G-6g) and (G-7g)

Similarly to the green-sensitive silver halide emulsion (G-3g), green-sensitive silver halide emulsions (G-4g), (G-5g), (G-6g) and (G-7g) were prepared using silver halide emulsions (G-4), (G-5), (G-6) and (G-7), respectively.

Preparation of Green-sensitive Silver Halide Emulsion (G-7h)

A green-sensitive silver halide emulsion (G-7h) was prepared similarly to the foregoing green-sensitive silver halide emulsion (G-7g), except that the compound (4-0) was replaced by compound (9-2).

Preparation of Green-sensitive Silver Halide Emulsion (G-7i)

A green-sensitive silver halide emulsion (G-7i) was prepared similarly to the green-sensitive silver halide emulsion (G-7g), except that the first addition of compound (4-0) was changed from $3.0\times10^{-6}$ mol/mol.AgX to $4.0\times10^{-6}$ mol/mol.AgX and the second addition of compound (4-0) was changed from $2.0\times10^{-6}$ mol/mol.AgX to $1.5\times10^{-6}$ mol/mol.AgX.

Preparation of Green-sensitive Silver Halide Emulsion (G-7j)

A green-sensitive silver halide emulsion (G-7j) was prepared similarly to the green-sensitive silver halide emulsion (G-7g), except that the first addition of the compound (4-0) was replaced by that of compound (9-2).

Preparation of Green-sensitive Silver Halide Emulsion (G-7k)

A green-sensitive silver halide emulsion (G-7k) was prepared similarly to the green-sensitive silver halide emulsion (G-7g), except that the first addition of the compound (4-0) was replaced by that of compound (9-2), the second addition of compound (4-0) was changed to $1.0\times10^{-6}$ mol/mol.AgX and $2.0\times10^{-6}$ mol/mol.AgX of compound (4-6) was further added at the completion of 95% of the chemical sensitization time of from addition of sodium thiosulfate to addition of compound (S-2-5).

Preparation of Red-sensitive Silver Halide Emulsion (R-1g)

To the foregoing silver halide emulsion (R-1) of Example 1, sensitizing dyes (RS-1) and (RS-2) were added at 60° C., a pH of 5.0 and a pAg of 7.1, and subsequently, sodium thiosulfate and chloroauric acid were added to perform spectral sensitization and chemical sensitization. Following the addition of chemical sensitizers and when optimally ripened, compound (S-2-5) was added to stop ripening. A red-sensitive silver halide emulsion (R-1g) was thus obtained.

| | |
|---|---|
| Sodium thiosulfate | $1.2\times10^{-5}$ mol/mol AgX |
| Chloroauric acid | $1.5\times10^{-5}$ mol/mol AgX |
| Compound S-2-5 | $2.0\times10^{-4}$ mol/mol AgX |
| Sensitizing dye RS-1 | $1.0\times10^{-4}$ mol/mol AgX |
| Sensitizing dye RS-2 | $1.0\times10^{-4}$ mol/mol AgX |

Preparation of Red-sensitive Silver Halide Emulsion (R-1h)

A red-sensitive silver halide emulsion (R-1h) was prepared similarly to the foregoing red-sensitive silver halide emulsion (R-1g), except that compound (4-6) was added in an amount of $2.5\times10^{-4}$ mol/mol.AgX at the completion of 70% of the chemical sensitization time from the addition of sodium thiosulfate to the addition of compound (S-2-5).

Preparation of Re-sensitive Silver Halide Emulsion (R-1i)

A red-sensitive silver halide emulsion (R-1i) was prepared similarly to the red-sensitive silver halide emulsion (R-1g), except that immediately before adding sensitizing dyes (RS-1) and (RS-2), compound (4-0) was added in an amount of $2.0\times10^{-6}$ mol/mol.AgX.

Preparation of Red-sensitive Silver Halide Emulsion, (R-1j)

A red-sensitive silver halide emulsion (R-1j) was prepared similarly to the red-sensitive silver halide emulsion (R-1g), except that immediately before adding sensitizing dyes (RS-1) and (RS-2), compound (4-0) was added in an amount of $2.0\times10^{-6}$ mol/mol.AgX and the compound (4-0) was further added in an amount of $2.0\times10^{-6}$ mol/mol.AgX at the completion of 70% of the chemical sensitization time of from addition of sodium thiosulfate to addition of compound (S-2- 5).

Preparation of Red-sensitive Silver Halide Emulsion (R-1k)

A red-sensitive silver halide emulsion (R-1k) was prepared similarly to the red-sensitive silver halide emulsion (R-1g), except that immediately before adding sensitizing dyes (RS-1) and (RS-2), compound (4-0) was added in an amount of $2.0\times10^{-6}$ mol/mol.AgX and the compound (4-0) was further added in an amount of $2.0\times10^{-6}$ mol/mol.AgX at the completion of 90% of the chemical sensitization time of from addition of sodium thiosulfate to addition of compound (S-2-5).

Preparation of Red-sensitive Silver Halide Emulsion (R-2g)

To the foregoing silver halide emulsion (R-2) of Example 1, $2.0\times10^{6}$ mol/mol.AgX of compound (4-0) was added at 60° C., a pH of 5.0 and a pAg of 7.1, and sensitizing dyes (RS-1) and (RS-2) were added immediately; subsequently, sodium thiosulfate and chloroauric acid were added to perform spectral sensitization and chemical sensitization. Following addition of chemical sensitizers and when optimally ripened, compound. (S-2-5) was added to stop ripening. In the course of ripening, the compound (4-0) was further added in an amount of $2.0\times10^{-6}$ mol/mol.AgX at the completion of 90% of the chemical sensitization time of from addition of sodium thiosulfate to addition of compound (S-2-5). According to the foregoing procedure was obtained a red-sensitive silver halide emulsion (B-2g).

| | |
|---|---|
| Sodium thiosulfate | $1.2\times10^{-5}$ mol/mol AgX |
| Chloroauric acid | $1.5\times10^{-5}$ mol/mol AgX |
| Compound S-2-5 | $2.0\times10^{-4}$ mol/mol AgX |
| Sensitizing dye RS-1 | $1.0\times10^{-4}$ mol/mol AgX |
| Sensitizing dye RS-2 | $1.0\times10^{-4}$ mol/mol AgX |

Preparation of Red-sensitive Silver Halide Emulsion (R-3g)

To the foregoing silver halide emulsion (R-3) of Example 1, $1.0\times10^{-4}$ mol/mol.AgX of compound (4-0) was added at 60° C., a pH of 5.0 and a pAg of 7.1, and sensitizing dyes (RS-1) and (RS-2) were immediately added; subsequently, sodium thiosulfate and chloroauric acid were added to perform spectral sensitization and chemical sensitization. Following addition of chemical sensitizers and when optimally ripened, compound (S-2-5) was added to stop ripening. In the course of ripening, compound (4-0) was further added in an amount of $2.0\times10^{-6}$ mol/mol.AgX at the completion of 90% of the chemical sensitization time of from addition of sodium thiosulfate to addition of compound (S-2-5). According to the foregoing procedure was obtained a red-sensitive silver halide emulsion (B-3g).

| | |
|---|---|
| Sodium thiosulfate | $1.2 \times 10^{-5}$ mol/mol AgX |
| Chloroauric acid | $1.5 \times 10^{-5}$ mol/mol AgX |
| Compound S-2-5 | $2.0 \times 10^{-4}$ mol/mol AgX |
| Sensitizing dye RS-1 | $1.0 \times 10^{-4}$ mol/mol AgX |
| Sensitizing dye RS-2 | $1.0 \times 10^{-4}$ mol/mol AgX |

Preparation of Red-sensitive Silver Halide Emulsion (R-3h)

A red-sensitive silver halide emulsion (R-3h) was prepared similarly to the foregoing red-sensitive silver halide emulsion (R-3g), except that the addition of the compound (4-0) at the completion of 90% of the chemical sensitization time of from addition of sodium thiosulfate to addition of compound (S-2-5) was canceled and $2.0\times10^{-6}$ mol/mol.AgX of the compound (4-0) was added after the addition of compound (S-2-5).

Preparation of Red-sensitive Silver Halide Emulsion (R-3i)

A red-sensitive silver halide emulsion (R-3i) was prepared similarly to the red-sensitive silver halide emulsion (R-3g), except that the addition of sensitizing dyes (RS-1) and (RS-2) before the addition of sodium thiosulfate and chloroauric acid was canceled and sensitizing dyes (RS-1) and (RS-2) were added after the addition of compound (S-2-5).

Preparation of Red-sensitive Silver Halide Emulsion (R-4g), (R-5g), (R-6g) and (R-7g)

Similarly to the red-sensitive silver halide emulsion (R-3g), red-sensitive silver halide emulsions (R-4g), (R-5g), (R-6g) and (R-7g) were prepared using silver halide emulsions (R-4), (R-5), (R-6) and (R-7), respectively.

Preparation of Red-sensitive Silver Halide Emulsion (R-7h)

A red-sensitive silver halide emulsion (R-7h) was prepared similarly to the foregoing red-sensitive silver halide emulsion (R-7g), except that the compound (4-0) was replaced by compound (9-2).

Preparation of Red-sensitive Silver Halide Emulsion (R-7i)

A red-sensitive silver halide emulsion (R-7i) was prepared similarly to the red-sensitive silver halide emulsion (R-7g), except that the first addition of compound (4-0) was changed from $2.0\times10^{-6}$ mol/mol.AgX to $1.5\times10^{-6}$ mol/mol.AgX and the second addition of compound (4-0) was changed from $2.0\times10^{-6}$ mol/mol.AgX to $3.0\times10^{-6}$ mol/mol.AgX.

Preparation of Red-sensitive Silver Halide Emulsion (R-7j)

A red-sensitive silver halide emulsion (R-7j) was prepared similarly to the red-sensitive silver halide emulsion (R-7g), except that the first addition of the compound (4-0) was replaced by that of compound (9-2).

Preparation of Red-sensitive Silver Halide Emulsion (R-7k)

A red-sensitive silver halide emulsion (R-7k) was prepared similarly to the red-sensitive silver halide emulsion (R-7g), except that the first addition of the compound (4-0) was replaced by that of compound (9-2), the second addition of compound (4-0) was changed to $1.0\times10^{-6}$ mol/mol.AgX and $1.5\times10^{-6}$ mol/mol.AgX of compound (4-5) was further added at the completion of 95% of the chemical sensitization time of from addition of sodium thiosulfate to addition of compound (S-2-5).

In the foregoing preparation of red-sensitive silver halide emulsions, $2.0\times10^{-3}$ mol/mol.AgX of SS-1 was added at the completion of the preparation.

Photographic material samples 201 to 217 were prepared similarly to sample 101 of Example 1, except that the blue-sensitive silver halide emulsion (B-1a) used in the 1st layer, the green-sensitive silver halide emulsion (G-1a) used in the 3rd layer and the red-sensitive silver halide emulsion (R-1a) used in the 5th layer were replaced by silver halide emulsions shown in Table 5. The thus prepared samples were evaluated similarly to Example 1 and results thereof are shown in Table 6.

TABLE 5

| Sample | Silver Halide Emulsion | | | |
|---|---|---|---|---|
| No. | 1st Layer | 3rd Layer | 5th Layer | Remark |
| 201 | B-1g | G-1g | R-1g | Comp. |
| 202 | B-1h | G-1h | R-1h | Comp. |
| 203 | B-1i | G-1i | R-1i | Comp. |
| 204 | B-1j | G-1j | R-1j | Inv. |
| 205 | B-1k | G-1k | R-1k | Inv. |
| 206 | B-2g | G-2g | R-2g | Inv. |
| 207 | B-3g | G-3g | R-3g | Inv. |
| 208 | B-3h | G-3h | R-3h | Inv. |
| 209 | B-3i | G-3i | R-3i | Inv. |
| 210 | B-4g | G-4g | R-4g | Inv. |
| 211 | B-5g | G-5g | R-5g | Inv. |
| 212 | B-6g | G-6g | R-6g | Inv. |
| 213 | B-7g | G-7g | R-7g | Inv. |
| 214 | B-7h | G-7h | R-7h | Inv. |
| 215 | B-7i | G-7i | R-7i | Inv. |
| 216 | B-7j | G-7j | R-7j | Inv. |
| 217 | B-7k | G-7k | R-7k | Inv. |

TABLE 6

| Sample No. | S | Fog | γ | Storage Stability | Pressure Resistance | Remark |
|---|---|---|---|---|---|---|
| 201 | 100 | 100 | 100 | 141 | E | Comp. |
| 202 | 107 | 94 | 107 | 128 | D | Comp. |
| 203 | 106 | 93 | 108 | 128 | D | Comp. |
| 204 | 117 | 88 | 113 | 112 | C | Inv. |
| 205 | 120 | 84 | 113 | 105 | C | Inv. |
| 206 | 122 | 82 | 124 | 102 | C | Inv. |
| 207 | 125 | 76 | 126 | 91 | B | Inv. |
| 208 | 124 | 77 | 124 | 95 | B | Inv. |
| 209 | 126 | 74 | 128 | 87 | B | Inv. |
| 210 | 128 | 73 | 129 | 85 | B | Inv. |
| 211 | 130 | 74 | 135 | 83 | A | Inv. |
| 212 | 136 | 74 | 133 | 78 | A | Inv. |
| 213 | 145 | 72 | 137 | 78 | A | Inv. |
| 214 | 142 | 71 | 143 | 75 | A | Inv. |
| 215 | 143 | 69 | 144 | 76 | A | Inv. |
| 216 | 143 | 72 | 143 | 76 | A | Inv. |
| 217 | 144 | 72 | 145 | 75 | A | Inv. |

As is apparent from Table 6, it was proved that samples using the silver halide emulsion relating to this invention resulted in enhanced sensitivity, minimized fogging and higher contrast when exposed at a high intensity and improved storage stability and pressure resistance, as compared to comparative samples.

Example 5

Samples 201 to 217 of Example 4 were evaluated similarly to Example 2. Results are shown in Table 7. As apparent therefrom, inventive samples led to superior results compared to comparative samples.

TABLE 7

| Sample No. | Clearness of Fine Line and Letter | Skin Tone Reproduction | Reproduction of Leaves Green | Print reproducibility | Remark |
|---|---|---|---|---|---|
| 201 | D | D | D | D | Comp. |
| 202 | C | D | D | C | Comp. |
| 203 | C | D | D | C | Comp. |
| 204 | B | B | B | B | Inv. |
| 205 | B | A | B | B | Inv. |
| 206 | B | B | A | B | Inv. |
| 207 | A | A | A | A | Inv. |
| 208 | A | A | A | A | Inv. |
| 209 | A | A | A | A | Inv. |
| 210 | A | A | A | A | Inv. |
| 211 | A | A | A | A | Inv. |
| 212 | A | A | A | A | Inv. |
| 213 | A | A | A | A | Inv. |
| 214 | A | A | A | A | Inv. |
| 215 | A | A | A | A | Inv. |
| 216 | A | A | A | A | Inv. |
| 217 | A | A | A | A | Inv. |

Example 6

Samples 201 to 217 of Example 4 were evaluated similarly to Example 3. Results are shown in Table 8. As apparent therefrom, inventive samples led to superior results compared to comparative samples.

TABLE 8

| Sample No. | Clearness of Fine Line and Letter | Skin Tone Reproduction | Reproduction of Leaves Green | Print reproducibility | Remark |
|---|---|---|---|---|---|
| 201 | D | D | D | D | Comp. |
| 202 | C | D | D | C | Comp. |
| 203 | C | D | D | C | Comp. |
| 204 | B | B | B | B | Inv. |
| 205 | B | B | A | B | Inv. |
| 206 | B | A | B | B | Inv. |
| 207 | B | A | A | A | Inv. |
| 208 | A | A | A | A | Inv. |
| 209 | A | A | A | A | Inv. |
| 210 | A | A | A | A | Inv. |
| 211 | A | A | A | A | Inv. |
| 212 | A | A | A | A | Inv. |
| 213 | A | A | A | A | Inv. |
| 214 | A | A | A | A | Inv. |
| 215 | A | A | A | A | Inv. |
| 216 | A | A | A | A | Inv. |
| 217 | A | A | A | A | Inv. |

Example 7

Silver halide emulsions were prepared as follows.

Preparation of Silver Halide Emulsion (B-10)

To 1 liter of an aqueous 2% solution of deionized ossein gelatin (containing 10 ppm calcium), maintained at 40° C. were solutions (A11) and (B11) for 30 min, while controlling the pAg and pH at 7.3 and 3.0, respectively. Subsequently, solutions (A12) and (B12) were added for 150 min with controlling the pAg and pH at 8.0 and 5.5, respectively. Then, solutions (A13) and (B13) were added over 30 min. with controlling the pAg and pH at 8.0 and 5.5, respectively. The pAg was controlled in accordance with the method described in JP-A No. 59-45437 and the pH was controlled using aqueous sulfuric acid or sodium hydroxide solution.

| | |
|---|---|
| Solution (A11) | |
| Sodium chloride | 3.42 g |
| Potassium bromide | 0.03 g |
| Water to make | 200 ml |
| Solution (A12) | |
| Sodium chloride | 71.9 g |
| $K_2IrCl_6$ | $5.0 \times 10^{-8}$ mol/mol AgX |
| $K_4Fe(CN)_6$ | $2.5 \times 10^{-5}$ mol/mol AgX |
| Potassium bromide | 0.7 g |
| Water to make | 420 ml |
| Solution (A13) | |
| Sodium chloride | 30.8 g |
| Potassium bromide | 0.3 g |
| Water to make | 180 ml |
| Solution (B11) | |
| Silver nitrate | 10 g |
| Water to make | 200 ml |
| Solution (B12) | |
| Silver nitrate | 210 g |
| Water to make | 420 ml |
| Solution (B13) | |
| Silver nitrate | 90 g |
| Water to make | 180 ml |

After completing addition, an aqueous 5% solution containing 30 g of chemically-modified gelatin (modification rate of 95%), in which an amino group of gelatin was phenylcarbamoylated, was added to perform desalting in accordance with the method described in JP-A No. 5-72658, and an aqueous gelatin solution was further added thereto to obtain silver halide emulsion (B-10) comprising monodisperse cubic grains having an average grain size (cubic equivalent edge length) of 0.64 $\mu$m, a coefficient of variation of grain size of 0.07, a chloride content of 99.5 mol % and a bromide content of 0.5 mol %.

In the silver halide emulsion (B-10), the grain growth portion formed by solutions (A11) and (B11) is designated "seed portion", the growth portion formed by solutions (A12) and (B12) is designated "core portion" and the growth portion formed by solutions (A13) and (B13) is designated "shell portion". The seed portion, core portion and shell portion accounted for 3.3%. 66.7% and 30.0% by volume, respectively.

Preparation of Silver Halide Emulsion (B-11)

Silver halide emulsion (B-11) was prepared similarly to the foregoing silver halide emulsion (B-10), except that an iridium compound of solution (A12) was varied as below.

| | |
|---|---|
| $K_2IrCl_6$ | $3.0 \times 10^{-8}$ mol/mol AgX |
| $K_2IrBr_6$ | $2.0 \times 10^{-8}$ mol/mol AgX |

Preparation of Silver Halide Emulsion (B-12)

Silver halide emulsion (B-12) was prepared similarly to the foregoing silver halide emulsion (B-11), except that compound (S-2-5) was added to solutions (A11), (A12) and (A13) in an amount of $2.1\times10^{-6}$ mol/mol.AgX, $4.3\times10^{-5}$ mol/mol.AgX and $1.9\times10^{-5}$ mol/mol.AgX, respectively, based on final grains.

Preparation of Silver Halide Emulsion (B-13)

Silver halide emulsion (B-13) was prepared similarly to the foregoing silver halide emulsion (B-12), except that compound (S-2-5) was added to solutions (A11), (A22) and (A13) in an amount of $2.1\times10^{-6}$ mol/mol.AgX, $5.3\times10^{-5}$ mol/mol.AgX and $9.0\times10^{-5}$ mol/mol.AgX, respectively, based on final grains, and iridium compounds of solution (A12) were varied as below.

| | |
|---|---|
| $K_2IrCl_6$ | $1.5 \times 10^{-8}$ mol/mol AgX |
| $K_2IrBr_6$ | $7.0 \times 10^{-9}$ mol/mol AgX |
| $K_2[IrCl_5(H_2O)]$ | $6.0 \times 10^{-8}$ mol/mol AgX |
| $K_2[IrCl_5(thiazole)]$ | $3.0 \times 10^{-9}$ mol/mol AgX |

Preparation of Silver Halide Emulsion (B-14)

Silver halide emulsion (B-14) was prepared similarly to the foregoing silver halide emulsion (B-13), except that after completing addition of all of silver nitrate and halide solutions, 0.0055 mol of fine silver bromide grains (grain size of 0.02 μm) was added to form bromide-localized phases in the vicinity of the corners of the grains. The thus prepared silver halide emulsion (B-14) was comprised of monodisperse cubic grains having an average grain size (cubic equivalent edge length) of 0.64 μm, a coefficient of variation of grain size of 0.07, a chloride content of 99.2 mol % and a bromide content of 0.8 mol %.

Preparation of Silver Halide Emulsion (B-15)

Silver halide emulsion (B-15) was prepared similarly to the foregoing silver halide emulsion (B-13), except that a ruthenium compound described below was added to solution (A11); the addition of silver nitrate and halide solutions was interrupted at the completion of 65% of addition of solutions (A13) and (B13) and 7.2 ml of aqueous 0.5 M potassium iodide solution was added; then, the addition of silver nitrate and halide solutions was restarted and after completing the addition of silver nitrate and halide solutions, 0.0055 mol of fine silver bromide grains (grain size of 0.02 μm) was further added to form bromide-localized phases in the vicinity of corners of the grain. The thus prepared silver halide emulsion (B-15) was comprised of monodisperse cubic grains having an average grain size (cubic equivalent edge length) of 0.64 μm, a coefficient of variation of grain size of 0.07, a chloride content of 99.0 mol %, a bromide content of 0.8 mol % and a iodide content of 0.2 mol %.

| | |
|---|---|
| $K_2[Ru(NO)Cl_5]$ | $7.0 \times 10^{-9}$ mol/mol AgX |

Preparation of Blue-sensitive Silver Halide Emulsion (B-10a)

To the foregoing silver halide emulsion (B-10), sensitizing dyes (BS-1) and (BS-2) were added at 60° C., a pH of 5.8 and a pAg of 7.5, subsequently, sodium thiosulfate and chloroauric acid were added to perform spectral sensitization and chemical sensitization. Following the addition of chemical sensitizers and when optimally ripened, compounds (S-2-5), (S-2-2) and (S-2-3) were successively added to stop ripening. A blue-sensitive silver halide emulsion (B-10a) was thus obtained.

| | |
|---|---|
| Sodium thiosulfate | $4.0 \times 10^{-6}$ mol/mol AgX |
| Chloroauric acid | $1.0 \times 10^{-5}$ mol/mol AgX |
| Compound S-2-5 | $3.0 \times 10^{-4}$ mol/mol AgX |
| Compound S-2-2 | $3.0 \times 10^{-4}$ mol/mol AgX |
| Compound S-2-3 | $3.0 \times 10^{-4}$ mol/mol AgX |
| Sensitizing dye BS-1 | $4.0 \times 10^{-4}$ mol/mol AgX |
| Sensitizing dye BS-2 | $1.0 \times 10^{-4}$ mol/mol AgX |

Preparation of Blue-sensitive Silver Halide Emulsion (B-10b)

A blue-sensitive silver halide emulsion (B-10b) was prepared similarly to the foregoing blue-sensitive silver halide emulsion (B-10a), except that compound (1-2) was added in an amount of $1.5\times10^{-4}$ mol/mol.AgX at the completion of 50% of the chemical sensitization time of from the addition of sodium thiosulfate to the addition of compound (S-2-5).

Preparation of Blue-sensitive Silver Halide Emulsion (B-10c)

A blue-sensitive silver halide emulsion (B-10c) was prepared similarly to the foregoing blue-sensitive silver halide emulsion (B-10a), except that compound (4-6) was added in an amount of $2.0\times10^{-4}$ mol/mol.AgX at the completion of 50% of the chemical sensitization time of from the addition of sodium thiosulfate to the addition of compound (S-2-5).

Preparation of Blue-sensitive Silver Halide Emulsion (B-10d)

A blue-sensitive silver halide emulsion (B-10d) was prepared similarly to the blue-sensitive silver halide emulsion (B-10a), except that immediately before adding the sensitizing dyes (BS-1) and (BS-2), compound (1-2) was added in an amount of $1.5\times10^{-4}$ mol/mol.AgX.

Preparation of Blue-sensitive Silver Halide Emulsion (B-10e)

A blue-sensitive silver halide emulsion (B-10e) was prepared similarly to the blue-sensitive silver halide emulsion (B-10a), except that immediately before adding the sensitizing dyes (BS-1) and (BS-2), compound (4-6) was added in an amount of $1.0\times10^{-4}$ mol/mol.AgX.

Preparation of Blue-sensitive Silver Halide Emulsion (B-10f)

A blue-sensitive silver halide emulsion (B-10f) was prepared similarly to the blue-sensitive silver halide emulsion (B-10a), except that immediately before adding the sensitizing dyes (BS-1) and (BS-2), compound (9-2) was added in an amount of $1.5\times10^{-6}$ mol/mol.AgX and compound (1-2) was further added in an amount of $2.0\times10^{-4}$ mol/mol.AgX at the completion of 50% of the chemical sensitization time of from addition of sodium thiosulfate to addition of compound (S-2-5).

Preparation of Blue-sensitive Silver Halide Emulsion (B-10g)

A blue-sensitive silver halide emulsion (B-10g) was prepared similarly to the blue-sensitive silver halide emulsion (B-10a), except that immediately before adding the sensitizing dyes (BS-1) and (BS-2), compound (4-0) was added in an amount of $1.5\times10^{-6}$ mol/mol.AgX and compound (1-21) was further added in an amount of $1.5\times10^{-4}$ mol/mol.AgX at the completion of 50% of the chemical sensitization time of from addition of sodium thiosulfate to addition of compound (S-2-5).

Preparation of Blue-sensitive Silver Halide Emulsion (B-10h)

A blue-sensitive silver halide emulsion (B-10h) was prepared similarly to the blue-sensitive silver halide emulsion (B-10a), except that immediately before adding the sensitizing dyes (BS-1) and (BS-2), compound (1-21) was added in an amount of $2.0\times10^{-4}$ mol/mol.AgX and compound (4-0) was further added in an amount of $2.0\times10^{-6}$ mol/mol.AgX at the completion of 50% of the chemical sensitization time of from addition of sodium thiosulfate to addition of compound (S-2-5).

Preparation of Blue-sensitive Silver Halide Emulsion (B-11a)

A blue-sensitive silver halide emulsion (B-11a) was prepared similarly to the blue-sensitive silver halide emulsion (B-10a), except that the silver halide emulsion (B-10) was replaced by silver halide emulsion (B-11), compound (4-0) was added in an amount of $1.5\times10^{-6}$ mol/mol.AgX immediately before adding the sensitizing dyes (BS-1) and (BS-2), and compound (1-21) was further added in an amount of $2.0\times10^{-4}$ mol/mol.AgX at the completion of 80% of the chemical sensitization time of from addition of sodium thiosulfate to addition of compound (S-2-5).

Preparation of Blue-sensitive Silver Halide Emulsion (B-11b)

A blue-sensitive silver halide emulsion (B-11b) was prepared similarly to the blue-sensitive silver halide emulsion (B-10a), except that the silver halide emulsion (B- 10) was replaced by silver halide emulsion (B-11), compound (1-21) was added in an amount of $2.0\times10^{-4}$ mol/mol.AgX immediately before adding the sensitizing dyes (BS-1) and (BS-2), and compound (4-0) was further added in an amount of $2.0\times10^{-6}$ mol/mol.AgX at the completion of 80% of the chemical sensitization time of from addition of sodium thiosulfate to addition of compound (S-2-5).

Preparation of Blue-sensitive Silver Halide Emulsion (B-12a)

A blue-sensitive silver halide emulsion (B-12a) was prepared similarly to the blue-sensitive silver halide emulsion (B-10a), except that the silver halide emulsion (B-10) was replaced by silver halide emulsion (B-12), compound (4-0) was added in an amount of $1.5\times10^{-6}$ mol/mol.AgX immediately before adding the sensitizing dyes (BS-1) and (BS-2), and compound (1-21) was further added in an amount of $2.0\times10^{-4}$ mol/mol.AgX at the completion of 90% of the chemical sensitization time of from addition of sodium thiosulfate to addition of compound (S-2-5).

Preparation of Blue-sensitive Silver Halide Emulsion (B-12b)

A blue-sensitive silver halide emulsion (B-12b) was prepared similarly to the blue-sensitive silver halide emulsion (B-10a), except that the silver halide emulsion (B-10) was replaced by silver halide emulsion (B-12), compound (1-21) was added in an amount of $2.0\times10^{-4}$ mol/mol.AgX immediately before adding the sensitizing dyes (BS-1) and (BS-2), and compound (4-0) was further added in an amount of $2.0\times10^{-6}$ mol/mol.AgX at the completion of 90% of the chemical sensitization time of from addition of sodium thiosulfate to addition of compound (S-2-5).

Preparation of Blue-sensitive Silver Halide Emulsion (B-13a)

A blue-sensitive silver halide emulsion (B-13a) was prepared similarly to the blue-sensitive silver halide emulsion (B-10a), except that the silver halide emulsion (B-10) was replaced by silver halide emulsion (B-13), compound (4-0) was added in an amount of $1.5\times10^{-6}$ mol/mol.AgX immediately before adding the sensitizing dyes (BS-1) and (BS-2), and compound (1-21) was further added in an amount of $2.0\times10^{-4}$ mol/mol.AgX at the completion of 90% of the chemical sensitization time of from addition of sodium thiosulfate to addition of compound (S-2-5).

Preparation of Blue-sensitive Silver Halide Emulsion (B-13b)

A blue-sensitive silver halide emulsion (B-13b) was prepared similarly to the blue-sensitive silver halide emulsion (B-10a), except that the silver halide emulsion (B-10) was replaced by silver halide emulsion (B-13), compound (1-21) was added in an amount of $2.0\times10^{-4}$ mol/mol.AgX immediately before adding the sensitizing dyes (BS-1) and (BS-2), and compound (4-0) was further added in an amount of $2.0\times10^{-6}$ mol/mol.AgX at the completion of 90% of the chemical sensitization time of from addition of sodium thiosulfate to addition of compound (S-2-5).

Preparation of Blue-sensitive Silver Halide Emulsion (B-14a)

A blue-sensitive silver halide emulsion (B-14a) was prepared similarly to the blue-sensitive silver halide emulsion (B-10a), except that the silver halide emulsion (B-10) was replaced by silver halide emulsion (B-14), compound (4-0) was added in an amount of $1.5\times10^{-6}$ mol/mol.AgX immediately before adding the sensitizing dyes (BS-1) and (BS-2), and compound (1-21) was further added in an amount of $2.0\times10^{-4}$ mol/mol.AgX at the completion of 90% of the chemical sensitization time of from addition of sodium thiosulfate to addition of compound (S-2-5).

Preparation of Blue-sensitive Silver Halide Emulsion (B-14b)

A blue-sensitive silver halide emulsion (B-14b) was prepared similarly to the blue-sensitive silver halide emulsion (B-10a), except that the silver halide emulsion (B-10) was replaced by silver halide emulsion (B-14), compound (1-21) was added in an amount of $2.0\times10^{-4}$ mol/mol.AgX immediately before adding the sensitizing dyes (BS-1) and (BS-2), and compound (4-0) was further added in an amount of $2.0\times10^{-6}$ mol/mol.AgX at the completion of 90% of the chemical sensitization time of from addition of sodium thiosulfate to addition of compound (S-2-5).

Preparation of Blue-sensitive Silver Halide Emulsion (B-15a)

A blue-sensitive silver halide emulsion (B-15a) was prepared similarly to the blue-sensitive silver halide emulsion (B-10a), except that the silver halide emulsion (B-10) was replaced by silver halide emulsion (B-15), compound (4-0) was added in an amount of $2.0\times10^{-6}$ mol/mol.AgX immediately before adding the sensitizing dyes (BS-1) and (BS-2), and compound (1-21) was further added in an amount of $2.0\times10^{-4}$ mol/mol.AgX at the completion of 90% of the chemical sensitization time of from addition of sodium thiosulfate to addition of compound (S-2-5).

Preparation of Blue-sensitive Silver Halide Emulsion (B-15b)

A blue-sensitive silver halide emulsion (B-15b) was prepared similarly to the blue-sensitive silver halide emulsion (B-10a), except that the silver halide emulsion (B-10) was replaced by silver halide emulsion (B-15), compound (1-21) was added in an amount of $2.0\times10^{-4}$ mol/mol.AgX immediately before adding the sensitizing dyes (BS-1) and (BS-2), and compound (4-0) was further added in an amount of $2.0\times10^{-6}$ mol/mol.AgX at the completion of 80% of the chemical sensitization time of from addition of sodium thiosulfate to addition of compound (S-2-5).

Preparation of Blue-sensitive Silver Halide Emulsion (B-15c)

A blue-sensitive silver halide emulsion (B-15c) was prepared similarly to the blue-sensitive silver halide emulsion (B-10a), except that the silver halide emulsion (B-10) was replaced by silver halide emulsion (B-15), compounds (1-21) and 9-2 added in an amount of $1.0\times10^{-4}$ mol/mol.AgX and $1.0\times10^{-6}$ mol/mol.AgX, respectively, immediately before adding the sensitizing dyes (BS-1) and (BS-2), and compounds (4-0) and 1-21 were further added in an amount of $2.0\times10^{-6}$ mol/mol.AgX and $1.5\times10^{-4}$ mol/mol.AgX, respectively, at the completion of 90% of the chemical sensitization time of from addition of sodium thiosulfate to addition of compound (S-2-5).

Preparation of Blue-sensitive Silver Halide Emulsion (B-15d)

A blue-sensitive silver halide emulsion (B-15d) was prepared similarly to the blue-sensitive silver halide emulsion (B-15c), except that the addition of sensitizing dyes (BS-1)

and (BS-2) before the addition of sodium thiosulfate and chloroauric acid was canceled and sensitizing dyes (BS-1) and (BS-2) were added after the addition of compounds (S-2-S), (S-2-2) and (S-2-3).

Preparation of Silver Halide Emulsion

Silver halide emulsions (G-10) to (G-13), which were each comprised of monodisperse cubic silver halide grains having an average grain size (cubic equivalent edge length) of 0.50 μm, a coefficient of variation of grain size of 0.08, a chloride content of 99.5 mol % and a bromide content of 0.5 mol %, were each prepared similarly to the foregoing silver halide emulsions (B-10) to (B-13), except that the time of addition of solutions (A11), (B11), (A12), (B12), (A13) and (B13) was optimally varied.

A silver halide emulsion (G-14), which was comprised of monodisperse cubic silver halide grains having an average grain size (cubic equivalent edge length) of 0.50 μm, a coefficient of variation of grain size of 0.08, a chloride content of 99.2 mol % and a bromide content of 0.8 mol %, was prepared similarly to the foregoing silver halide emulsions (B-14), except that the time of addition of solutions (A11), (B11), (A12), (B12), (A13) and (B13) was optimally varied.

A silver halide emulsion (G-15), which was comprised of monodisperse cubic silver halide grains having an average grain size (cubic equivalent edge length) of 0.50 μm, a coefficient of variation of grain size of 0.08, a chloride content of 99.0 mol %, a bromide content of 0.8 mol % and an iodide content of 0.2 mol %, was prepared similarly to the foregoing silver halide emulsions (B-15), except that the time of addition of solutions (A11), (B11), (A12), (B12), (A13) and (B13) was optimally varied.

Preparation of Green-sensitive Silver Halide Emulsion (G-10a)

To the foregoing silver halide emulsion (G-10), sensitizing dye (GS-1) was added at 60° C., a pH of 5.8 and a pAg of 7.5, subsequently, sodium thiosulfate and chloroauric acid were added to perform spectral sensitization and chemical sensitization. Following the addition of chemical sensitizers and when optimally ripened, compound (S-2-5) was successively added to stop ripening. A green-sensitive silver halide emulsion (G-10a) was thus obtained.

| | |
|---|---|
| Sensitizing dye GS-1 | $4.0 \times 10^{-4}$ mol/mol AgX |
| Sodium thiosulfate | $4.5 \times 10^{-6}$ mol/mol AgX |
| Chloroauric acid | $1.5 \times 10^{-5}$ mol/mol AgX |
| Compound S-2-5 | $1.5 \times 10^{-4}$ mol/mol AgX |

Preparation of Green-sensitive Silver Halide Emulsion (G-10b)

A green-sensitive silver halide emulsion (G-10b) was prepared similarly to the foregoing green-sensitive silver halide emulsion (G-10a), except that compound (1-2) was added in an amount of $1.5\times10^{-4}$ mol/mol.AgX at the completion of 50% of the chemical sensitization time of from the addition of sodium thiosulfate to the addition of compound (S-2-5).

Preparation of Green-sensitive Silver Halide Emulsion (G-11c)

A green-sensitive silver halide emulsion (B-10c) was prepared similarly to the foregoing green-sensitive silver halide emulsion (G-10a), except that compound (4-6) was added in an amount of $2.0\times10^{-4}$ mol/mol.AgX at the completion of 50% of the chemical sensitization time of from the addition of sodium thiosulfate to the addition of compound (S-2-5).

Preparation of Green-sensitive Silver Halide Emulsion (G-10d)

A green-sensitive silver halide emulsion (G-10d) was prepared similarly to the green-sensitive silver halide emulsion (G-10a), except that immediately before adding the sensitizing dye (GS-1), compound (1-2) was added in an amount of $1.5\times10^{-4}$ mol/mol.AgX.

Preparation of Green-sensitive Silver Halide Emulsion (G-10e)

A green-sensitive silver halide emulsion (G-10e) was prepared similarly to the green-sensitive silver halide emulsion (G-10a), except that immediately before adding the sensitizing dye (GS-1), compound (4-6) was added in an amount of $1.0\times10^{-4}$ mol/mol.AgX.

Preparation of Green-sensitive Silver Halide Emulsion (G-10f)

A green-sensitive silver halide emulsion (G-10f) was prepared similarly to the green-sensitive silver halide emulsion (G-10a), except that immediately before adding the sensitizing dye (GS-1), compound (9-2) was added in an amount of $1.5\times10^{-6}$ mol/mol.AgX and compound (1-2) was further added in an amount of $2.0\times10^{-4}$ mol/mol.AgX at the completion of 50% of the chemical sensitization time of from addition of sodium thiosulfate to addition of compound (S-2-5).

Preparation of Green-sensitive Silver Halide Emulsion (G-10g)

A green-sensitive silver halide emulsion (G-10g) was prepared similarly to the green-sensitive silver halide emulsion (G-10a), except that immediately before adding the sensitizing dye (GS-1), compound (4-0) was added in an amount of $1.5\times10^{-6}$ mol/mol.AgX and compound (1-21) was further added in an amount of $1.5\times10^{-4}$ mol/mol.AgX at the completion of 50% of the chemical sensitization time of from addition of sodium thiosulfate to addition of compound (S-2-5).

Preparation of Green-sensitive Silver Halide Emulsion (G-10h)

A green-sensitive silver halide emulsion (G-10h) was prepared similarly to the green-sensitive silver halide emulsion (G-10a), except that immediately before adding the sensitizing dye (GS-1), compound (1-21) was added in an amount of $2.0\times10^{-4}$ mol/mol.AgX and compound (4-0) was further added in an amount of $2.0\times10^{-6}$ mol/mol.AgX at the completion of 50% of the chemical sensitization time of from addition of sodium thiosulfate to addition of compound (S-2-5).

Preparation of Green-sensitive Silver Halide Emulsion (G-11a)

A green-sensitive silver halide emulsion (G-11a) was prepared similarly to the green-sensitive silver halide emulsion (G-10a), except that the silver halide emulsion (G-10) was replaced by silver halide emulsion (G-11), compound (4-0) was added in an amount of $1.5\times10^{-6}$ mol/mol.AgX immediately before adding the sensitizing dye (GS-1), and compound (1-21) was further added in an amount of $2.0\times10^{-4}$ mol/mol.AgX at the completion of 80% of the chemical sensitization time of from addition of sodium thiosulfate to addition of compound (S-2-5).

Preparation of Green-sensitive Silver Halide Emulsion (G-11b)

A green-sensitive silver halide emulsion (G-11b) was prepared similarly to the green-sensitive silver halide emulsion (G-10a), except that the silver halide emulsion (G-10) was replaced by silver halide emulsion (G-11), compound (1-21) was added in an amount of $2.0\times10^{4}$ mol/mol.AgX immediately before adding the sensitizing dye (GS-1), and compound (4-0) was further added in an amount of $2.0\times10^{-6}$ mol/mol.AgX at the completion of 80% of the chemical sensitization time of from addition of sodium thiosulfate to addition of compound (S-2-5).

Preparation of Green-sensitive Silver Halide Emulsion (G-12a)

A green-sensitive silver halide emulsion (G-12a) was prepared similarly to the green-sensitive silver halide emulsion (G-10a), except that the silver halide emulsion (G-10) was replaced by silver halide emulsion (G-12), compound (4-0) was added in an amount of $1.5\times10^{-6}$ mol/mol.AgX immediately before adding the sensitizing dye (GS-1), and compound (1-21) was further added in an amount of $2.0\times10^{-4}$ mol/mol.AgX at the completion of 90% of the chemical sensitization time of from addition of sodium thiosulfate to addition of compound (S-2-5).

Preparation of Green-sensitive Silver Halide Emulsion (G-12b)

A green-sensitive silver halide emulsion (G-12b) was prepared similarly to the green-sensitive silver halide emulsion (G-10a), except that the silver halide emulsion (G-10) was replaced by silver halide emulsion (G-12), compound (1-21) was added in an amount of $2.0\times10^{-4}$ mol/mol.AgX immediately before adding the sensitizing dye (GS-1), and compound (4-0) was further added in an amount of $2.0\times10^{-6}$ mol/mol.AgX at the completion of 90% of the chemical sensitization time of from addition of sodium thiosulfate to addition of compound (S-2-5).

Preparation of Green-sensitive Silver Halide Emulsion (G-13a)

A green-sensitive silver halide emulsion (G-13a) was prepared similarly to the green-sensitive silver halide emulsion (G-10a), except that the silver halide emulsion (G-10) was replaced by silver halide emulsion (G-13), compound (4-0) was added in an amount of $1.5\times10^{-6}$ mol/mol.AgX immediately before adding the sensitizing dye (GS-1), and compound (1-21) was further added in an amount of $2.0\times10^{-4}$ mol/mol.AgX at the completion of 90% of the chemical sensitization time of from addition of sodium thiosulfate to addition of compound (S-2-5).

Preparation of Green-sensitive Silver Halide Emulsion (G-13b)

A green-sensitive silver halide emulsion (G-13b) was prepared similarly to the green-sensitive silver halide emulsion (G-10a), except that the silver halide emulsion (G-10) was replaced by silver halide emulsion (G-13), compound (1-21) was added in an amount of $2.0\times10^{-4}$ mol/mol.AgX immediately before adding the sensitizing dye (GS-1), and compound (4-0) was further added in an amount of $2.0\times10^{-6}$ mol/mol.AgX at the completion of 90% of the chemical sensitization time of from addition of sodium thiosulfate to addition of compound (S-2-5).

Preparation of Green-sensitive Silver Halide Emulsion (G-14a)

A green-sensitive silver halide emulsion (G-14a) was prepared similarly to the green-sensitive silver halide emulsion (G-10a), except that the silver halide emulsion (G-10) was replaced by silver halide emulsion (G-14), compound (4-0) was added in an amount of $1.5\times10^{-6}$ mol/mol.AgX immediately before adding the sensitizing dye (GS-1), and compound (1-21) was further added in an amount of $2.0\times10^{-4}$ mol/mol.AgX at the completion of 90% of the chemical sensitization time of from addition of sodium thiosulfate to addition of compound (S-2-5).

Preparation of Green-sensitive Silver Halide Emulsion (G-14b)

A green-sensitive silver halide emulsion (G-14b) was prepared similarly to the green-sensitive silver halide emulsion (G-10a), except that the silver halide emulsion (G-10) was replaced by silver halide emulsion (G-14), compound (1-21) was added in an amount of $2.0\times10^{-4}$ mol/mol.AgX immediately before adding the sensitizing dye (GS-1), and compound (4-0) was further added in an amount of $2.0\times10^{-6}$ mol/mol.AgX at the completion of 90% of the chemical sensitization time of from addition of sodium thiosulfate to addition of compound (S-2-5).

Preparation of Green-sensitive Silver Halide Emulsion (G-15a)

A green-sensitive silver halide emulsion (G-15a) was prepared similarly to the green-sensitive silver halide emulsion (G-10a), except that the silver halide emulsion (G-10) was replaced by silver halide emulsion (G-15), compound (4-0) was added in an amount of $2.0\times10^{-6}$ mol/mol.AgX immediately before adding the sensitizing dye (GS-1), and compound (1-21) was further added in an amount of $2.0\times10^{-4}$ mol/mol.AgX at the completion of 90% of the chemical sensitization time of from addition of sodium thiosulfate to addition of compound (S-2-5).

Preparation of Green-sensitive Silver Halide Emulsion (G-15b)

A green-sensitive silver halide emulsion (G-15b) was prepared similarly to the green-sensitive silver halide emulsion (G-10a), except that the silver halide emulsion (G-10) was replaced by silver halide emulsion (G-15), compound (1-21) was added in an amount of $2.0\times10^{-4}$ mol/mol.AgX immediately before adding the sensitizing dye (GS-1), and compound (4-0) was further added in an amount of $2.0\times10^{-6}$ mol/mol.AgX at the completion of 90% of the chemical sensitization time of from addition of sodium thiosulfate to addition of compound (S-2-5).

Preparation of Green-sensitive Silver Halide Emulsion (G-15c)

A green-sensitive silver halide emulsion (G-15c) was prepared similarly to the green-sensitive silver halide emulsion (G-10a), except that the silver halide emulsion (G-10) was replaced by silver halide emulsion (G-15), compounds (1-21) and (9-2) added in an amount of $1.5\times10^{-4}$ mol/mol.AgX and $1.0\times10^{-6}$ mol/mol.AgX, respectively, immediately before adding the sensitizing dye (GS-1), and compounds (4-0) and (1-21) were further added in an amount of $2.0\times10^{-6}$ mol/mol.AgX and $1.5\times10^{-4}$ mol/mol.AgX, respectively, at the completion of 90% of the chemical sensitization time of from addition of sodium thiosulfate to addition of compound (S-2-5).

Preparation of Green-sensitive Silver Halide Emulsion (G-15d)

A green-sensitive silver halide emulsion (G-15d) was prepared similarly to the green-sensitive silver halide emulsion (G-15c), except that the addition of sensitizing dye (GS-1) before the addition of sodium thiosulfate and chloroauric acid was canceled and sensitizing dye (GS-1) was added after the addition of compounds (S-2-5).

Preparation of Silver Halide Emulsion

Silver halide emulsions (R-10) to (R-13), which were each comprised of monodisperse cubic silver halide grains having an average grain size (cubic equivalent edge length) of 0.40 $\mu$m, a coefficient of variation of grain size of 0.08, a chloride content of 99.5 mol % and a bromide content of 0.5 mol %, were each prepared similarly to the foregoing silver halide emulsions (B-10) to (B-13), except that the time of addition of solutions (A11), (B11), (A12), (B12), (A13) and (B13) was optimally varied.

A silver halide emulsion (R-14), which was comprised of monodisperse cubic silver halide grains having an average grain size (cubic equivalent edge length) of 0.4 $\mu$m, a coefficient of variation of grain size of 0.08, a chloride content of 99.2 mol % and a bromide content of 0.8 mol %, was prepared similarly to the foregoing silver halide emulsions (B-14), except that the time of addition of solutions (A11), (B11), (A12), (B12), (A13) and (B13) was optimally varied.

A silver halide emulsion (R-15), which was comprised of monodisperse (cubic silver halide grains having an average grain size cubic equivalent edge length) of 0.40 μm, a coefficient of variation of grain size of 0.08, a chloride content of 99.0 mol %, a bromide content of 0.8 mol % and an iodide content of 0.2 mol %, was prepared similarly to the foregoing silver halide emulsions (B-15), except that the time of addition of solutions (A11), (B11), (A12), (B12), (A13) and (B13) was optimally varied.

Preparation of Red-sensitive Silver Halide Emulsion (R-10a)

To the foregoing silver halide emulsion (R-10), sensitizing dyes (RS-1) and (RS-2) were added at 60° C., a pH of 5.0 and a pAg of 7.1, subsequently, sodium thiosulfate and chloroauric acid were added to perform spectral sensitization and chemical sensitization. Following the addition of chemical sensitizers and when optimally ripened, compound (S-2-5) was successively added to stop ripening. A red-sensitive silver halide emulsion (R-10a) was thus obtained.

| | |
|---|---|
| Sodium thiosulfate | $1.2 \times 10^{-5}$ mol/mol AgX |
| Chloroauric acid | $1.5 \times 10^{-5}$ mol/mol AgX |
| Compound S-2-5 | $1.2 \times 10^{-4}$ mol/mol AgX |
| Sensitizing dye RS-1 | $1.0 \times 10^{-4}$ mol/mol AgX |
| Sensitizing dye RS-2 | $1.0 \times 10^{-4}$ mol/mol AgX |

Preparation of Red-sensitive Silver Halide Emulsion (R-10b)

A red-sensitive silver halide emulsion (R-10b) was prepared similarly to the foregoing red-sensitive silver halide emulsion (R-10a), except that compound (1-2) was added in an amount of $1.5\times10^{-4}$ mol/mol.AgX at the completion of 50% of the chemical sensitization time of from the addition of sodium thiosulfate to the addition of compound (S-2-5).

Preparation of Red-sensitive Silver Halide Emulsion (R-10c)

A red-sensitive silver halide emulsion (R-10c) was prepared similarly to the foregoing red-sensitive silver halide emulsion (R-10a), except that compound (4-6) was added in an amount of $2.0\times10^{-4}$ mol/mol.AgX at the completion of 50% of the chemical sensitization time of from the addition of sodium thiosulfate to the addition of compound (S-2-5).

Preparation of Red-sensitive Silver Halide Emulsion (R-10d)

A red-sensitive silver halide emulsion (R-10d) was prepared similarly to the red-sensitive silver halide emulsion (R-10a), except that immediately before adding the sensitizing dyes (RS-1) and (RS-2), compound (1-2) was added in an amount of $1.5\times10^{-4}$ mol/mol.AgX.

Preparation of Red-sensitive Silver Halide Emulsion (R-10e)

A red-sensitive silver halide emulsion (R-10e) was prepared similarly to the red-sensitive silver halide emulsion (R-10a), except that immediately before adding the sensitizing dyes (RS-1) and (RS-2), compound (4-6) was added in an amount of $1.0\times10^{-4}$ mol/mol.AgX.

Preparation of Red-sensitive Silver Halide Emulsion (R-10f)

A red-sensitive silver halide emulsion (R-10f) was prepared similarly to the red-sensitive silver halide emulsion (R-10a), except that immediately before adding the sensitizing dyes (RS-1) and (RS-2), compound (9-2) was added in an amount of $1.5\times10^{-6}$ mol/mol.AgX and compound (1-2) was further added in an amount of $2.0\times10^{-4}$ mol/mol.AgX at the completion of 50% of the chemical sensitization time of from addition of sodium thiosulfate to addition of compound (S-2-5).

Preparation of Red-sensitive Silver Halide Emulsion (R-10g)

A red-sensitive silver halide emulsion (R-10g) was prepared similarly to the red-sensitive silver halide emulsion (R-10a), except that immediately before adding the sensitizing dyes (RS-1) and (RS-2), compound (4-0) was added in an amount of $1.5\times10^{-6}$ mol/mol.AgX and compound (1-21) was further added in an amount of $1.5\times10^{-4}$ mol/mol.AgX at the completion of 50% of the chemical sensitization time of from addition of sodium thiosulfate to addition of compound (S-2-5).

Preparation of Red-sensitive Silver Halide Emulsion (R-10h)

A red-sensitive silver halide emulsion (R-10h) was prepared similarly to the red-sensitive silver halide emulsion (R-10a), except that immediately before adding the sensitizing dyes (RS-1) and (RS-2), compound (1-21) was added in an amount of $2.0\times10^{-4}$ mol/mol.AgX and compound (4-0) was further added in an amount of $2.0\times10^{-6}$ mol/mol.AgX at the completion of 50% of the chemical sensitization time of from addition of sodium thiosulfate to addition of compound (S-2-5).

Preparation of Red-sensitive Silver Halide Emulsion (R-11a)

A red-sensitive silver halide emulsion (R-11a) was prepared similarly to the red-sensitive silver halide emulsion (R-10a), except that the silver halide emulsion (R-10) was replaced by silver halide emulsion (R-11), compound (4-0) was added in an amount of $1.5\times10^{-6}$ mol/mol.AgX immediately before adding the sensitizing dyes (RS-1) and (RS-2), and compound (1-21) was further added in an amount of $2.0\times10^{-4}$ mol/mol.AgX at the completion of 80% of the chemical sensitization time of from addition of sodium thiosulfate to addition of compound (S-2-5).

Preparation of Red-sensitive Silver Halide Emulsion (R-11b)

A red-sensitive silver halide emulsion (R-11b) was prepared similarly to the red-sensitive silver halide emulsion (G-10a), except that the silver halide emulsion (R-10) was replaced by silver halide emulsion (R-11), compound (1-21) was added in an amount of $2.0\times10^{-4}$ mol/mol.AgX immediately before adding the sensitizing dyes (RS-1) and (RS-2), and compound (4-0) was further added in an amount of $2.0\times10^{-6}$ mol/mol.AgX at the completion of 80% of the chemical sensitization time of from addition of sodium thiosulfate to addition of compound (S-2-5).

Preparation of Red-sensitive Silver Halide Emulsion (R-12a)

A red-sensitive silver halide emulsion (R-12a) was prepared similarly to the red-sensitive silver halide emulsion (R-10a), except that the silver halide emulsion (R-10) was replaced by silver halide emulsion (R-12), compound (4-0) was added in an amount of $1.5\times10^{-6}$ mol/mol.AgX immediately before adding the sensitizing dyes (RS-1) and (RS-2), and compound (1-21) was further added in an amount of $2.0\times10^{-4}$ mol/mol.AgX at the completion of 90% of the chemical sensitization time of from addition of sodium thiosulfate to addition of compound (S-2-5).

Preparation of Red-sensitive Silver Halide Emulsion (R-12b)

A red-sensitive silver halide emulsion (R-12b) was prepared similarly to the red-sensitive silver halide emulsion (R-10a), except that the silver halide emulsion (R-10) was replaced by silver halide emulsion (R-12), compound (1-21) was added in an amount of $2.0\times10^{-4}$ mol/mol.AgX immediately before adding the sensitizing dyes (RS-1) and (RS-2), and compound (4-0) was further added in an amount of $2.0\times10^{-6}$ mol/mol.AgX at the completion of 90% of the chemical sensitization time of from addition of sodium thiosulfate to addition of compound (S-2-5).

Preparation of Red-sensitive Silver Halide Emulsion (R-13a)

A red-sensitive silver halide emulsion (R-13a) was prepared similarly to the red-sensitive silver halide emulsion (R-10a), except that the silver halide emulsion (R-10) was replaced by silver halide emulsion (R-13), compound (4-0) was added in an amount of $1.5\times10^{-6}$ mol/mol.AgX immediately before adding the sensitizing dyes (RS-1) and (RS-2), and compound (1-21) was further added in an amount of $2.0\times10^{-4}$ mol/mol.AgX at the completion of 90% of the chemical sensitization time of from addition of sodium thiosulfate to addition of compound (S-2-5).

Preparation of Red-sensitive Silver Halide Emulsion (R-13b)

A red-sensitive silver halide emulsion (R-13b) was prepared similarly to the red-sensitive silver halide emulsion (R-10a), except that the silver halide emulsion (R-10) was replaced by silver halide emulsion (R-13), compound (1-21) was added in an amount of $2.0\times10^{-4}$ mol/mol.AgX immediately before adding the sensitizing dyes (RS-1) and (RS-2), and compound (4-0) was further added in an amount of $2.0\times10^{-6}$ mol/mol.AgX at the completion of 90% of the chemical sensitization time of from addition of sodium thiosulfate to addition of compound (S-2-5).

Preparation of Red-sensitive Silver Halide Emulsion (R-14a)

A red-sensitive silver halide emulsion (R-14a) was prepared similarly to the red-sensitive silver halide emulsion (R-10a), except that the silver halide emulsion (R-10) was replaced by silver halide emulsion (R-14), compound (4-0) was added in an amount of $1.5\times10^{-6}$ mol/mol.AgX immediately before adding the sensitizing dyes (RS-1) and (RS-2), and compound (1-21) was further added in an amount of $2.0\times10^{-4}$ mol/mol.AgX at the completion of 90% of the chemical sensitization time of from addition of sodium thiosulfate to addition of compound (S-2-5).

Preparation of Red-sensitive Silver Halide Emulsion (R-14b)

A red-sensitive silver halide emulsion (R-14b) was prepared similarly to the red-sensitive silver halide emulsion (R-10a), except that the silver halide emulsion (R-10) was replaced by silver halide emulsion (R-14), compound (1-21) was added in an amount of $2.0\times10^{-4}$ mol/mol.AgX immediately before adding the sensitizing dyes (RS-1) and (RS-2), and compound (4-0) was further added in an amount of $2.0\times10^{-6}$ mol/mol.AgX at the completion of 90% of the chemical sensitization time of from addition of sodium thiosulfate to addition of compound (S-2-5).

Preparation of Red-sensitive Silver Halide Emulsion (R-15a)

A red-sensitive silver halide emulsion (R-15a) was prepared similarly to the red-sensitive silver halide emulsion (R-10a), except that the silver halide emulsion (R-10) was replaced by silver halide emulsion (R-15), compound (4-0) was added in an amount of $2.0\times10^{-6}$ mol/mol.AgX immediately before adding the sensitizing dyes (RS-1) and (RS-2), and compound (1-21) was further added in an amount of $2.0\times10^{-4}$ mol/mol.AgX at the completion of 90% of the chemical sensitization time of from addition of sodium thiosulfate to addition of compound (S-2-5).

Preparation of Red-sensitive Silver Halide Emulsion (R-15b)

A red-sensitive silver halide emulsion (R-15b) was prepared similarly to the red-sensitive silver halide emulsion (R-10a), except that the silver halide emulsion (R-10) was replaced by silver halide emulsion (R-15), compound (1-21) was added in an amount of $2.0\times10^{-4}$ mol/mol.AgX immediately before adding the sensitizing dyes (RS-1) and (RS-2), and compound (4-0) was further added in an amount of $2.0\times10^{-6}$ mol/mol.AgX at the completion of 90% of the chemical sensitization time of from addition of sodium thiosulfate to addition of compound (S-2-5).

Preparation of Red-sensitive Silver Halide Emulsion (R-15c)

A red-sensitive silver halide emulsion (R-15c) was prepared similarly to the red-sensitive silver halide emulsion (R-10a), except that the silver halide emulsion (R-10) was replaced by silver halide emulsion (R-15), compounds (1-21) and (9-2) added in an amount of $1.5\times10^{-4}$ mol/mol.AgX and $1.0\times10^{-6}$ mol/mol.AgX, respectively, immediately before adding the sensitizing dyes (RS-1) and (RS-2), and compounds (4-0) and (1-21) were further added in an amount of $2.0\times10^{-6}$ mol/mol.AgX and $1.5\times10^{-4}$ mol/mol.AgX, respectively, at the completion of 90% of the chemical sensitization time of from addition of sodium thiosulfate to addition of compound (S-2-5).

Preparation of Red-sensitive Silver Halide Emulsion (R-15d)

A red-sensitive silver halide emulsion (R-15d) was prepared similarly to the red-sensitive silver halide emulsion (R-15c), except that the addition of sensitizing dyes (RS-1) and (RS-2) before the addition of sodium thiosulfate and chloroauric acid was canceled and sensitizing dyes (RS-1) and (RS-2) were added after the addition of compounds (S-2-5).

In the foregoing preparation of red-sensitive silver halide emulsions, $2.0\times10^{-3}$ mol/mol.AgX of SS-1 was added at the completion of the preparation.

Photographic material samples 301 to 320 were prepared similarly to sample 101 of Example 1, except that the blue-sensitive silver halide emulsion (B-1a) used in the 1st layer, the green-sensitive silver halide emulsion (G-1a) used in the 3rd layer and the red-sensitive silver halide emulsion (R-1a) used in the 5th layer were respectively replaced by silver halide emulsions shown in Table 9. The thus prepared samples were evaluated similarly to Example 1 and results thereof are shown in Table 10.

TABLE 9

| Sample | Silver Halide Emulsion | | | |
|---|---|---|---|---|
| No. | 1st Layer | 3rd Layer | 5th Layer | Remark |
| 301 | B-10a | G-10a | R-10a | Comp. |
| 302 | B-10b | G-10b | R-10b | Comp. |
| 303 | B-10c | G-10c | R-10c | Comp. |
| 304 | B-10d | G-10d | R-10d | Comp. |
| 305 | B-10e | G-10e | R-10e | Comp. |
| 306 | B-10f | G-10f | R-10f | Inv. |
| 307 | B-10g | G-10g | R-10g | Inv. |
| 308 | B-10h | G-10h | R-10h | Inv. |
| 309 | B-11a | G-11a | R-11a | Inv. |
| 310 | B-11b | G-11b | R-11b | Inv. |
| 311 | B-12a | G-12a | R-12a | Inv. |
| 312 | B-12b | G-12b | R-12b | Inv. |
| 313 | B-13a | G-13a | R-13a | Inv. |
| 314 | B-13b | G-13b | R-13b | Inv. |
| 315 | B-14a | G-14a | R-14a | Inv. |
| 316 | B-14b | G-14b | R-14b | Inv. |

TABLE 9-continued

| Sample No. | Silver Halide Emulsion 1st Layer | 3rd Layer | 5th Layer | Remark |
|---|---|---|---|---|
| 317 | B-15a | G-15a | R-15a | Inv. |
| 318 | B-15b | G-15b | R-15b | Inv. |
| 319 | B-15c | G-15c | R-15c | Inv. |
| 320 | B-15d | G-15d | R-15d | Inv. |

TABLE 10

| Sample No. | S | Fog | γ | Storage Stability | Pressure Resistance | Remark |
|---|---|---|---|---|---|---|
| 301 | 100 | 100 | 100 | 146 | E | Comp. |
| 302 | 104 | 87 | 103 | 120 | E | Comp. |
| 303 | 105 | 88 | 102 | 121 | E | Comp. |
| 304 | 111 | 93 | 109 | 123 | D | Comp. |
| 305 | 110 | 92 | 108 | 122 | D | Comp. |
| 306 | 121 | 81 | 115 | 103 | C | Inv. |
| 307 | 120 | 80 | 117 | 101 | C | Inv. |
| 308 | 121 | 82 | 117 | 105 | C | Inv. |
| 309 | 124 | 77 | 123 | 97 | B | Inv. |
| 310 | 123 | 77 | 121 | 95 | B | Inv. |
| 311 | 127 | 72 | 122 | 90 | B | Inv. |
| 312 | 128 | 73 | 126 | 92 | B | Inv. |
| 313 | 134 | 73 | 128 | 88 | A | Inv. |
| 314 | 136 | 72 | 126 | 86 | A | Inv. |
| 315 | 141 | 70 | 133 | 83 | A | Inv. |
| 316 | 138 | 71 | 134 | 83 | A | Inv. |
| 317 | 146 | 68 | 140 | 77 | A | Inv. |
| 318 | 144 | 70 | 138 | 79 | A | Inv. |
| 319 | 145 | 69 | 141 | 76 | A | Inv. |
| 320 | 144 | 67 | 140 | 74 | A | Inv. |

As is apparent from Table 10, it was proved that samples using the silver halide emulsion relating to this invention resulted in enhanced sensitivity, minimized fogging and higher contrast when exposed at a high intensity and improved storage stability and pressure resistance, as compared to comparative samples.

Example 8

Samples 301 to 320 of Example 7 were evaluated similarly to Example 2. Results are shown in Table 11. As is apparent therefrom, inventive samples led to superior results compared to comparative samples.

TABLE 11

| Sample No. | Clearness of Fine Line and Letter | Skin Tone Reproduction | Reproduction of Leaves Green | Print reproducibility | Remark |
|---|---|---|---|---|---|
| 301 | D | D | D | D | Comp. |
| 302 | C | D | C | C | Comp. |
| 303 | C | D | C | C | Comp. |
| 304 | D | C | D | C | Comp. |
| 305 | C | C | D | C | Comp. |
| 306 | A | B | B | B | Inv. |
| 307 | A | B | B | B | Inv. |
| 308 | A | B | B | B | Inv. |
| 309 | A | A | A | B | Inv. |
| 310 | A | A | A | B | Inv. |
| 311 | A | A | A | A | Inv. |
| 312 | A | A | A | A | Inv. |
| 313 | A | A | A | A | Inv. |
| 314 | A | A | A | A | Inv. |
| 315 | A | A | A | A | Inv. |
| 316 | A | A | A | A | Inv. |

TABLE 11-continued

| Sample No. | Clearness of Fine Line and Letter | Skin Tone Reproduction | Reproduction of Leaves Green | Print reproducibility | Remark |
|---|---|---|---|---|---|
| 317 | A | A | A | A | Inv. |
| 318 | A | A | A | A | Inv. |
| 319 | A | A | A | A | Inv. |
| 320 | A | A | A | A | Inv. |

Example 9

Samples 301 to 320 of Example 7 were evaluated similarly to Example 3. Results are shown in Table 12. As is apparent therefrom, inventive samples led to superior results compared to comparative samples.

TABLE 12

| Sample No. | Clearness of Fine Line and Letter | Skin Tone Reproduction | Reproduction of Leaves Green | Print reproducibility | Remark |
|---|---|---|---|---|---|
| 301 | D | D | D | D | Comp. |
| 302 | C | D | C | C | Comp. |
| 303 | C | D | C | C | Comp. |
| 304 | D | C | D | C | Comp. |
| 305 | C | C | D | C | Comp. |
| 306 | A | B | A | B | Inv. |
| 307 | A | B | A | B | Inv. |
| 308 | A | B | A | B | Inv. |
| 309 | A | A | A | A | Inv. |
| 310 | A | A | A | A | Inv. |
| 311 | A | A | A | A | Inv. |
| 312 | A | A | A | A | Inv. |
| 313 | A | A | A | A | Inv. |
| 314 | A | A | A | A | Inv. |
| 315 | A | A | A | A | Inv. |
| 316 | A | A | A | A | Inv. |
| 317 | A | A | A | A | Inv. |
| 318 | A | A | A | A | Inv. |
| 319 | A | A | A | A | Inv. |
| 320 | A | A | A | A | Inv. |

Example 10

Preparation of Blue-sensitive Silver Halide Emulsion (B-10j)

To the foregoing silver halide emulsion (B-10) of Example 7, sensitizing dyes (BS-1) and (BS-2) were added at 60° C., a pH of 5.8 and a pAg of 7.5, subsequently, sodium thiosulfate and chloroauric acid were added to perform spectral and chemical sensitization. Following the addition of chemical sensitizers and when optimally ripened, compounds (S-2-5), (S-2-2) and (S-2-3) were successively added to stop ripening. A blue-sensitive silver halide emulsion (B-10j) was thus obtained.

| | |
|---|---|
| Sodium thiosulfate | $3.5 \times 10^{-6}$ mol/mol AgX |
| Chloroauric acid | $8.0 \times 10^{-6}$ mol/mol AgX |
| Compound S-2-5 | $3.0 \times 10^{-4}$ mol/mol AgX |
| Compound S-2-2 | $2.0 \times 10^{-4}$ mol/mol AgX |
| Compound S-2-3 | $3.0 \times 10^{-4}$ mol/mol AgX |
| Sensitizing dye BS-1 | $4.0 \times 10^{-4}$ mol/mol AgX |
| Sensitizing dye BS-2 | $1.0 \times 10^{-4}$ mol/mol AgX |

Preparation of Blue-sensitive Silver Halide Emulsion (B-10k)

A blue-sensitive silver halide emulsion (B-10k) was prepared similarly to the foregoing blue-sensitive silver halide emulsion (B-10j), except that compound (1-2) was added in an amount of $1.5\times10^{-4}$ mol/mol AgX immediately after the addition of compounds (S-2-5), (S-2-2) and (S-2-3).

Preparation of Blue-sensitive Silver Halide Emulsion (B-10m)

A blue-sensitive silver halide emulsion (B-10m) was prepared similarly to the foregoing blue-sensitive silver halide emulsion (B-10j), except that compound (4-6) was added in an amount of $1.5\times10^{-4}$ mol/mol AgX immediately after the addition of compounds (S-2-5), (S-2-2) and (S-2-3).

Preparation of Blue-sensitive Silver Halide Emulsion (B-10n)

A blue-sensitive silver halide emulsion (B-10n) was prepared similarly to the foregoing blue-sensitive silver halide emulsion (B-10a), except that compound S-2-5 was added (first addition) in an amount of $1.0\times10^{-4}$ mol/mol.AgX immediately before the addition of sensitizing dyes (BS-1) and (BS-2) and compound (1-2) was added in an amount of $2.0\times10^{-4}$ mol/mol.AgX at the completion of 50% of the chemical sensitization time of from the addition of sodium thiosulfate to the addition of compound S-2-5 (second addition).

Preparation of Blue-sensitive Silver Halide Emulsion (B-10p)

A blue-sensitive silver halide emulsion (B-10p) was prepared similarly to the foregoing blue-sensitive silver halide emulsion (B-10a), except that compound S-2-5 was added (first addition) in an amount of $1.0\times10^{-4}$ mol/mol.AgX immediately before the addition of sensitizing dyes (BS-1) and (BS-2) and compound (4-6) was added in an amount of $2.0\times10^{-4}$ mol/mol.AgX at the completion of 50% of the chemical sensitization time of from the addition of sodium thiosulfate to the addition of compound S-2-5 (second addition).

Preparation of Blue-sensitive Silver Halide Emulsion (B-10q)

A blue-sensitive silver halide emulsion (B-10q) was prepared similarly to the foregoing blue-sensitive silver halide emulsion (B-10a), except that compound S-2-5 was added (first addition) in an amount of $1.0\times10^{-4}$ mol/mol.AgX immediately before the addition of sensitizing dyes (BS-1) and (BS-2) and compound (1-21) was added in an amount of $2.0\times10^{-4}$ mol/mol.AgX at the completion of 90% of the chemical sensitization time of from the addition of sodium thiosulfate to the addition of compound S-2-5 (second addition).

Preparation of Blue-sensitive Silver Halide Emulsion (B-10r)

A blue-sensitive silver halide emulsion (B-10r) was prepared similarly to the foregoing blue-sensitive silver halide emulsion (B-10a), except that compound S-2-5 was added (first addition) in an amount of $1.0\times10^{-4}$ mol/mol.AgX immediately before the addition of sensitizing dyes (BS-1) and (BS-2) and compound (4-0) was added in an amount of $2.0\times10^{-6}$ mol/mol.AgX at the completion of 90% of the chemical sensitization time of from the addition of sodium thiosulfate to the addition of compound S-2-5 (second addition).

Preparation of Blue-sensitive Silver Halide Emulsion (B-12j)

A blue-sensitive silver halide emulsion (B-12j) was prepared similarly to the foregoing blue-sensitive silver halide emulsion (B-10a), except that the silver halide emulsion (B-10) was replaced by the silver halide emulsion (B-12) of Example 7, compound S-2-5 was added (first addition) in an amount of $1.0\times10^{-4}$ mol/mol.AgX immediately before the addition of sensitizing dyes (BS-1) and (BS-2) and compound (1-21) was added in an amount of $2.0\times10^{-4}$ mol/mol.AgX at the completion of 90% of the chemical sensitization time of from the addition of sodium thiosulfate to the addition of compound S-2-5 (second addition).

Preparation of Blue-sensitive Silver Halide Emulsion (B-12k)

A blue-sensitive silver halide emulsion (B-12k) was prepared similarly to the foregoing blue-sensitive silver halide emulsion (B-10a), except that the silver halide emulsion (B-10) was replaced by the silver halide emulsion (B-12) of Example 7, compound S-2-5 was added (first addition) in an amount of $1.0\times10^{-4}$ mol/mol.AgX immediately before the addition of sensitizing dyes (BS-1) and (BS-2) and compound (4-0) was added in an amount of $2.0\times10^{-6}$ mol/mol.AgX at the completion of 90% of the chemical sensitization time of from the addition of sodium thiosulfate to the addition of compound S-2-5 (second addition).

Preparation of Blue-sensitive Silver Halide Emulsion (B-13j)

A blue-sensitive silver halide emulsion (B-13j) was prepared similarly to the foregoing blue-sensitive silver halide emulsion (B-10a), except that the silver halide emulsion (B-10) was replaced by the silver halide emulsion (B-13) of Example 7, compound S-2-5 was added (first addition) in an amount of $1.0\times10^{4}$ mol/mol.AgX immediately before the addition of sensitizing dyes (BS-1) and (BS-2) and compound (1-21) was added in an amount of $2.0\times10^{-4}$ mol/mol.AgX at the completion of 90% of the chemical sensitization time of from the addition of sodium thiosulfate to the addition of compound S-2-5 (second addition).

Preparation of Blue-sensitive Silver Halide Emulsion (B-13k)

A blue-sensitive silver halide emulsion (B-13k) was prepared similarly to the foregoing blue-sensitive silver halide emulsion (B-10a), except that the silver halide emulsion (B-10) was replaced by the silver halide emulsion (B-13) of Example 7, compound S-2-5 was added (first addition) in an amount of $1\times10^{-4}$ mol/mol.AgX immediately before the addition of sensitizing dyes (BS-1) and (BS-2) and compound (4-0) was added in an amount of $2.0\times10^{-6}$ mol/mol.AgX at the completion of 90% of the chemical sensitization time of from the addition of sodium thiosulfate to the addition of compound S-2-5 (second addition).

Preparation of Blue-sensitive Silver Halide Emulsion (B-14j)

A blue-sensitive silver halide emulsion (B-14j) was prepared similarly to the foregoing blue-sensitive silver halide emulsion (B-10a), except that the silver halide emulsion (B-10) was replaced by the silver halide emulsion (B-14) of Example 7, compound S-2-5 was added (first addition) in an amount of $1.0\times10^{-4}$ mol/mol.AgX immediately before the addition of sensitizing dyes (BS-1) and (BS-2) and compounds (1-21) and (4-0) were added in an amount of $1.0\times10^{-4}$ mol/mol.AgX and $1.0\times10^{-6}$ mol/mol.AgX, respectively, at the completion of 90% of the chemical sensitization time of from the addition of sodium thiosulfate to the addition of compound S-2-5 (second addition).

Preparation of Blue-sensitive Silver Halide Emulsion (B-14k)

A blue-sensitive silver halide emulsion (B-14k) was prepared similarly to the foregoing blue-sensitive silver halide emulsion (B-10a), except that the silver halide emulsion (B-10) was replaced by the silver halide emulsion (B-14) of Example 7, compounds S-2-5 and (1-21) were added in an amount of $1.0\times10^{-4}$ mol/mol.AgX (first addition) and $1.0\times10^{-4}$ mol/mol.AgX, respectively, immediately before the addition of sensitizing dyes (BS-1) and (BS-2), and compounds (1-21) and (9-2) were added in an amount of $1.0\times10^{-4}$ mol/mol.AgX and $1.0\times10^{-6}$ mol/mol.AgX, respectively, at the completion of 90% of the chemical sensitization time of from the addition of sodium thiosulfate to the addition of compound S-2-5 (second addition).

Preparation of Blue-sensitive Silver Halide Emulsion (B-15j) A blue-sensitive silver halide emulsion (B-15j) was prepared similarly to the foregoing blue-sensitive silver halide emulsion (B-10a), except that the silver halide emulsion (B-10) was replaced by the silver halide emulsion (B-15) of Example 7, compound S-2-5 was added (first addition) in an amount of $1.0\times10^{-4}$ mol/mol.AgX immediately before the addition of sensitizing dyes (BS-1) and (BS-2), and compounds (1-21) and (4-0) were added in an amount of $1.0\times10^{-4}$ mol/mol.AgX and $2.0\times10^{-6}$ mol/mol.AgX, respectively, at the completion of 90% of the chemical sensitization time of from the addition of sodium thiosulfate to the addition of compound S-2-5 (second addition).

Preparation of Blue-sensitive Silver Halide Emulsion (B-15k)

A blue-sensitive silver halide emulsion (B-15k) was prepared similarly to the foregoing blue-sensitive silver halide emulsion (B-10a), except that the silver halide emulsion (B-10) was replaced by the silver halide emulsion (B-15) of Example 7, compounds S-2-5 and (9-2) were added in an amount of $1.0\times10^{-4}$ mol/mol.AgX (first addition) and $1.0\times10^{-6}$ mol/mol.AgX, respectively, immediately before the addition of sensitizing dyes (BS-1) and (BS-2), and compounds (1-21) and (4-0) were added in an amount of $1.0\times10^{-4}$ mol/mol.AgX and $2.0\times10^{-6}$ mol/mol.AgX, respectively, at the completion of 90% of the chemical sensitization time of from the addition of sodium thiosulfate to the addition of compound S-2-5 (second addition).

Preparation of Blue-sensitive Silver Halide Emulsion (B-15m)

A blue-sensitive silver halide emulsion (B-15m) was prepared similarly to the foregoing blue-sensitive silver halide emulsion (B-10a), except that the silver halide emulsion (B-10) was replaced by the silver halide emulsion (B-15) of Example 7, the addition of sensitizing dyes (BS-1) and (BS-2) was canceled, compounds S-2-5 and (9-2) were added in an amount of $1.0\times10^{-4}$ mol/mol.AgX (first addition) and $1.0\times10^{-6}$ mol/mol.AgX, respectively, then, sodium thiosulfate and chloroauric acid were successively added, compound (4-0) was added in an amount of $2.0\times10^{-6}$ mol/mol.AgX at the completion of 90% of the chemical sensitization time of from the addition of sodium thiosulfate to the addition of compound S-2-5 (second addition), and sensitizing dyes (BS-1) and (BS-2) were added after the addition of S-2-5 (second addition), S-2-2 and S-2-3.

Preparation of Blue-sensitive Silver Halide Emulsion (B-15n)

A blue-sensitive silver halide emulsion (B-15n) was prepared similarly to the foregoing blue-sensitive silver halide emulsion (B-10a), except that the silver halide emulsion (B-10) was replaced by the silver halide emulsion (B-15) of Example 7, compound S-2-5 was added in an amount of $1.0\times10^{-4}$ mol/mol.AgX (first addition) immediately before the addition of sensitizing dyes (BS-1) and (BS-2), compound (9-2) was added in an amount of $1.0\times10^{-6}$ mol/mol.AgX after the addition of sensitizing dyes (BS-1) and (BS-2) and before the addition of sodium thiosulfate, compound (1-21) was added in an amount of $1.0\times10^{-4}$ mol/mol.AgX at the completion of 90% of the chemical sensitization time of from the addition of sodium thiosulfate to the addition of compound S-2-5 (second addition), and compound (4-0) was added in an amount of $2.0\times10^{-6}$ mol/mol.AgX at the completion of 95%.

Preparation of Green-sensitive Silver Halide Emulsion (G-10j)

To the silver halide emulsion (G-10) of Example 7, sensitizing dye (GS-1) was added at 60° C., a pH of 5.8 and a pAg of 7.5, subsequently, sodium thiosulfate and chloroauric acid were added to perform spectral and chemical sensitization. Following the addition of chemical sensitizers and when optimally ripened, compound (S-2-5) was added to stop ripening. A green-sensitive silver halide emulsion (G-10j) was thus obtained.

| | |
|---|---|
| Sensitizing dye GS-1 | $4.0\times10^{-4}$ mol/mol AgX |
| Sodium thiosulfate | $4.0\times10^{-6}$ mol/mol AgX |
| Chloroauric acid | $1.0\times10^{-5}$ mol/mol AgX |
| Compound S-2-5 | $2.0\times10^{-4}$ mol/mol AgX |

Preparation of Green-sensitive Silver Halide Emulsion (G-10k)

A green-sensitive silver halide emulsion (G-10k) was prepared similarly to the foregoing green-sensitive silver halide emulsion (G-10j), except that compound (1-2) was added in an amount of $1.5\times10^{-4}$ mol/mol AgX immediately after the addition of compound (S-2-5).

Preparation of Green-sensitive Silver Halide Emulsion (G-10m)

A green-sensitive silver halide emulsion (G-10m) was prepared similarly to the foregoing green-sensitive silver halide emulsion (G-10j), except that compound (4-6) was added in an amount of $1.5\times10^{-4}$ mol/mol AgX immediately after the addition of compound (S-2-5).

Preparation of Green-sensitive Silver Halide Emulsion (G-10n)

A green-sensitive silver halide emulsion (G-10n) was prepared similarly to the foregoing green-sensitive silver halide emulsion (G-10a), except that compound S-2-5 was added in an amount of $1.0\times10^{-4}$ mol/mol.AgX (first addition) immediately before the addition of sensitizing dye (GS-1) and compound (1-2) was added in an amount of $2.0\times10^{-4}$ mol/mol.AgX at the completion of 50% of the chemical sensitization time of from the addition of sodium thiosulfate to the addition of compound S-2-5 (second addition).

Preparation of Green-sensitive Silver Halide Emulsion (G-10p)

A green-sensitive silver halide emulsion (G-10p) was prepared similarly to the foregoing green-sensitive silver halide emulsion (G-10a), except that compound S-2-5 was added in an amount of $1.0\times10^{-4}$ mol/mol.AgX (first addition) immediately before the addition of sensitizing dye (GS-1) and compound (4-6) was added in an amount of $2.0\times10^{-4}$ mol/mol.AgX at the completion of 50% of the chemical sensitization time of from the addition of sodium thiosulfate to the addition of compound S-2-5 (second addition).

Preparation of Green-sensitive Silver Halide Emulsion (G-10q)

A green-sensitive silver halide emulsion (G-10q) was prepared similarly to the foregoing green-sensitive silver halide emulsion (G-10a), except that compound S-2-5 was added (first addition) in an amount of $1.0\times10^{-4}$ mol/mol.AgX immediately before the addition of sensitizing dye (GS-1) and compound (1-21) was added in an amount of $2.0\times10^{-4}$ mol/mol.AgX at the completion of 90% of the chemical sensitization time of from the addition of sodium thiosulfate to the addition of compound S-2-5 (second addition).

Preparation of Green-sensitive Silver Halide Emulsion (G-10r)

A green-sensitive silver halide emulsion (G-10r) was prepared similarly to the foregoing green-sensitive silver halide emulsion (G-10a), except that compound S-2-5 was added (first addition) in an amount of $1.0\times10^{-4}$ mol/mol.AgX immediately before the addition of sensitizing dye (GS-1) and compound (4-0) was added in an amount of $2.0\times10^{-6}$ mol/mol.AgX at the completion of 90% of the chemical sensitization time of from the addition of sodium thiosulfate to the addition of compound S-2-5 (second addition).

Preparation of Green-sensitive Silver Halide Emulsion (G-12j)

A green-sensitive silver halide emulsion (G-12j) was prepared similarly to the foregoing green-sensitive silver halide emulsion (G-10a), except that the silver halide emulsion (G-10) was replaced by the silver halide emulsion (G-12) of Example 7, compound S-2-5 was added (first addition) in an amount of $1.0\times10^{-4}$ mol/mol.AgX immediately before the addition of sensitizing dye (GS-1) and compound (1-21) was added in an amount of $2.0\times10^{-4}$ mol/mol.AgX at the completion of 90% of the chemical sensitization time of from the addition of sodium thiosulfate to the addition of compound S-2-5 (second addition).

Preparation of Green-sensitive Silver Halide Emulsion (G-12k)

A green-sensitive silver halide emulsion (G-12k) was prepared similarly to the foregoing green-sensitive silver halide emulsion (G-10a), except that the silver halide emulsion (G-10) was replaced by the silver halide emulsion (G-12) of Example 7, compound S-2-5 was added (first addition) in an amount of $1.0\times10^{-4}$ mol/mol.AgX immediately before the addition of sensitizing dye (GS-1), and compound (4-0) was added in an amount of $2.0\times10^{-6}$ mol/mol.AgX at the completion of 90% of the chemical sensitization time of from the addition of sodium thiosulfate to the addition of compound S-2-5 (second addition).

Preparation of Green-sensitive Silver Halide Emulsion (G-13j)

A green-sensitive silver halide emulsion (G-13j) was prepared similarly to the foregoing green-sensitive silver halide emulsion (G-10a), except that the silver halide emulsion (G-10) was replaced by the silver halide emulsion (G-13) of Example 7, compound S-2-5 was added (first addition) in an amount of $1.0\times10^{-4}$ mol/mol.AgX immediately before the addition of sensitizing dye (GS-1) and compound (1-21) was added in an amount of $2.0\times10^{-4}$ mol/mol.AgX at the completion of 90% of the chemical sensitization time of from the addition of sodium thiosulfate to the addition of compound S-2-5 (second addition).

Preparation of Green-sensitive Silver Halide Emulsion (G-13k)

A green-sensitive silver halide emulsion (G-13k) was prepared similarly to the foregoing green-sensitive silver halide emulsion (G-10a), except that the silver halide emulsion (G-10) was replaced by the silver halide emulsion (G-13) of Example 7, compound S-2-5 was added (first addition) in an amount of $1.0\times10^{-4}$ mol/mol.AgX immediately before the addition of sensitizing dye (GS-1) and compound (4-0) was added in an amount of $2.0\times10^{-6}$ mol/mol.AgX at the completion of 90% of the chemical sensitization time of from the addition of sodium thiosulfate to the addition of compound S-2-5 (second addition).

Preparation of Green-sensitive Silver Halide Emulsion (G-14j)

A green-sensitive silver halide emulsion (G-14j) was prepared similarly to the foregoing green-sensitive silver halide emulsion (G-10a), except that the silver halide emulsion (G-10) was replaced by the silver halide emulsion (G-14) of Example 7, compound S-2-5 was added (first addition) in an amount of $1.0\times10^{-4}$ mol/mol.AgX immediately before the addition of sensitizing dye (GS-1) and compounds (1-21) and (4-0) were added in an amount of $1.0\times10^{-4}$ mol/mol.AgX and $1.0\times10^{-6}$ mol/mol.AgX, respectively, at the completion of 90% of the chemical sensitization time of from the addition of sodium thiosulfate to the addition of compound S-2-5 (second addition).

Preparation of Green-sensitive Silver Halide Emulsion (G-14k)

A green-sensitive silver halide emulsion (G-14k) was prepared similarly to the foregoing green-sensitive silver halide emulsion (G-10a), except that the silver halide emulsion (G-10) was replaced by the silver halide emulsion (G-14) of Example 7, compounds S-2-5 and (1-21) were added in an amount of $1.0\times10^{4}$ mol/mol.AgX (first addition) and $1.0\times10^{-4}$ mol/mol.AgX, respectively, immediately before the addition of sensitizing dye (GS-1), and compounds (1-21) and (9-2) were added in an amount of $1.0\times10^{-4}$ mol/mol.AgX and $1.0\times10^{-6}$ mol/mol.AgX, respectively, at the completion of 90% of the chemical sensitization time of from the addition of sodium thiosulfate to the addition of compound S-2-5 (second addition).

Preparation of Green-sensitive Silver Halide Emulsion (G-15j)

A green-sensitive silver halide emulsion (G-15j) was prepared similarly to the foregoing green-sensitive silver halide emulsion (G-10a), except that the silver halide emulsion (G-10) was replaced by the silver halide emulsion (G-15) of Example 7, compound S-2-5 was added (first addition) in an amount of $1.0\times10^{-4}$ mol/mol.AgX immediately before the addition of sensitizing dye (GS-1), and compounds (1-21) and (4-0) were added in an amount of $1.0\times10^{-4}$ mol/mol.AgX and $2.0\times10^{-6}$ mol/mol.AgX, respectively, at the completion of 90% of the chemical sensitization time of from the addition of sodium thiosulfate to the addition of compound S-2-5 (second addition).

Preparation of Green-sensitive Silver Halide Emulsion (G-15k)

A green-sensitive silver halide emulsion (G-15k) was prepared similarly to the foregoing green-sensitive silver halide emulsion (G-10a), except that the silver halide emulsion (G-10) was replaced by the silver halide emulsion (G-15) of Example 7, compounds S-2-5 and (9-2) were added in an amount of $1.0\times10^{-4}$ mol/mol.AgX (first addition) and $1.0\times10^{-6}$ mol/mol.AgX, respectively, immediately before the addition of sensitizing, and compounds (1-21) and (4-0) were added in an amount of $1.0\times10^{-4}$ mol/mol.AgX and $2.0\times10^{-6}$ mol/mol.AgX, respectively, at the completion of 90% of the chemical sensitization time of from the addition of sodium thiosulfate to the addition of compound S-2-5 (second addition).

Preparation of Green-sensitive Silver Halide Emulsion (G-15m)

A green-sensitive silver halide emulsion (G-15m) was prepared similarly to the foregoing green-sensitive silver halide emulsion (G-10a), except that the silver halide emulsion (G-10) was replaced by the silver halide emulsion (G-15) of Example 7, the addition of sensitizing dye (GS-1) was canceled, compounds S-2-5 and (9-2) were added in an amount of $1.0\times10^{-4}$ mol/mol.AgX (first addition) and $1.0\times10^{-6}$ mol/mol.AgX, respectively, then, sodium thiosulfate and chloroauric acid were successively added, compound (4-0) was added in an amount of $2.0\times10^{-6}$ mol/mol.AgX at the completion of 90% of the chemical sensitization time of from the addition of sodium thiosulfate to the addition of compound S-2-5 (second addition), and sensitizing dye (GS-1) was added after the addition of S-2-5 (second addition).

Preparation of Green-sensitive Silver Halide Emulsion (G-15n)

A green-sensitive silver halide emulsion (G-15n) was prepared similarly to the foregoing green-sensitive silver halide emulsion (G-10a), except that the silver halide emulsion (G-10) was replaced by the silver halide emulsion (G-15) of Example 7, compound S-2-5 was added in an amount of $1.0\times10^{-4}$ mol/mol.AgX (first addition) immediately before the addition of sensitizing dye (GS-1), compound (9-2) was added in an amount of $1.0\times10^{-6}$ mol/mol.AgX after the addition of sensitizing dye (GS-1) and before the addition of sodium thiosulfate, compound (1-21) was added in an amount of $1.0\times10^{-4}$ mol/mol.AgX at the completion of 90% of the chemical sensitization time of from the addition of sodium thiosulfate to the addition of compound S-2-5 (second addition), and compound (4-0) was added in an amount of $2.0\times10^{-6}$ mol/mol.AgX at the completion of 95%.

Preparation of Red-sensitive Silver Halide Emulsion (R-10j)

To the silver halide emulsion (R-10) of Example 7, sensitizing dyes (RS-1) and (RS-2) were added at 60° C., a pH of 5.0 and a pAg of 7.1, subsequently, sodium thiosulfate and chloroauric acid were added to perform spectral and chemical sensitization. Following the addition of chemical sensitizers and when optimally ripened, compound (S-2-5) was added to stop ripening. A red-sensitive silver halide emulsion (R-l0j) was thus obtained.

| | |
|---|---|
| Sodium thiosulfate | $1.0\times10^{-5}$ mol/mol AgX |
| Chloroauric acid | $1.2\times10^{-5}$ mol/mol AgX |
| Compound S-2-5 | $1.5\times10^{-4}$ mol/mol AgX |
| Sensitizing dye RS-1 | $1.0\times10^{-4}$ mol/mol AgX |
| Sensitizing dye RS-2 | $1.0\times10^{-4}$ mol/mol AgX |

Preparation of Red-sensitive Silver Halide Emulsion (R-10k)

A red-sensitive silver halide emulsion (R-10k) was prepared similarly to the foregoing red-sensitive silver halide emulsion (R-10j), except that compound (1-2) was added in an amount of $1.5\times10^{-4}$ mol/mol AgX immediately after the addition of compound (S-2-5).

Preparation of Red-sensitive Silver Halide Emulsion (R-10m)

A red-sensitive silver halide emulsion (R-10m) was prepared similarly to the foregoing red-sensitive silver halide emulsion (R-10j), except that compound (4-6) was added in an amount of $1.5\times10^{-4}$ mol/mol.AgX immediately after the addition of compound (S-2-5).

Preparation of Red-sensitive Silver Halide Emulsion (R-10n)

A red-sensitive silver halide emulsion (R-10n) was prepared similarly to the foregoing red-sensitive silver halide emulsion (R-10a), except that compound S-2-5 was added in an amount of $1.0\times10^{-4}$ mol/mol.AgX (first addition) immediately before the addition of sensitizing dyes (RS-1) and (RS-2) and compound (1-2) was added in an amount of $2.0\times10^{-4}$ mol/mol.AgX at the completion of 50% of the chemical sensitization time of from the addition of sodium thiosulfate to the addition of compound S-2-5 (second addition).

Preparation of Red-sensitive Silver Halide Emulsion (R-10p)

A red-sensitive silver halide emulsion (R-10p) was prepared similarly to the foregoing red-sensitive silver halide emulsion (R-10a), except that compound S-2-5 was added in an amount of $1.0\times10^{-4}$ mol/mol.AgX (first addition) immediately before the addition of sensitizing dyes (RS-1) and (RS-2) and compound (4-6) was added in an amount of $2.0\times10^{-4}$ mol/mol.AgX at the completion of 50% of the chemical sensitization time of from the addition of sodium thiosulfate to the addition of compound S-2-5 (second addition).

Preparation of Red-sensitive Silver Halide Emulsion (R-10q)

A red-sensitive silver halide emulsion (R-10q) was prepared similarly to the foregoing red-sensitive silver halide emulsion (R-10a), except that compound S-2-5 was added in an amount of $1.0\times10^{-4}$ mol/mol.AgX (first addition) immediately before the addition of sensitizing dyes (RS-1) and (RS-2) and compound (1-21) was added in an amount of $2.0\times10^{-4}$ mol/mol.AgX at the completion of 90% of the chemical sensitization time of from the addition of sodium thiosulfate to the addition of compound S-2-5 (second addition).

Preparation of Red-sensitive Silver Halide Emulsion (R-10r)

A red-sensitive silver halide emulsion (R-10r) was prepared similarly to the foregoing red-sensitive silver halide emulsion (R-10a), except that compound S-2-5 was added in an amount of $1.0\times10^{-4}$ mol/mol.AgX (first addition) immediately before the addition of sensitizing dyes (RS-1) and (RS-2) and compound (4-0) was added in an amount of $2.0\times10^{-6}$ mol/mol.AgX at the completion of 90% of the chemical sensitization time of from the addition of sodium thiosulfate to the addition of compound S-2-5 (second addition).

Preparation of Red-sensitive Silver Halide Emulsion (R-12j)

A red-sensitive silver halide emulsion (R-12j) was prepared similarly to the foregoing red-sensitive silver halide emulsion (R-10a), except that the silver halide emulsion (R-10) was replaced by the silver halide emulsion (R-12) of Example 7, compound S-2-5 was added in an amount of $1.0\times10^{-4}$ mol/mol.AgX (first addition) immediately before the addition of sensitizing dyes (RS-1) and (RS-2), and compound (1-21) was added in an amount of $2.0\times10^{-4}$ mol/mol.AgX at the completion of 90% of the chemical sensitization time of from the addition of sodium thiosulfate to the addition of compound S-2-5 (second addition).

Preparation of Red-sensitive Silver Halide Emulsion (R-12k)

A red-sensitive silver halide emulsion (R-12k) was prepared similarly to the foregoing red-sensitive silver halide emulsion (R-10a), except that the silver halide emulsion (R-10) was replaced by the silver halide emulsion (R-12) of Example 7, compound S-2-5 was added in an amount of $1.0\times10^{-4}$ mol/mol.AgX (first addition) immediately before the addition of sensitizing dye (GS-1), and compound (4-0) was added in an amount of $2.0\times10^{-6}$ mol/mol.AgX at the completion of 90% of the chemical sensitization time of from the addition of sodium thiosulfate to the addition of compound S-2-5 (second addition).

Preparation of Red-sensitive Silver Halide Emulsion (R-13j)

A red-sensitive silver halide emulsion (R-13j) was prepared similarly to the foregoing red-sensitive silver halide emulsion (R-10a), except that the silver halide emulsion (R-10) was replaced by the silver halide emulsion (R-13) of Example 7, compound S-2-5 was added an amount of $1.0\times10^{-4}$ mol/mol.AgX (first addition) immediately before the addition of sensitizing dyes (RS-1) and (RS-2) and compound (1-21) was added in an amount of $2.0\times10^{-4}$ mol/mol.AgX at the completion of 90% of the chemical sensitization time of from the addition of sodium thiosulfate to the addition of compound S-2-5 (second addition).

Preparation of Red-sensitive Silver Halide Emulsion (R-13k)

A red-sensitive silver halide emulsion (R-13k) was prepared similarly to the foregoing red-sensitive silver halide emulsion (R-10a), except that the silver halide emulsion (R-10) was replaced by the silver halide emulsion (R-13) of Example 7, compound S-2-5 was added in an amount of $1.0\times10^{-4}$ mol/mol.AgX (first addition) immediately before the addition of sensitizing dyes (RS-1) and (RS-2), and compound (4-0) was added in an amount of $2.0\times10^{-6}$ mol/mol.AgX at the completion of 90% of the chemical sensitization time of from the addition of sodium thiosulfate to the addition of compound S-2-5 (second addition).

Preparation of Red-sensitive Silver Halide Emulsion (R-14j)

A red-sensitive silver halide emulsion (R-14j) was prepared similarly to the foregoing red-sensitive silver halide emulsion (R-10a), except that the silver halide emulsion (R-10) was replaced by the silver halide emulsion (R-14) of Example 7, compound S-2-5 was added in an amount of $1.0\times10^{-4}$ mol/mol.AgX (first addition) immediately before the addition of sensitizing dyes (RS-1) and (RS-2), and compounds (1-21) and (4-0) were added in an amount of $1.0\times10^{-4}$ mol/mol.AgX and $1.0\times10^{-6}$ mol/mol.AgX, respectively, at the completion of 90% of the chemical sensitization time of from the addition of sodium thiosulfate to the addition of compound S-2-5 (second addition).

Preparation of Red-sensitive Silver Halide Emulsion (R-14k)

A red-sensitive silver halide emulsion (R-14k) was prepared similarly to the foregoing red-sensitive silver halide emulsion (R-10a), except that the silver halide emulsion (R-10) was replaced by the silver halide emulsion (R-14) of Example 7, compounds S-2-5 and (1-21) were added in an amount of $1.0\times10^{-4}$ mol/mol.AgX (first addition) and $1.0\times10^{-4}$ mol/mol.AgX, respectively, immediately before the addition of sensitizing dyes (RS-1) and (RS-2), and compounds (1-21) and (9-2) were added in an amount of $1.0\times10^{-4}$ mol/mol.AgX and $1.0\times10^{-6}$ mol/mol.AgX, respectively, at the completion of 90% of the chemical sensitization time of from the addition of sodium thiosulfate to the addition of compound S-2-5 (second addition).

Preparation of Red-sensitive Silver Halide Emulsion (R-15j)

A red-sensitive silver halide emulsion (R-15j) was prepared similarly to the foregoing red-sensitive silver halide emulsion (R-10a), except that the silver halide emulsion (R-10) was replaced by the silver halide emulsion (R-15) of Example 7, compound S-2-5 was added in an amount of $1.0\times10^{-4}$ mol/mol.AgX (first addition) immediately before the addition of sensitizing dyes (RS-1) and (RS-2), and compounds (1-21) and (4-0) were added in an amount of $1.0\times10^{-4}$ mol/mol.AgX and $2.0\times10^{-6}$ mol/mol.AgX, respectively, at the completion of 90% of the chemical sensitization time of from the addition of sodium thiosulfate to the addition of compound S-2-5 (second addition).

Preparation of Red-sensitive Silver Halide Emulsion (R-15k)

A red-sensitive silver halide emulsion (R-15k) was prepared similarly to the foregoing red-sensitive silver halide emulsion (R-10a), except that the silver halide emulsion (R-10) was replaced by the silver halide emulsion (R-15) of Example 7, compounds S-2-5 and (9-2) were added in an amount of $1.0\times10^{-4}$ mol/mol.AgX (first addition) and $1.0\times10^{-6}$ mol/mol.AgX, respectively, immediately before the addition of sensitizing, and compounds (1-21) and (4-0) were added in an amount of $1.0\times10^{-4}$ mol/mol.AgX and $2.0\times10^{-6}$ mol/mol.AgX, respectively, at the completion of 90% of the chemical sensitization time of from the addition of sodium thiosulfate to the addition of compound S-2-5 (second addition).

Preparation of Red-sensitive Silver Halide Emulsion (R-15m)

A red-sensitive silver halide emulsion (R-15m) was prepared similarly to the foregoing red-sensitive silver halide emulsion (R-10a), except that the silver halide emulsion (R-10) was replaced by the silver halide emulsion (R-15) of Example 7, the addition of sensitizing dyes (RS-1) and (RS-2) was canceled, compounds S-2-5 and (9-2) were added in an amount of $1.0\times10^{-4}$ mol/mol.AgX (first addition) and $1.0\times10^{-6}$ mol/mol.AgX, respectively, then, sodium thiosulfate and chloroauric acid were successively added, compound (4-0) was added in an amount of $2.0\times10^{-6}$ mol/mol.AgX at the completion of 90% of the chemical sensitization time of from the addition of sodium thiosulfate to the addition of compound S-2-5 (second addition), and sensitizing dyes (RS-1) and (RS-2) were added after the addition of S-2-5 (second addition).

Preparation of Red-sensitive Silver Halide Emulsion (R-15n)

A red-sensitive silver halide emulsion (R-15n) was prepared similarly to the foregoing red-sensitive silver halide emulsion (R-10a), except that the silver halide emulsion (R-10) was replaced by the silver halide emulsion (R-15) of Example 7, compound S-2-5 was added in an amount of $1.0\times10^{-4}$ mol/mol.AgX (first addition) immediately before the addition of sensitizing dyes (RS-1) and (RS-2), compound (9-2) was added in an amount of $1.0\times10^{-6}$ mol/mol.AgX after the addition of sensitizing dyes (RS-1) and (RS-2) and before the addition of sodium thiosulfate, compound (1-21) was added in an amount of $1.0\times10^{-4}$ mol/mol.AgX at the completion of 90% of the chemical sensitization time of from the addition of sodium thiosulfate to the addition of compound S-2-5 (second addition), and compound (4-0) was added in an amount of $2.0\times10^{-6}$ mol/mol.AgX at the completion of 95%.

In the foregoing preparation of red-sensitive silver halide emulsions, $2.0\times10^{-3}$ mol/mol.AgX of SS-1 was added at the completion of the preparation.

Photographic material samples 401 to 417 were prepared similarly to sample 101 of Example 1, except that the blue-sensitive silver halide emulsion (B-1a) used in the 1st layer, the green-sensitive silver halide emulsion (G-1a) used in the 3rd layer and the red-sensitive silver halide emulsion (R-1a) used in the 5th layer were respectively replaced by silver halide emulsions shown in Table 13. The thus prepared samples were evaluated similarly to Example 1 and results thereof are shown in Table 14.

TABLE 13

| Sample | Silver Halide Emulsion | | | |
|---|---|---|---|---|
| No. | 1st Layer | 3rd Layer | 5th Layer | Remark |
| 401 | B-10j | G-10j | R-10j | Comp. |
| 402 | B-10k | G-10k | R-10k | Comp. |
| 403 | B-10m | G-10m | R-10m | Comp. |
| 404 | B-10n | G-10n | R-10n | Inv. |
| 405 | B-10p | G-10p | R-10p | Inv. |
| 406 | B-10q | G-10q | R-10q | Inv. |
| 407 | B-10r | G-10r | R-10r | Inv. |

TABLE 13-continued

| Sample No. | Silver Halide Emulsion 1st Layer | 3rd Layer | 5th Layer | Remark |
|---|---|---|---|---|
| 408 | B-12j | G-12j | R-12j | Inv. |
| 409 | B-12k | G-12k | R-12k | Inv. |
| 410 | B-13j | G-13j | R-13j | Inv. |
| 411 | B-13k | G-13k | R-13k | Inv. |
| 412 | B-14j | G-14j | R-14j | Inv. |
| 413 | B-14k | G-14k | R-14k | Inv. |
| 414 | B-15j | G-15j | R-15j | Inv. |
| 415 | B-15k | G-15k | R-15k | Inv. |
| 416 | B-15m | G-15m | R-15m | Inv. |
| 417 | B-15n | G-15n | R-15n | Inv. |

TABLE 14

| Sample No. | S | Fog | γ | Storage Stability | Pressure Resistance | Remark |
|---|---|---|---|---|---|---|
| 401 | 100 | 100 | 100 | 144 | E | Comp. |
| 402 | 105 | 90 | 103 | 128 | D | Comp. |
| 403 | 103 | 92 | 102 | 128 | D | Comp. |
| 404 | 117 | 81 | 110 | 105 | C | Inv. |
| 405 | 115 | 79 | 108 | 102 | C | Inv. |
| 406 | 125 | 77 | 110 | 98 | B | Inv. |
| 407 | 127 | 77 | 113 | 97 | B | Inv. |
| 408 | 130 | 71 | 125 | 84 | A | Inv. |
| 409 | 129 | 70 | 122 | 85 | A | Inv. |
| 410 | 134 | 70 | 127 | 82 | A | Inv. |
| 411 | 135 | 69 | 127 | 83 | A | Inv. |
| 412 | 141 | 70 | 131 | 80 | A | Inv. |
| 413 | 140 | 68 | 133 | 76 | A | Inv. |
| 414 | 147 | 68 | 137 | 76 | A | Inv. |
| 415 | 145 | 67 | 136 | 74 | A | Inv. |
| 416 | 146 | 68 | 140 | 74 | A | Inv. |
| 417 | 144 | 67 | 137 | 75 | A | Inv. |

As is apparent from Table 14, it was proved that samples using the silver halide emulsion relating to this invention resulted in enhanced sensitivity, minimized fogging and higher contrast when exposed at a high intensity and improved storage stability and pressure resistance, as compared to comparative samples.

Example 11

Sample 401 to 417 of Example 7 were evaluated similarly to Example 2. Results are shown in Table 15. As is apparent therefrom, inventive samples led to superior results compared to comparative samples.

TABLE 15

| Sample No. | Clearness of Fine Line and Letter | Skin Tone Repro-duction | Reproduction of Leaves Green | Print reprodu-cibility | Remark |
|---|---|---|---|---|---|
| 401 | D | D | D | D | Comp. |
| 402 | D | C | C | D | Comp. |
| 403 | D | C | C | D | Comp. |
| 404 | B | B | B | B | Inv. |
| 405 | B | B | B | B | Inv. |
| 406 | B | B | B | B | Inv. |
| 407 | B | B | B | B | Inv. |
| 408 | A | B | A | A | Inv. |
| 409 | A | B | A | A | Inv. |
| 410 | A | A | A | A | Inv. |
| 411 | A | A | A | A | Inv. |
| 412 | A | A | A | A | Inv. |
| 413 | A | A | A | A | Inv. |

TABLE 15-continued

| Sample No. | Clearness of Fine Line and Letter | Skin Tone Repro-duction | Reproduction of Leaves Green | Print reprodu-cibility | Remark |
|---|---|---|---|---|---|
| 414 | A | A | A | A | Inv. |
| 415 | A | A | A | A | Inv. |
| 416 | A | A | A | A | Inv. |
| 417 | A | A | A | A | Inv. |

Example 12

Samples 401 to 417 of Example 10 were evaluated similarly to Example 3. Results are shown in Table 16. As is apparent therefrom, inventive samples led to superior results compared to comparative samples.

TABLE 16

| Sample No. | Clearness of Fine Line and Letter | Skin Tone Repro-duction | Reproduction of Leaves Green | Print reprodu-cibility | Remark |
|---|---|---|---|---|---|
| 401 | D | D | D | D | Comp. |
| 402 | D | C | D | D | Comp. |
| 403 | D | C | D | D | Comp. |
| 404 | B | B | B | A | Inv. |
| 405 | B | B | B | A | Inv. |
| 406 | A | B | B | A | Inv. |
| 407 | A | B | B | A | Inv. |
| 408 | A | B | A | A | Inv. |
| 409 | A | B | A | A | Inv. |
| 410 | A | A | A | A | Inv. |
| 411 | A | A | A | A | Inv. |
| 412 | A | A | A | A | Inv. |
| 413 | A | A | A | A | Inv. |
| 414 | A | A | A | A | Inv. |
| 415 | A | A | A | A | Inv. |
| 416 | A | A | A | A | Inv. |
| 417 | A | A | A | A | Inv. |

What is claimed is:

1. A silver halide emulsion comprising silver halide grains containing at least 90 mol % chloride, 0.02 to 5.0 mol % bromide and 0 to 2.0 mol % iodide, wherein the silver halide emulsion is prepared by a process comprising the steps of (i) forming a silver halide grain emulsion, (ii) subjecting the silver halide emulsion to desalting to remove soluble salts and (iii) subjecting the desalted silver halide emulsion to chemical sensitization by adding a chemical sensitizer, wherein in the step (iii), at least one compound represented by the following formula (1) to (4) is added before adding a chemical sensitizer and at least one compound represented by the following formula (1) to (4) is further added after adding a chemical sensitizer:

$$R—SO_2S—M \quad \text{formula (1)}$$

$$R_1—SO_2S—R_2 \quad \text{formula (2)}$$

$$R_3—SO_2S—L_m—SSO_2—R_4 \quad \text{formula (3)}$$

wherein R, $R_1$, $R_2$, $R_3$, and $R_4$ are each an aliphatic group, an aromatic group or a heterocyclic group; M is a cation; L is a divalent linkage group; and m is 0 or 1;

formula (4)

$$R_{11}—(S)_{m1}—R_{12}$$

wherein $R_{11}$ and $R_{12}$ are each an aliphatic group, an aromatic group or a heterocyclic group, or $R_{11}$ and $R_{12}$ combine with each other to form a ring; m1 is an integer of 2 to 6.

2. The silver halide emulsion of claim 1, wherein in the step (iii), at least one compound represented by formula (1) to (3) is added before adding a chemical sensitizer and at least one compound selected from the group consisting of compounds represented by formula (1) to (3) is further added after adding a chemical sensitizer.

3. The silver halide emulsion of claim 1, wherein in the step (iii), at least one compound represented by formula (4) is added before adding a chemical sensitizer and at least one compound represented by formula (4) is further added after adding a chemical sensitizer.

4. The silver halide emulsion of claim 1, wherein in the step (iii), at least one compound represented by formula (1) to (3) and at least one compound represented by formula (4) are added before completing the chemical sensitization.

5. The silver halide emulsion of claim 4, wherein in the step (iii), said at least one compound represented by formula (1) to (3) and at least one compound represented by formula (4) are added in the presence of a compound represented by the following formula (S):

formula (S)

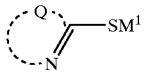

wherein Q is an atomic group necessary to form a 5- or 6-membered nitrogen-containing ring; $M^1$ is a hydrogen atom, alkali metal or a cation group.

6. The silver halide emulsion of claim 1, wherein the silver halide grains include in the interior of the grains a compound represented by the following formula (S):

formula (S)

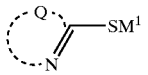

wherein Q is an atomic group necessary to form a 5- or 6-membered nitrogen-containing ring; $M^1$ is a hydrogen atom, alkali metal or a cation group.

7. The silver halide emulsion of claim 1, wherein the silver halide grains include in the interior of the grains at least a Group 8 metal compound and at least an iridium compound.

8. A silver halide photographic material comprising on a support at least one image forming layer, wherein the image forming layer comprises a silver halide emulsion as claimed in claim 1.

9. A method of preparing a silver halide emulsion comprising silver halide grains containing at least 90 mol % chloride, 0.02 to 5.0 mol % bromide and 0 to 2.0 mol % iodide, the process comprising the steps of:

(i) forming a silver halide grain emulsion by mixing a silver salt and a halide salt to form silver halide host grains, (ii) subjecting the silver halide grain emulsion to desalting to remove soluble salts and (iii) subjecting the desalted silver halide emulsion to chemical sensitization by adding a chemical sensitizer wherein in the step (iii), at least one compound represented by the following formula (1) to (4) is added before adding a chemical sensitizer and at least one compound represented by formula (1) to (4) is further added after adding a chemical sensitizer:

formula (1)

$$R—SO_2S—M$$

formula (2)

$$R_1—SO_2S—R_2$$

formula (3)

$$R_3—SO_2S—L_m—SSO_2—R_4$$

wherein R, $R_1$, $R_2$, $R_3$, and $R_4$ are each an aliphatic group, an aromatic group or a heterocyclic group; M is a cation; L is a divalent linkage group; and m is 0 or 1;

formula (4)

$$R_{11}—(S)_{m1}—R_{12}$$

wherein $R_{11}$ and $R_{12}$ are each an aliphatic group, an aromatic group or a heterocyclic group, or $R_{11}$ and $R_{12}$ combine with each other to form a ring; m1 is an integer of 2 to 6.

10. The method of claim 9, wherein in the step (iii), at least one compound represented by formula (1) to (3) is added before adding a chemical sensitizer and at least one compound selected from the group consisting of compounds represented by formula (1) to (3) is further added after adding a chemical sensitizer.

11. The method of claim 9, wherein in the step (iii), at least one compound represented by formula (4) is added before adding a chemical sensitizer and at least one compound represented by formula (4) is further added after adding a chemical sensitizer.

12. The method of claim 9, wherein in the step (iii), at least one compound represented by formula (1) to (3) and at least one compound represented by formula (4) are added before completing the chemical sensitization.

13. The silver halide emulsion of claim 12, wherein in the step (iii), a compound represented by the following formula (S) is added before adding a chemical sensitizer:

formula (S)

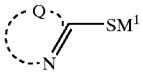

wherein Q is an atomic group necessary to form a 5- or 6-membered nitrogen-containing ring; $M^1$ is a hydrogen atom, alkali metal or a cation group.

14. The method of claim 9, wherein a compound represented by the following formula (S) is added at a time during the step (i):

formula (S)

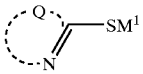

wherein Q is an atomic group necessary to form a 5- or 6-membered nitrogen-containing ring; $M^1$ is a hydrogen atom, alkali metal or a cation group.

15. The method of claim 9, wherein at least a Group 8 metal compound and at least an iridium compound are added at a time during the step (i).

* * * * *